US006727057B2

(12) United States Patent
Suzuki et al.

(10) Patent No.: US 6,727,057 B2
(45) Date of Patent: Apr. 27, 2004

(54) HEAT-DEVELOPABLE PHOTOSENSITIVE MATERIAL

(75) Inventors: Keiichi Suzuki, Kanagawa (JP); Yoshiharu Yabuki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/401,599

(22) Filed: Mar. 31, 2003

(65) Prior Publication Data

US 2003/0198907 A1 Oct. 23, 2003

(30) Foreign Application Priority Data

Mar. 29, 2002 (JP) ..... P2002-096797

(51) Int. Cl.[7] ..... G03C 1/498; G03C 1/675; G03C 1/40

(52) U.S. Cl. ..... 430/619; 430/510; 430/513; 430/517; 430/611; 430/613

(58) Field of Search ..... 430/619, 517, 430/611, 613, 510, 513

(56) References Cited

U.S. PATENT DOCUMENTS

| | | | | |
|---|---|---|---|---|
| 3,178,285 A | * | 4/1965 | Anderau et al. | 430/503 |
| 5,989,796 A | | 11/1999 | Moon | |
| 6,114,106 A | | 9/2000 | Fujiwara et al. | |
| 6,174,657 B1 | | 1/2001 | Wedner et al. | |

FOREIGN PATENT DOCUMENTS

| | | |
|---|---|---|
| DE | 19 17 589 A | 4/1970 |
| DE | 28 18 917 A | 11/1978 |
| DE | 29 45 368 A | 5/1980 |
| EP | 889355 A1 | 1/1999 |
| EP | 0 919 862 A1 | 6/1999 |
| JP | 59-1580 A | 1/1984 |
| WO | 98/36322 | 8/1998 |

* cited by examiner

*Primary Examiner*—Thorl Chea
(74) *Attorney, Agent, or Firm*—Sughrue Mion, PLLC

(57) ABSTRACT

A heat-developable photosensitive material comprising at least one light-sensitive layer containing an organic silver salt, light-sensitive silver halide and a reducing agent and at least one light-insensitive layer on a support, wherein the heat-developable photosensitive material comprises a water-soluble metal phthalocyanine compound.

10 Claims, No Drawings

HEAT-DEVELOPABLE PHOTOSENSITIVE MATERIAL

FIELD OF THE INVENTION

The present invention relates to a heat-developable photosensitive material, and more particularly to a heat-developable photosensitive material that provides images having favorable color tone and color density in the highlight portions after processing and high sharpness.

BACKGROUND OF THE INVENTION

Heat-developable photosensitive materials have been proposed from long ago and are described, for example, in U.S. Pat. Nos. 3,152,904 and 3,457,075, and B. Shely Thermally Processed Silver Systems in *Imaging Processes and Materials: Neblette's,* 8th Edition, J. Sturge, V. Walworth and A. Shepp ed., page 2 (1996).

The heat-developable photosensitive material ordinarily has a light-sensitive layer comprising a catalytically active amount of photo-catalyst (e.g., silver halide), a reducing agent, a silver salt capable of being reduced (e.g., organic silver salt) and a toning agent for controlling color tone of silver image, dispersed in a binder matrix. After imagewise exposure, the heat-developable image recording material is subjected to heating at high temperature (e.g., 80° C. or more), whereby a black silver image is formed upon an oxidation reduction reaction between the silver salt capable of being reduced (which acts as an oxidizing agent) and the reducing agent. The oxidation reduction reaction is accelerated by a catalytic function of latent image of silver halide formed by the imagewise exposure and thus, the black silver image is formed in the exposed area.

In recent years, a simple and rapid development processing has been desired in the field of photographic technology, especially, in the field of photography for medical use or lithographic use. However, improvements in a wet type development processing reach the limit. Therefore, a method of forming images by a heat-development processing has drawn anew attention in the field of photography for medical use or lithographic use. The heat-development processing does not require a processing solution used in the wet type development processing and thus, it has the advantage of being able to conduct development processing simply and rapidly and also it is a processing method taking into account the global environment because waste of the processing solution is not discharged.

In the field of photography for medical use, it is well known to use a blue-colored polyester film, particularly, a polyethylene terephthalate (PET) film containing a 1,4-dianilinoanthracene pigment. Such a blue tone support is preferred since medical experts have been familiarized themselves with the observation of X ray films having blue tone and made a diagnosis on the background of such color tone.

Various proposals for making the blue tone have been made in the field of heat-developable photosensitive material. Specifically, (1) method of coloring a support and (2) method of incorporating a pigment or dye into a layer other than the support have been proposed and practically used. Recently, however, clear images without the blue tone have the preference sometimes in the field of photography for medical use. Accordingly, the latter method is advantageous since it is not necessary to prepare both blue toned supports and clear supports separately. It is also preferable in view of taking into account the global environment because the colored supports are not discharged as waste materials. In addition, it is preferred to add a dye or pigment having an absorption in a range of exposure wavelength for the purpose of preventing irradiation to a light-sensitive layer of the heat-developable photosensitive material. From this point of view, the latter method is preferable.

Examples of the methods of (1) and (2) are described in JP-A-2000-29164 (the term "JP-A" as used herein means an "unexamined published Japanese patent application"), JP-A-2000-158825, JP-A-10-268465 and WO 98/36322. In a case where any layer, which is formed from a coating solution mainly containing water or an organic solvent on the light-sensitive layer side of a support, is colored, there is a problem in that the decomposition and decoloration of dye tends to occur due to the reaction caused in the photosensitive material during heat-development. In order to prevent the decoloration of dye, therefore, it is practical to use pigment.

On the other hand, in case of using a coating solution mainly containing water, since a spectral absorption characteristic of dispersion of pigment in an aqueous medium is not clear, a water-soluble dye is subsidiarily used sometimes as described in the example of JP-A-2000-112060. However, since the water-soluble dye has the tendencies of decoloration as described above and fading during preservation after the heat-development processing, it has a defect that a problem of change in the background color tends to occur.

SUMMARY OF THE INVENTION

An object of the present invention is to provide a heat-developable photosensitive material that is excellent in handleability and provides images having sufficiently high sharpness and background color having a favorable color tone (blue) and color density after development processing and free from change in the background color upon the preservation.

Other objects of the present invention will become apparent from the following description.

As a result of various investigations on the problems described above, the inventors have found that the change in color tone of highlight portion of image after processing can be prevented by the use of a water-soluble metal phthalocyanine compound in a heat-developable photosensitive material to complete the present invention.

The above-described objects of the present invention are accomplished by the following heat-developable photosensitive materials:

(1) A heat-developable photosensitive material comprising at least one light-sensitive layer containing an organic silver salt, light-sensitive silver halide and a reducing agent and at least one light-insensitive layer on a support, wherein the heat-developable photosensitive material comprises a water-soluble metal phthalocyanine compound.

(2) The heat-developable photosensitive material as described in item (1) above, wherein the water-soluble metal phthalocyanine compound is a copper phthalocyanine compound.

(3) The heat-developable photosensitive material as described in item (1) or (2) above, wherein the water-soluble metal phthalocyanine compound is a compound represented by the following formula (Pc-1):

$$MPc(SO_3H)_n(SO_2NHR)_m \quad \text{(Pc-1)}$$

In formula (Pc-1), Pc represents a phthalocyanine skeleton; R represents a hydrogen atom, an alkyl group which may have a substituent, an aryl group which may have a substituent or a heterocyclic group which may have a substituent; n represents a number of from 0 to 4; m represents a number of from 1 to 4; and M represents a metal atom or an oxide, hydroxide or halide thereof.

(4) The heat-developable photosensitive material as described in any one of items (1) to (3) above, wherein the water-soluble metal phthalocyanine compound is present on the same side as the light-sensitive layer provided on the support.

(5) The heat-developable photosensitive material as described in any one of items (1) to (4) above, which further comprises a polyhalogen compound represented by formula (H), (H1) or (H2) shown below incorporated into at least one of the light-sensitive layer and the light-insensitive layer:

$$Q—(Y)_n—C(Z_1)(Z_2)X \quad (H)$$

In formula (H), Q represents an alkyl group, an aryl group or a heterocyclic group; Y represents a divalent connecting group; n represents 0 or 1; $Z_1$ and $Z_2$ each independently represent a halogen atom; and X represents a hydrogen atom or an electron withdrawing group.

(H1)

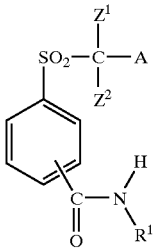

In formula (H1), $Z^1$ and $Z^2$ each independently represent a halogen atom; A represents a hydrogen atom or a halogen atom; and $R^1$ represents an alkyl group having from 2 to 12 carbon atoms, which may have one or more substituents, an alkenyl group having from 2 to 12 carbon atoms, which may have one or more substituents or an alkynyl group having from 2 to 12 carbon atoms, which may have one or more substituents, (H2)

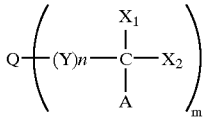

In formula (H2), $X_1$ and $X_2$ each independently represent a halogen atom; Y represents a divalent connecting group; A represents a hydrogen atom, a halogen atom or an electron withdrawing group other than the halogen atom; m represents an integer of from 1 to 4; Q represents a heterocyclic group; and n represents an integer of from 0 to 3.

(6) The heat-developable photosensitive material as described in any one of items (1) to (5) above, wherein the water-soluble metal phthalocyanine compound is incorporated into a layer provided on the side of the support opposite to the side provided with the light-sensitive layer.

(7) The heat-developable photosensitive material as described in any one of items (1) to (6) above, which further comprises a base precursor compound incorporated into a layer provided on the side of the support opposite to the side provided with the light-sensitive layer.

(8) The heat-developable photosensitive material as described in any one of items (1) to (7) above, which further comprises a free ion of metal same as the central metal of the water-soluble metal phthalocyanine compound in an amount of not more than 200 mol % based on the content of water-soluble metal phthalocyanine compound.

(9) The heat-developable photosensitive material as described in any one of items (1) to (7) above, which further comprises a water-soluble organic solvent in an amount of from 1 to 500 moles per mol of the water-soluble metal phthalocyanine compound.

(10) The heat-developable photosensitive material as described in item (9) above, wherein the water-soluble organic solvent is urea.

DETAILED DESCRIPTION OF THE INVENTION

The present invention is described in more detail below.

First, the water-soluble metal phthalocyanine compound for use in the present invention will be described below.

The water-soluble metal phthalocyanine compound is a metal complex of a metal-free phthalocyanine nucleus. The central ion may be any of metal elements capable of forming stably the complex, for example, Na, K, Be, Mg, Mn, Ca, Ba, Cd, Hg, Cr, Fe, Co, Ni, Zn, Pt, Pd, Cu, Ti, V, Si, Sr, Mo, B, Al, Pb or Sn. Transition metal element, for example, chromium, manganese, iron, cobalt, nickel, copper or zinc is preferred, and copper is particularly preferred.

The metal phthalocyanine compound for use in the present invention is water-soluble and has a water-soluble group on the phthalocyanine carbocyclic aromatic ring directly or through a connecting group. As the water-soluble group, a dissociative group having a pK of 6 or less or salt thereof, for example, a sulfonic acid group or salt thereof or a carboxylic acid group or salt thereof, which is bonded directly or through a connecting group to the phthalocyanine carbocyclic aromatic ring. Specific examples thereof include $—SO_2NHSO_2R$, —CONHCOOR and $—SO_2NHCOR$ (wherein R represents a hydrogen atom, an alkyl group which may have a substituent, an aryl group which may have a substituent or a heterocyclic group which may have a substituent).

Also, a compound wherein the metal phthalocyanine compounds are bonded to the main chain of a water-soluble polymer as pendants can be used.

The compounds represented by formula (Pc-X) shown below have been hitherto known to use for forming blue background color, but these compound are not included in the water-soluble metal phthalocyanine compound according to the present invention because they do not have a water-soluble group in the molecules thereof.

(Pc-X)

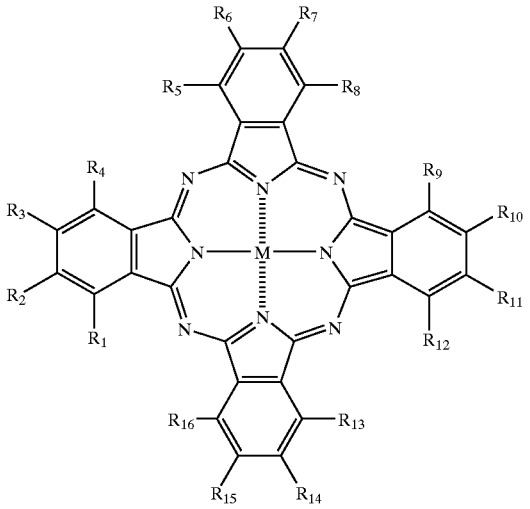

In formula (Pc-X), M represents a multi-valent metal atom; $R_1$, $R_4$, $R_5$, $R_8$, $R_9$, $R_{12}$, $R_{13}$ and $R_{16}$ each independently represents a hydrogen atom or a substituted or unsubstituted, straight chain or branched alkyl group; $R_2$, $R_3$, $R_6$, $R_7$, $R_{10}$, $R_{11}$, $R_{14}$ and $R_{15}$ each independently represents a hydrogen atom, a halogen atom, a substituted or unsubstituted, straight chain or branched alkyl group, a substituted or unsubstituted aryl group, a substituted or unsubstituted alkoxy group or a substituted or unsubstituted aryloxy group; or one or more pairs of $R_1$ and $R_2$, $R_2$ and $R_3$, $R_3$ and $R_4$, $R_5$ and $R_6$, $R_6$ and $R_7$, $R_7$ and $R_8$, $R_9$ and $R_{10}$, $R_{10}$ and $R_{11}$, $R_{11}$ and $R_{12}$, $R_{13}$ and $R_{14}$, $R_{14}$ and $R_{15}$, $R_{15}$ and $R_{16}$ represents an atomic group necessary for forming a substituted or unsubstituted, aromatic or heteroaromatic ring by combining with each other.

Of the water-soluble cyanine dyes, those commercially available which can be used include acid dyes, direct dyes and reactive dyes described in Senryou Binran, Maruzen Co., Ltd. (1975) and Colour Index International Third Edition, The Society of Dye and Colourists (1992). Specifically, C. I. Acid Blue 185, 197, 228, 242, 243, 249, 254, 255, 275, 279 and 283, C. I. Direct Blue 86, 87, 189, 199, 262, 264 and 276, and C. I. Reactive Blue 3, 7, 11, 14, 15, 18, 21, 23, 25, 30, 35, 38, 41, 48, 57, 58, 63, 71, 72, 77, 80, 85, 88, 91, 92, 95, 105, 106, 107, 117, 118, 123, 124, 136, 140, 143, 148, 151, 152, 153, 190, 197, 207, 215, 227, 229 and 231 can be used.

With respect to C. I. Direct Blue 86, there are illustrated specific commercial products, for example, Aizen Primula Turquoise Blue GLH (manufactured by Hodogaya Chemical Co., Ltd.), Cupro Cyanine Blue GL (manufactured by Toyo Ink MFG. Co., Ltd.), Daivogen Turquoise Blue S (manufactured by Dainippon Ink and Chemicals Inc.), Direct Fast Cyanine Blue GL (manufactured by Takaoka Chemical Co., Ltd.), Kayafect Blue GT, Kayafect Blue T and Kayarus Turquoise Blue GL (manufactured by Nippon Kayaku Co., Ltd.), Kiwa Turquoise Blue GL (manufactured by Kiwa Chemical Co., Ltd.), Nankai Direct Fast Cyanine Blue GL (manufactured by Nankai Senryou Co., Ltd.), Phthalocyanine Blue G conc. (manufactured by Usu Chemical Co., Ltd.), Sanyo Turquoise Blue BLR and Sanyo Cyanine Blue SBL conc.-B (manufactured by Sanyo Color Works, Ltd.), Sumilight Supra Turquoise Blue G conc., Sumilight Supra Turquoise Blue FB conc. (manufactured by Sumitomo Chemical Co., Ltd.), Sirius Supra Turquoise Blue GL (manufactured by Bayer), Diazo Light Turquoise JL (manufactured by ICI), Lurantin Light Turquoise Blue GL (manufactured by BASF), and Solar Turquoise Blue GLL (manufactured by Sandoz).

With respect to C. I. Direct Blue 199, there are illustrated specific commercial products, for example, Solar Turquoise Blue FBL (manufactured by Sandoz), Lurantin Light Turquoise Blue FBL (manufactured by BASF), Diazo Light Turquoise JRL (manufactured by ICI), Levacell Fast Turquoise Blue BLN and Levacell Fast Turquoise Blue FBL (manufactured by Bayer), Kayafect Turquoise RN (manufactured by Nippon Kayaku Co., Ltd.), Sumilight Supra Turquoise Blue FB (manufactured by Sumitomo Chemical Co., Ltd.), and Jay Direct Turquoise Blue CGL and Jay Direct Turquoise Blue FBL (manufactured by Jay Chemical Industries).

As the phthalocyanine compounds having favorable color tone and large aggregate absorption according to the present invention, phthalocyanine compounds having a hydrogen bond-forming substituent, for example, a sulfamoyl group, a carbamoyl group or a hydroxy group in the molecules thereof are preferred. Preferred examples thereof include phthalocyanine compounds represented by the following formula (Pc-1):

$$MPc(SO_3H)_n(SO_2NHR)_m \qquad \text{(Pc-1)}$$

In formula (Pc-1), Pc represents a phthalocyanine skeleton; R represents a hydrogen atom, an alkyl group which may have a substituent, an aryl group which may have a substituent or a heterocyclic group which may have a substituent; n represents a number of from 0 to 4; m represents a number of from 1 to 4; and M represents a metal atom or an oxide, hydroxide or halide thereof.

In formula (Pc-1), M is preferably Cu, Ni, Zn or Al, and most preferably Cu. In formula (Pc-1), the sulfo group is indicated by a free form but it may be a salt form. The phthalocyanine compound represented by formula (Pc-1) is water-soluble and has at least one ionic hydrophilic group in the molecules thereof. Examples of the ionic hydrophilic group include a sulfo group, a carboxy group, a phosphono group and a quaternary ammonium group. Of the ionic hydrophilic groups, a carboxy group, a phosphono group and a sulfo group are preferred, and a carboxy group and a sulfo group are particularly preferred. The carboxy group, phosphono group and sulfo group may be salt forms. Examples of counter ions for forming the salts include an ammonium ion, an alkali metal ion (e.g., lithium ion, sodium ion or potassium ion) and an organic cation (e.g., tetramethylammonium ion, tetramethylguanidium ion or tetramethylphosphonium ion).

In addition, reactive phthalocyanine dyes having a triazinyl group and phthalocyanine dyes obtained by hydrolysis of the triazinyl reactive group thereof are preferably used.

Moreover, phthalocyanine compounds having a specific substituent on the β-position thereof as represented by formula (Pc-2) shown below as described in JP-A-2000-303009, JP-A-2002-294097, JP-A-2002-302623, JP-A-2002-249677, JP-A-2002-256167 and JP-A-2002-275386 are preferably used since these compounds provide the large aggregate absorption.

(Pc-2)

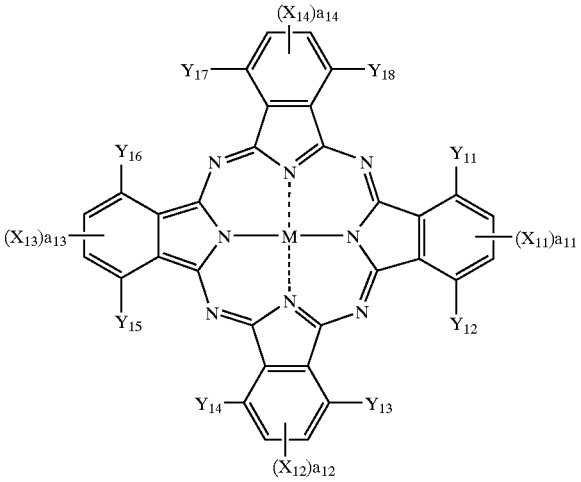

In the above formula, $X_{11}$ to $X_{14}$ each independently represent —SO—Z, —$SO_2$—Z, —$SO_2NR^1R^2$, a sulfo group, —$CONR^1R^2$ or —$CO_2R^1$ wherein Z represents a substituted or unsubstituted alkyl group, a substituted or unsubstituted cycloalkyl group, a substituted or unsubstituted alkenyl group, a substituted or unsubstituted aralkyl group, a substituted or unsubstituted aryl group or a substituted or unsubstituted heterocyclic group, and $R^1$ and $R^2$ each independently represent a hydrogen atom, a substituted or unsubstituted alkyl group, a substituted or unsubstituted cycloalkyl group, a substituted or unsubstituted alkenyl group, a substituted or unsubstituted aralkyl group, a substituted or unsubstituted aryl group or a substituted or unsubstituted heterocyclic group. $Y_{11}$ to $Y_{18}$ each independently represent a monovalent substituent. M represents a multi-valent metal atom. M is preferably Cu, Ni, Zn or Al, and most preferably Cu. $a_{11}$ to $a_{14}$ each independently represent an integer of from 1 to 2. It is preferred that an inequality formula of $4 \leqq a_{11}+a_{12}+a_{13}+a_{14} \leqq 6$ is satisfied, and a case wherein $a_{11}=a_{12}=a_{13}=a_{14}=1$ is particularly preferred.

$X_{11}$, $X_{12}$, $X_{13}$ and $X_{14}$ may be the totally same substituents respectively, or may be the same sort of substituents which are partially different from each other, for example, $X_{11}$, $X_{12}$, $X_{13}$ and $X_{14}$ each represent —$SO_2$—Z groups wherein Z's represent moieties different from each other, or may be fully different from each other, for example, $X_{11}$, $X_{12}$, $X_{13}$ and $X_{14}$ each represent —$SO_2$—Z and —$SO_2NR^1R^2$, which are different from each other.

The phthalocyanine compound represented by formula (Pc-2) is water-soluble and has at least one ionic hydrophilic group in the molecules thereof. Examples of the ionic hydrophilic group include those described with respect to the phthalocyanine compound represented by formula (Pc-1).

Specific examples of preferred phthalocyanine compound represented by formulae (Pc-1) and (Pc-2) are set forth below. In the following examples, an ionic hydrophilic group is represented by a free form, but it also may be a salt form.

(I) C. I. Direct Blue 199

Compound represented by CuPc $(SO_3H)_n(SO_2NHR)_m$ (I-1) n=1, m=3, R=$CH_2CH_2SO_3H$ (I-2) n=2, m=2, R=$CH_2CO_2H$ (I-3) n=3, m=1, R=$CH_2CH_2CO_2H$ (I-4) n=3, m=1, R=$CH_2CH_2OH$ (I-5) n=3, m=1, R=$CH_2CH(OH)CH_3$ (I-6) n=3, m=1, R=$CH_2CH_2OCH_2CH_2OH$ (II) Compound represented by formula (Pc-2) wherein $Y_{11}$ to $Y_{18}$=H and $a_{11}$ to $a_{14}$=1.

(II-1) $X_{11}$ to $X_{14}$=$SO_2NHCH_2CH_2SO_3H$ (II-2) $X_{11}$ to $X_{14}$=$CONHCH_2CO_2H$ (II-3) $X_{11}$ to $X_{14}$=$SO_2CH_2CH_2CH_2SO_3H$ (II-4) $X_{11}$ to $X_{14}$=$SO_3H$ (II-5) $X_{11}$ to $X_{14}$=$CO_2H$ (II-6) $X_{11}$ to $X_{14}$=$CONHCH_2CH_2SO_3H$ (II-7) $X_{11}$ to $X_{14}$=$CONHCH_2SO_3H$ (II-8) $X_{11}$ to $X_{14}$=$SO_2CH_2CH(OH)CH_2SO_3H$

In addition, dyes described in JP-A-2002-294097, JP-A-2002-302623, JP-A-2002-249677, JP-A-2002-256167 and JP-A-2002-275386 are exemplified.

The water-soluble metal phthalocyanine compound according to the present invention can be incorporated into at least one layer provided on the same side as the light-sensitive layer on a support or at least one layer provided on the opposite side to the light-sensitive layer on a support. It is preferred that the water-soluble metal phthalocyanine compound according to the present invention is incorporated into a layer provided on the same side as the light-sensitive layer on a support. It is also preferred that a polyhalogen compound is incorporated into at least one layer provided on the same side as the light-sensitive layer on a support.

When the water-soluble metal phthalocyanine compound according to the present invention is incorporated into a layer provided on the opposite side to the light-sensitive layer on a support, it is also preferred that a base precursor is incorporated into at least one layer provided on the same side as the layer containing the water-soluble metal phthalocyanine compound on a support.

In general, a free ion of metal element same as the central metal of the water-soluble metal phthalocyanine compound according to the present invention adversely affects photographic characteristics of silver halide light-sensitive materials. Therefore, the content of free ion is preferably not more than 200 mol %, more preferably not more than 100 mol %, still more preferably not more than 40 mol %, based on the amount of the phthalocyanine compound in the heat-developable photosensitive material.

It is preferred that the water-soluble metal phthalocyanine compound according to the present invention is one of cyan dyes having an absorption spectrum described below. The measurement of absorption spectrum is performed, for example, according to JIS K0115 "General Rules for Molecular Absorptiometric Analysis".

(1) Cyan dye having absorption peaks both in a range of from 590 nm to 640 nm and in a range of from 650 nm to 710 nm.

(2) Cyan dye having an absorption peak in a range of from 590 nm to 640 nm and no absorption peak (excluding a shoulder that does not form an absorption maximum) in a range of from 650 nm to 710 nm.

(3) Cyan dye having an absorption peak in a range of from 650 nm to 710 nm. and no absorption peak (excluding a shoulder that does not form an absorption maximum) in a range of from 590 nm to 640 nm.

In general, it is known that dyes having the same Colour Index No. exhibit different position and/or size of absorption peak in the spectrum thereof depending on variation of kind, position and/or number of substituents thereof.

Phthalocyanine compounds ordinarily have an absorption peak due to monomer in a range of from 650 nm to 710 nm, preferably from 650 nm to 690 nm, and an absorption peak due to aggregate in a range of from 590 nm to 650 nm, preferably from 600 nm to 650 nm. When the absorption due to monomer is too strong, color tone becomes greenish and is not preferred to obtain blue color favorably accepted in the field of photography for medical use.

For instance, the cyan dye as described in (1) above has absorption over a wide range of wavelength and thus is very preferably used because it can serve various functions, for example, control of color tone, prevention of irradiation, prevention of halation and safelight filter in the photosensitive material.

With respect to an absorption spectrum in a film, assuming that A represents a peak value of an absorption spectrum in a range of from 590 nm to 640 nm and B represents a peak value of an absorption spectrum in a range of from 650 nm to 710 nm, a ratio of B/A can be used for description of preferred embodiments.

Specifically, for the purposes of controlling color tone and suppressing decrease in sensitivity of a red-sensitive photosensitive material, the ratio of B/A is preferably not more than 1.0, more preferably not more than 0.9, and most preferably not more than 0.8.

On the other hand, in case of attaching special importance to the irradiation prevention function or halation prevention function, the ratio of B/A is preferably more than 1.0. From the viewpoint of balancing these functions, the ratio of B/A preferably meets an inequality of $0.5<B/A<1.8$, and most preferably meets an inequality of $0.8<B/A<1.3$.

In the water-soluble metal phthalocyanine compounds having absorption peaks both in a range of from 590 nm to 640 nm and in a range of from 650 nm to 710 nm, a ratio of the peak values in respective compounds is different from each other resulting from variation of kind, position and/or number of substituents thereof.

The cyan dye as described in (2) above has a sharp absorption and large absorption area in the visible region and thus is preferably used because it can effectively serve functions, for example, control of color tone and safelight filter in the photosensitive material only in a small amount. The state of having no peak in the range of from 650 nm to 710 nm of an absorption spectrum in respective compounds is different from each other resulting from variation of kind, position and/or number of substituents thereof.

The cyan dye as described in (3) above has a sharp absorption and small absorption area in the visible region and thus is preferably used because it can effectively serve functions, for example, prevention of irradiation and prevention of halation in the photosensitive material only in a small amount. The state of having no peak in the range of from 590 nm to 640 nm of an absorption spectrum in respective compounds is different from each other resulting from variation of kind, position and/or number of substituents thereof.

With respect to absorbance of the water-soluble metal phthalocyanine compound, the maximum absorbance of a solution prepared by diluting a 2 wt % aqueous solution of the dye 1,000 times with water in the range of from 400 nm to 800 nm is preferably from 0.3 to less than 1.2.

The water-soluble metal phthalocyanine compound according to the present invention is preferably used in the form of an aqueous solution thereof previously prepared using water as a medium in the production of photosensitive material. The content of the water-soluble metal phthalocyanine compound according to the present invention in the aqueous solution is ordinarily in the order of from 0.1 to 30 wt %, preferably from 0.5 to 20 wt %, and more preferably from 1 to 8 wt %. The aqueous solution of dye may further contain a water-soluble organic solvent and an auxiliary additive. The content of water-soluble organic solvent is ordinarily in the order of from 0 to 30 wt %, preferably from 5 to 30 wt %. The content of auxiliary additive is ordinarily in the order of from 0 to 5 wt %, preferably from 0 to 2 wt %.

Specific examples of the water-soluble organic solvent for use in the preparation of aqueous solution of the water-soluble metal phthalocyanine compound according to the present invention include an alkanol having from 1 to 4 carbon atoms, e.g., methanol, ethanol, propanol, isopropanol, butanol, isobutanol, secondary butanol or tertiary butanol, a carboxylic amide, e.g., N,N-dimethylformamide or N,N-dimethylacetamide, a lactam, e.g., ε-caprolactam or N-methylpyrrolidin-2-one, urea, a cyclic urea, e.g., 1,3-dimethylimidazolidin-2-one or 1,3-dimethylhexahydropyrimid-2-one, a ketone or ketoalcohol, e.g., acetone, methyl ethyl ketone or 2-methyl-2-hydroxypentan-4-one, an ether, e.g., tetrahydrofuran or dioxane, a monomer, oligomer, polyalkylene glycol or thioglycol containing an alkylene unit having from 2 to 6 carbon atoms, e.g., ethylene glycol, 1,2- or 1,3-propylene glycol, 1,2- or 1,4-butylene glycol, 1,6-hexylene glycol, diethylene glycol, triethylene glycol, dipropylene glycol, thiodiglycol, polyethylene glycol or polypropylene glycol, a polyol (triol) e.g., glycerin or hexane-1,2,6-triol, an alkyl ether of polyol having from 1 to 4 carbon atoms in the alkyl moiety, e.g., ethylene glycol monomethyl ether, ethylene glycol monoethyl ether, diethylene glycol monomethyl ether, diethylene glycol monoethyl ether, triethylene glycol monomethyl ether or triethylene glycol monoethyl ether, γ-butyrolactone and dimethylsulfoxide. Two or more of the water-soluble organic solvents may be used in combination.

Of the water-soluble organic solvents, urea, N-methylpyrrolidin-2-one and a mono- di- or trialkylene glycol containing an alkylene unit having from 2 to 6 carbon atoms are preferred. Further, mono-, di- or triethylene glycol, dipropylene glycol and dimethylsulfoxide are preferably used. N-methylpyrrolidin-2-one, diethylene glycol, dimethylsulfoxide and urea are more preferably used. Urea is particularly preferred.

Since the aqueous solution of water-soluble metal phthalocyanine compound according to the present invention is diluted by mixing with various other chemicals in the production process of photosensitive material, a water-soluble organic solvent contained is also diluted. Therefore, a method of adding the water-soluble organic solvent in an amount of from 1 to 500 mol per mol of the water-soluble metal phthalocyanine compound is preferably used in the production process.

As the auxiliary additive, for example, antiseptic or antimold, a pH control agent, a chelating agent, an anticorrosive agent, a water-soluble ultraviolet absorbing agent, a water-soluble polymer compound, a dye-dissolving agent or a surfactant is used, if desired.

Examples of the antiseptic or antimold usable include sodium dehydroacetate, sodium sorbate, sodium 2-pyridinethiol-1-oxide, sodium benzoate, sodium pentachlorophenol, benzisothiazolinone and salt thereof, and a parahydroxybenzoic acid ester.

Any substance may be used as the pH control agent, as far as the substance can control the pH of aqueous solution in a range of from 4 to 11 without adversely affecting the aqueous solution prepared. Examples of the pH control agent include an alkanolamine, e.g., diethanolamine or trithanolamine, a hydroxide of alkali metal, e.g., lithium hydroxide, sodium hydroxide or potassium hydroxide, ammonium hydroxide, and a carbonate of alkali metal, e.g., lithium carbonate, sodium carbonate or potassium carbonate.

Examples of the chelating agent include sodium ethylenediaminetetraacetate, sodium nitrilotriacetate, sodium hydroxyethylethylenediaminetriacetate, sodium diethylenetriaminepentaacetate and sodium uracil diacetate. Examples of the anticorrosive agent include an acidic sulfite, sodium thiosulfate, ammonium thioglycolate, diisopropylammonium nitrite, pentaerythritol tetranitrate and dicyclohexylammonium nitrite. Examples of the water-soluble polymer compound include polyvinyl alcohol, a cellulose derivative, polyamine and polyimine. Examples of the water-soluble ultraviolet absorbing agent include a sulfonated benzophenone and a sulfonated benzotriazole. Examples of the dye-dissolving agent include ε-caprolactam, ethylene carbonate and urea. Examples of the surfactant include known surfactants, for example, anionic, cationic and nonionic surfactants, and an acetylene glycol surfactant is preferably used.

The amount of the water-soluble metal phthalocyanine compound is determined to adjust the color tone of image after the heat-development processing to blue taking color tone of silver and color tone caused by other additives into consideration. In general, a dye is used in an amount that provides an optical density measured by the desired wavelength (600 nm in case of a cyan dye) not exceeding 0.5. The optical density is ordinarily from 0.01 to 0.5, preferably from 0.01 to 0.1, and more preferably from 0.01 to 0.05. The amount of the water-soluble metal phthalocyanine compound for obtaining such an optical density is ordinarily in the order of from 0.5 to 150 mg/m$^2$, preferably from 0.5 to 30 mg/m$^2$, more preferably from 0.5 to 15 mg/m$^2$.

Now, the heat-developable photosensitive material of the present invention will be described in more detail below.

(Description of Organic Silver Salt)

The organic silver salt for use in the present invention is a silver salt that is relatively stable to light but functions as a silver ion supplier to form a silver image when heated at 80° C. or higher in the presence of an exposed light-sensitive silver halide and a reducing agent. The organic silver salt may be an appropriate organic substance that can be reduced by the reducing agent and supply a silver ion. Such a light-insensitive organic silver salt is described, for example, in JP-A-10-62899, Paragraph Nos. [0048] to [0049], EP-A-803764, from page 18, line 24 to page 19, line 37, EP-A-962812, JP-A-11-349591, JP-A-2000-7683 and JP-A-2000-72711. A silver salt of organic acid, particularly a silver salt of long-chain aliphatic carboxylic acid (having from 10 to 30 carbon atoms, preferably from 15 to 28 carbon atoms) (fatty acid silver salt) is preferably used.

Preferred examples of the fatty acid silver salt include silver lignocerate, silver behenate, silver arachidate, silver stearate, silver oleate, silver laurate, silver caprate, silver myristate, silver palmitate, silver erucate and a mixture thereof. Of the fatty acid silver salts, those having a silver behenate content of not less than 50 mol % are preferably used. The silver behenate content is more preferably not less than 85 mol %, and still more preferably not less than 95 mol %.

The crystal shape of organic silver salt for use in the invention is not particularly restricted, and any crystal shape, for example, acicular, rod-like, tabular or scaly shape may be used.

The organic silver salt of a scaly shape is preferably used in the invention. Also, organic silver salt grain in the shape of a short needle having an ratio of the major axis to the minor axis of not more than 5, a rectangular solid or a cube, or in an irregular shape like a potato is preferably used. The organic silver salt grains have a feature of restrained fog at the time of heat development, compared with long acicular grains having the ratio of the major axis to the minor axis of more than 5. Particularly, grains having the ratio of the major axis to the minor axis of not more than 3 are preferred because of improvement in mechanical stability of coated film.

The term "organic silver salt of scaly crystal shape" as used in the invention is defined in the following manner. An organic silver salt grain is observed under an electron microscope. The shape of the organic silver salt is approximated to a rectangular solid, and when the edge lengths of the rectangular solid are taken as a, b and c from the shortest (wherein c may be equal to b), x is calculated using the shorter lengths, a and b, as follows:

$$x=b/a$$

In such a manner, x values of about 200 grains are determined. When the grains satisfy a relation of x(average) ≧1.5, wherein x(average) means the average of the x values determined, they are referred to as scaly grains. The grains satisfying the relation of 30≧x(average)≧1.5 are preferred, and those satisfying the relation of 20≧x(average)≧2.0 are more preferred. On the other hand, the acicular grains are defined as grains satisfying the inequality formula 1.5≧x (average)≧1.

In the scaly grain, a can be regarded as thickness of a tabular grain which has a surface with edge lengths of b and c as the principal plane. The average of the a value is preferably from 0.01 to 0.23 μm, more preferably from 0.1 μm to 0.20 μm. The average of the c/b ratio is preferably from 1 to 6, more preferably from 1.05 to 4, still more preferably from 1.1 to 3, and particularly preferably from 1.1 to 2.

It is preferred that the grain size distribution of organic silver salt is monodispersed. The monodisperse means that a percentage of each of the values obtained by dividing standard deviations of the lengths of the minor axis and the major axis respectively by the averages for lengths of the minor axis and the major axes respectively is preferably not more than 100%, more preferably not more than 80%, and still more preferably not more than 50%. The crystal shape of organic silver salt can be determined by transmission electron microscopic photographs of an organic silver salt dispersion.

Another method for determining the monodispersity is a method of determining a standard deviation of the volume weighted average diameter of organic silver salt grain. A percentage of value (variation coefficient) obtained by dividing the standard deviation by the volume weighted average diameter is preferably not more than 100%, more preferably not more than 80%, and still more preferably not more than 50%. The variation coefficient can be calculated, for example, from the grain size value (volume weighted average diameter) obtained by irradiating an organic silver salt dispersed in a liquid with a laser beam and determining an autocorrelation function of change in fluctuation of light scattered from the salt with respect to time.

In the production and dispersion of organic silver salt for use in the invention, known methods can be employed. Specifically, methods described, for example, in JP-A-10-62899, EP-A-803763, EP-A-962812, JP-A-11-349591, JP-A-2000-7683, JP-A-2000-72711, JP-A-2001-163889, JP-A-2001-163890, JP-A-2001-163827, JP-A-2001-33907, JP-A-2001-188313, JP-A-2001-83652, JP-A-2002-6442, JP-A-2002-31870 and JP-A-2002-107868 can be referred to.

The presence of light-sensitive silver salt at the time of dispersing the organic silver salt results in increase in fog and severe reduction in sensitivity. Therefore, it is preferable that the dispersion is carried out in the substantial absence of light-sensitive silver salt. In the invention, the amount of light-sensitive silver salt in the aqueous dispersion of the organic silver salt is preferably not more than 1 mole %, more preferably not more than 0.1 mole %, per mole of the organic acid silver salt. Still more preferably, the light-sensitive silver salt is not positively added to the aqueous dispersion of the organic silver salt.

In the invention, it is possible to prepare a photosensitive material through mixing of an aqueous dispersion of organic silver salt with an aqueous dispersion of light-sensitive silver salt. The mixing ratio of organic silver salt to light-sensitive silver salt can be selected according to the purpose. The proportion of light-sensitive silver salt to organic silver salt is preferably from 1 to 30 mole %, more preferably from 2 to 20 mole %, and particularly preferably from 3 to 15 mole %. A method of mixing two or more aqueous organic silver salt dispersions with two or more aqueous light-sensitive silver salt dispersions is preferably used for the purpose of adjusting photographic characteristics.

The organic silver salt according to the invention can be used in a desired amount. Specifically, the amount of the organic silver salt used is preferably from 0.1 to 5 g/m$^2$, more preferably from 0.3 to 3 g/m$^2$, and still more preferably from 0.5 to 2 g/m$^2$, in terms of the total amount of coated silver including the silver halide. In particular, for the purpose of improving image preservability, the total amount of coated silver is preferably not more than 1.8 g/m$^2$, and more preferably not more than 1.6 g/m$^2$. A sufficient image density can be obtained even in such a small amount of the coated silver. It is advantageous to use a reducing agent according to the invention described below together with the organic silver salt.

(Description of Reducing Agent)

It is preferable for the heat-developable photosensitive material of the invention to contain a thermal developer, which is a reducing agent for the organic silver salt. The reducing agent for organic silver salt may be any of substances (preferably any organic substances) capable of reducing silver ion to metallic silver. Examples of such a reducing agent are described in JP-A-11-65021, paragraphs [0043] to [0045], and EP-A-803764, from page 7, line 34 to page 18, line 12.

As the reducing agent for use in the invention, reducing agents of so-called hindered phenol type having a substituent on the o-position of a phenolic hydroxy group and reducing agents of bisphenol type are preferred. Of the reducing agents, compounds represented by the following formula (R) are more preferably used.

(R)

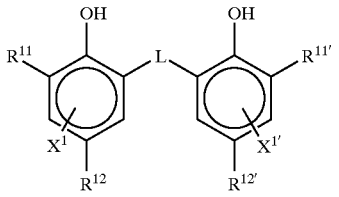

In formula (R), $R^{11}$ and $R^{11'}$ each independently represent an alkyl group containing from 1 to 20 carbon atoms. $R^{12}$ and $R^{12'}$ each independently represent a hydrogen atom or a substituent capable of substituting on the benzene ring. L represents —S— or —CHR$^{13}$—. $R^{13}$ represents a hydrogen atom or an alkyl group containing from 1 to 20 carbon atoms. $X^1$ and $X^{1'}$ each independently represent a hydrogen atom or a substituent capable of substituting on the benzene ring.

The formula (R) is described in more detail below.

$R^{11}$ and $R^{11'}$ each independently represent a substituted or unsubstituted alkyl group from containing from 1 to 20 carbon atoms. The substituent on the alkyl group is not particularly restricted, and preferred examples of the substituents include an aryl group, a hydroxy group, an alkoxy group, an aryloxy group, an alkylthio group, an arylthio group, an acylamino group, a sulfonamido group, a sulfonyl group, a phosphoryl group, an acyl group, a carbamoyl group, an ester group, an ureido group, an urethane group and a halogen atom.

$R^{12}$ and $R^{12'}$ each independently represent a hydrogen atom or a substituent capable of substituting on the benzene ring. $X^1$ and $X^{1'}$ also each independently represent a hydrogen atom or a substituent capable of substituting on the benzene ring. Preferred examples of the substituent capable of substituting on the benzene ring include an alkyl group, an aryl group, a halogen atom, an alkoxy group and an acylamino group.

L represents —S— or —CHR$^{13}$—. $R^{13}$ represents a hydrogen atom or an alkyl group containing from 1 to 20 carbon atoms, which may have a substituent. Examples of the unsubstituted alkyl group represented by $R^{13}$ include methyl, ethyl, propyl, butyl, heptyl, undecyl, isopropyl, 1-ethylpentyl and 2,4,4-trimethylpentyl groups. Examples of the substituent for the alkyl group include the same substituents as described for the alkyl group represented by $R^{11}$.

As $R^{11}$ and $R^{11'}$ each, a secondary or tertiary alkyl group containing from 3 to 15 carbon atoms is preferred. Specific examples of such an alkyl group include isopropyl, isobutyl, tert-butyl, tert-amyl, tert-octyl, cyclohexyl, cyclopentyl, 1-methylcyclohexyl and 1-methylcyclopropyl groups. The group more preferable as $R^{11}$ and $R^{11'}$ each is a tertiary alkyl group containing from 4 to 12 carbon atoms. Of the groups, tert-butyl, tert-amyl and 1-methylcyclohexyl groups are still more preferred, and a tert-butyl group is particularly preferred.

As R and $R^{12'}$ each, an alkyl group containing from 1 to 20 carbon atoms is preferred. Examples of such an alkyl group include methyl, ethyl, propyl, butyl, isopropyl, tert-butyl, t-amyl, cyclohexyl, 1-methylcyclohexyl, benzyl, methoxymethyl and ethoxyethyl groups. Of the groups, methyl, ethyl, propyl, isopropyl and tert-butyl groups are more preferred.

As $X^1$ and $X^{1'}$ each, a hydrogen atom, a halogen atom or an alkyl group is preferred, and a hydrogen atom is more preferred.

L is preferably —CHR$^{13}$—.

$R^{13}$ is preferably a hydrogen atom or an alkyl group containing from 1 to 15 carbon atoms. Preferred examples of such an alkyl group include methyl, ethyl, propyl, isopropyl and 2,4,4-trimethylpentyl groups. A hydrogen atom, a methyl group, an ethyl group, a propyl group and an isopropyl group are particularly preferred as $R^{13}$.

When $R^{13}$ is a hydrogen atom, $R^{12}$ and $R^{12'}$ each represent preferably an alkyl group containing from 2 to 5 carbon atoms, more preferably an ethyl group or a propyl group, particularly preferably an ethyl group.

When $R^{13}$ is a primary or secondary alkyl group containing from 1 to 8 carbon atoms, $R^{12}$ and $R^{12'}$ each preferably represent a methyl group. As the primary or secondary alkyl group containing from 1 to 8 carbon atoms for $R^{13}$, a methyl group, an ethyl group, a propyl group and an isopropyl group are more preferred. In particular, a methyl group, an ethyl group and a propyl group are preferred.

When $R^{11}$, $R^{11'}$, $R^{12}$ and $R^{12'}$ all are methyl groups, it is preferred that $R^{13}$ is a secondary alkyl group. In this case, an isopropyl group, an isobutyl group or a 1-ethylpentyl group is preferred as the secondary alkyl group for $R^{13}$. Of the groups, an isopropyl group is more preferred.

The heat developability and color tone of developed silver vary depending on the combination of $R^{11}$, $R^{11'}$, $R^{12}$, $R^{12'}$ and $R^{13}$ in the reducing agent described above. These characteristics can be adjusted by using two or more reducing agents in combination. Depending on the purpose, therefore, it is preferred to use two or more reducing agents in combination.

Specific examples of the compound represented by formula (R) and other reducing agents for use in the invention are set forth below, but the invention should not be construed as being limited thereto.

(R-1)

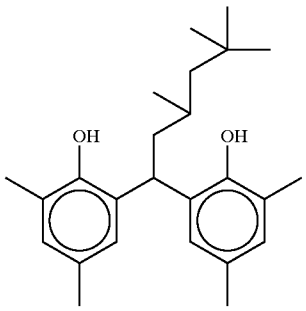

(R-2)

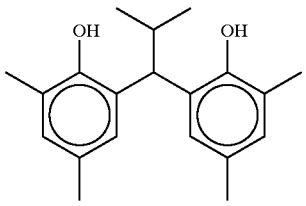

(R-3)

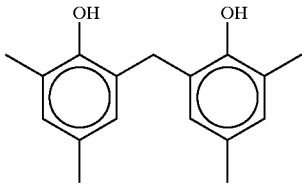

(R-4)

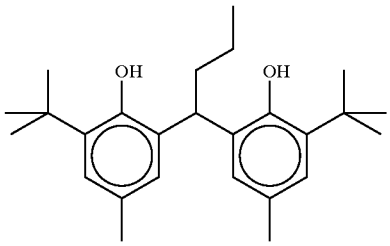

-continued (R-5)

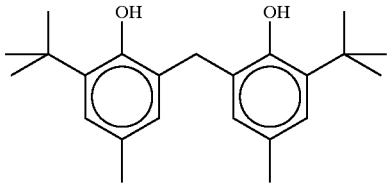

(R-6)

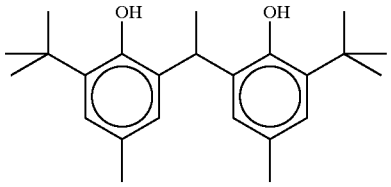

(R-7)

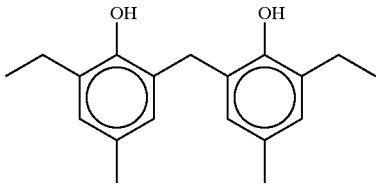

(R-8)

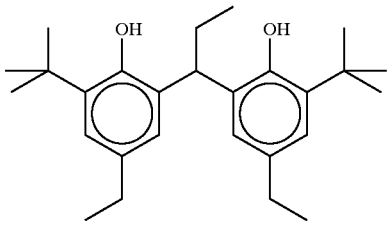

(R-9)

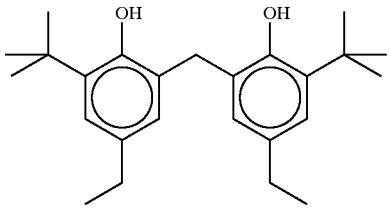

(R-10)

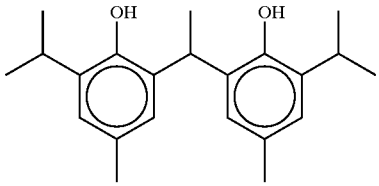

(R-11)

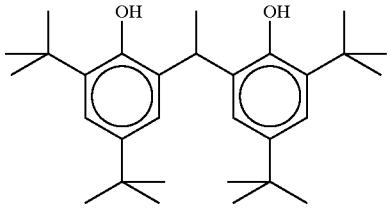

-continued
(R-12)
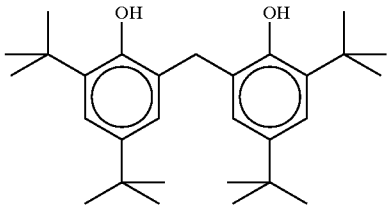
(R-13)
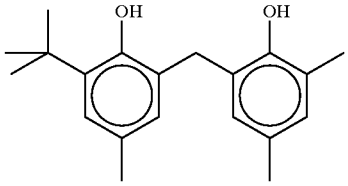
(R-14)
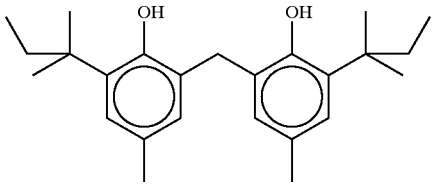
(R-15)
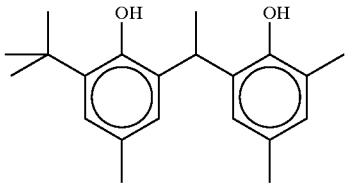
(R-16)
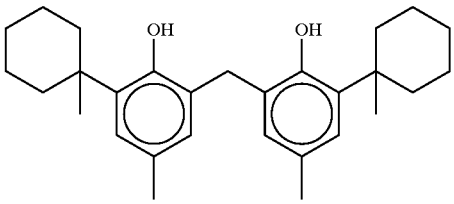
(R-17)
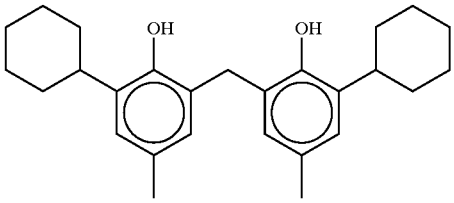
(R-18)
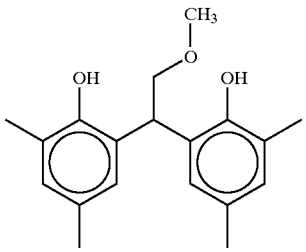
-continued
(R-19)
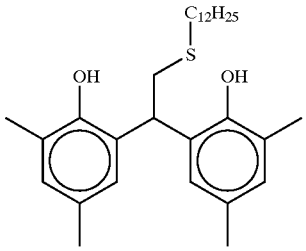
(R-20)
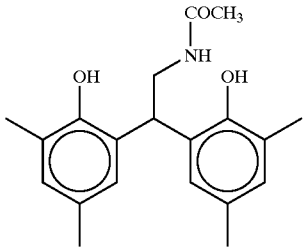
(R-21)
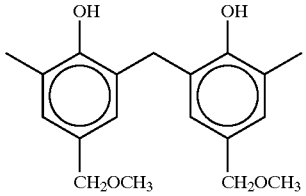
(R-22)
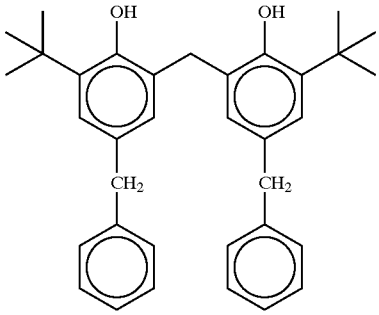
(R-23)
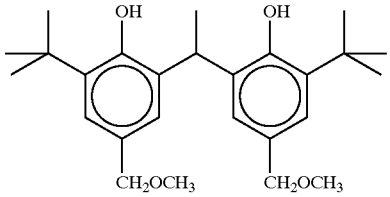
(R-24)
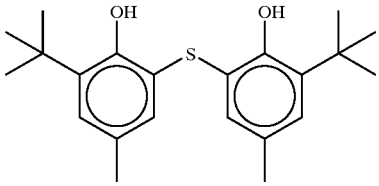
(R-25)
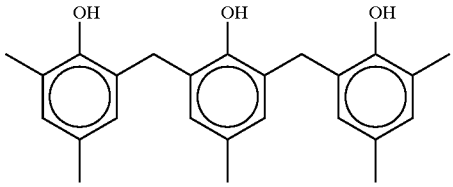

-continued (R-26)

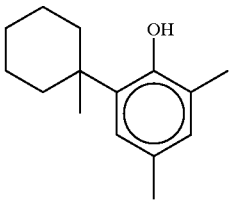

(R-27)

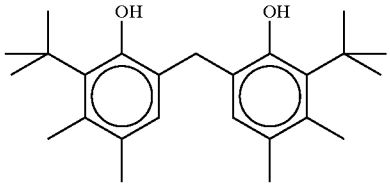

(R-28)

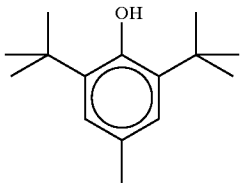

(R-29)

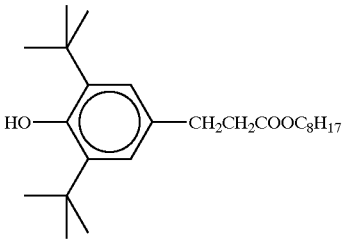

(R-30)

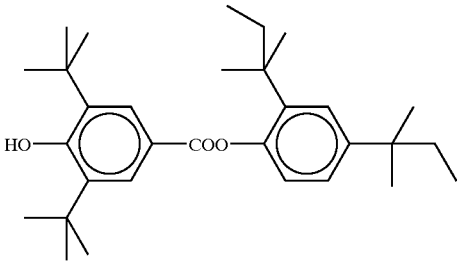

(R-31)

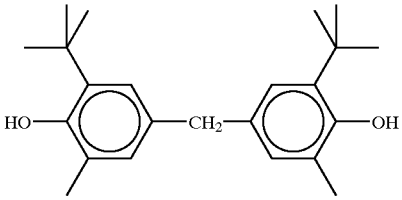

(R-32)

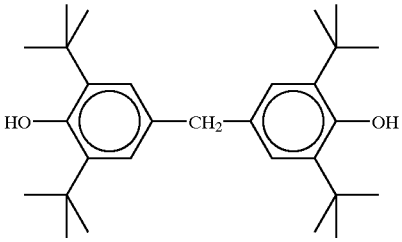

-continued (R-33)

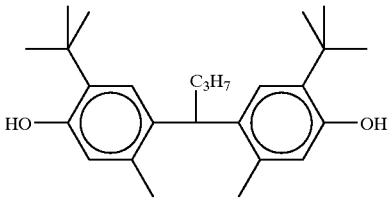

(R-34)

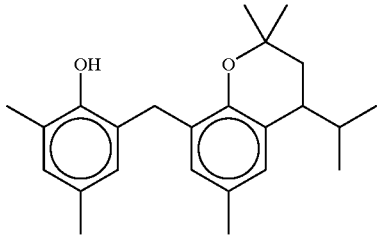

The amount of reducing agent added in the invention is preferably from 0.1 to 3.0 g/m$^2$, more preferably from 0.2 to 1.5 g/m$^2$, and still more preferably from 0.3 to 1.0 g/m$^2$. The amount of reducing agent per mole of silver on the side having the image-forming layer is preferably from 5 to 50 mole %, more preferably from 8 to 30 mole %, and still more preferably from 10 to 20 mole %. It is preferred that the reducing agent is incorporated into the image-forming layer.

The reducing agent may be added to a coating composition in any form, for example, a solution, emulsified dispersion or fine particulate solid dispersion, and incorporated in the photosensitive material.

In a well-known emulsified dispersion method, the reducing agent is dissolved using oil, for example, dibutyl phthalate, tricresyl phosphate, glyceryl triacetate or diethyl phthalate and an auxiliary solvent, for example, ethyl acetate or cyclohexanone, and mechanically prepare an emulsified dispersion thereof.

In a fine particulate solid dispersing method, the reducing agent powder is dispersed in an appropriate solvent, for example, water, by means of a ball mill, a colloid mill, a vibrating ball mill, a sand mill, a jet mill, a roller mill or an ultrasonic wave, thereby preparing a solid dispersion. The dispersion may be performed in the presence of a protective colloid (e.g., polyvinyl alcohol) or a surfactant (e.g., an anionic surfactant, such as sodium triisopropylnaphthalenesulfonate, which is a mixture of those differing in substitution positions of three isopropyl groups). In the mills described above, zirconia beads are ordinarily used as dispersion media. In some cases, therefore, the dispersion is contaminated with zirconium dissolved from the beads. The zirconium content in the dispersion is ordinarily within the range of from 1 to 1,000 ppm, though it depends on dispersing conditions. As far as the zirconium content in the photosensitive material is not higher than 0.5 mg per gram of silver, zirconium produces no adverse effects in a practical sense.

In the aqueous dispersion of reducing gent, it is preferred to incorporate an antiseptic (e.g., sodium benzisothiazolinone).

In the invention, the reducing agent is preferably used as the solid dispersion.

(Description of Development Accelerator)

Compounds preferably used as development accelerator in the heat-developable photosensitive material of the invention include the sulfonamidophenol compounds represented by formula (A) described in JP-A-2000-267222 and JP-A-

2000-330234, the hindered phenol compounds represented by formula (II) described in JP-A-2001-92075, the hydrazine compounds represented by formula (I) described in JP-A-10-62895 and JP-A-11-15116 and formula (1) described in JP-A-2002-278017, and the phenol or naphthol compounds represented by formula (2) described in JP-A-2001-264929. The development accelerator is used in a proportion of from 0.1 to 20 mole %, preferably from 0.5 to 10 mole %, more preferably from 1 to 5 mole %, based on the reducing agents used. The development accelerator can be introduced into the photosensitive material in accordance with the same method as used for the reducing agent. In particular, it is preferable to add the development accelerator as a solid dispersion or an emulsified dispersion. In the case of adding the development accelerator as an emulsified dispersion, it is preferred to prepare the emulsified dispersion by dispersing the development accelerator using both a high boiling solvent, which is a solid at room temperature, and an auxiliary solvent with a low boiling point, or to prepare a so-called oil-less emulsified dispersion by dispersing the development accelerator without using the high boiling solvent.

Of the development accelerators described above, the hydrazine compounds represented by formula (1) described in JP-A-2002-278017 and the phenol or naphthol compounds represented by formula (2) described in JP-A-2001-264929 are particularly preferably used in the invention.

Specific preferred examples of the development accelerator for use in the invention are set forth below, but the invention should not be construed as being limited thereto.

(A-1)

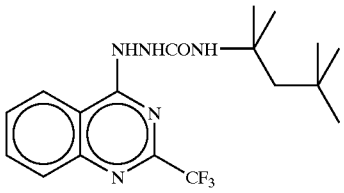

(A-2)

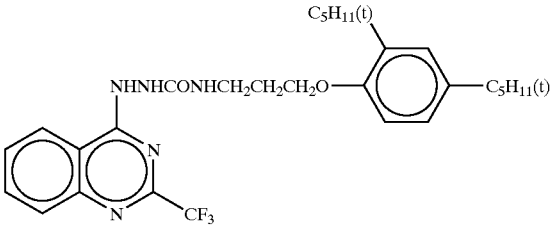

(A-3)

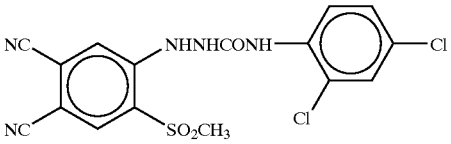

(A-4)

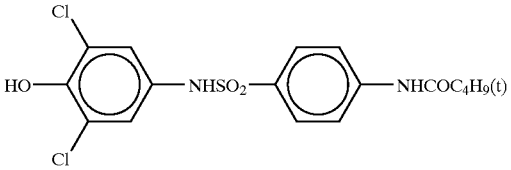

-continued (A-5)

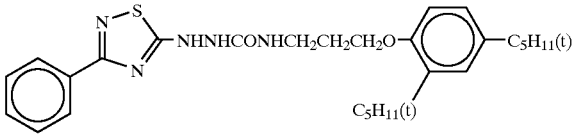

(A-6)

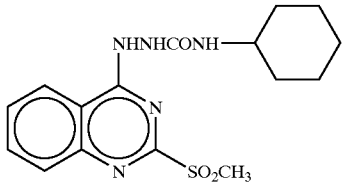

(A-7)

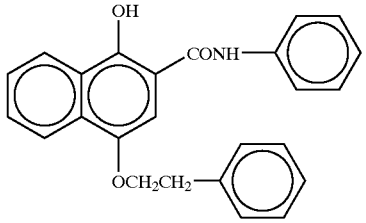

(A-8)

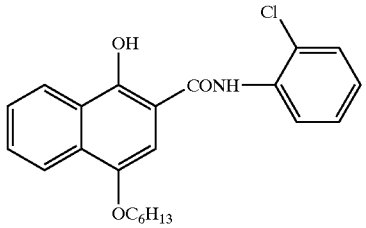

(A-9)

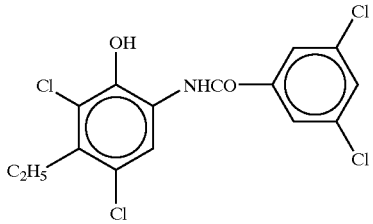

(A-10)

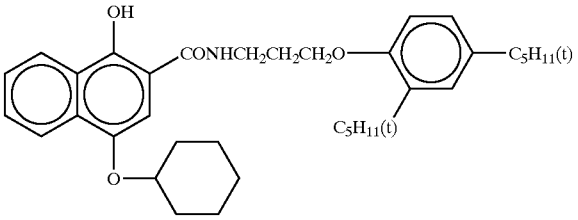

(Description of Hydrogen Bong-Forming Compound)

When the reducing agent used in the invention has an aromatic hydroxy group (—OH), especially in the cases of a bisphenol as described above, a non-reducing compound having a group capable of forming a hydrogen bond with the hydroxy group is preferably used in combination. Examples of the group capable of forming a hydrogen bond together with a hydroxy group or an amino group include a phosphoryl group, a sulfoxido group, a sulfonyl group, a carbonyl group, an amido group, an ester group, an urethane group, an ureido group, a tertiary amino group and a nitrogen-containing aromatic group. Of such compounds, those having a phosphoryl group, a sulfoxido group, an amido group (not having >N—H moiety but being blocked in the form of >N—Ra, wherein Ra is a substituent other than H), an urethane group (not having >N—H moiety but being blocked in the form of >N—Ra, wherein Ra is a substituent other than H) or an ureido group (not having >N—H moiety but being blocked in the form of >N—Ra, wherein Ra is a substituent other than H) are preferred.

The hydrogen bond-forming compound particularly preferably used in the invention is a compound represented by the following formula (D):

(D)

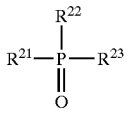

In formula (D), $R^{21}$ to $R^{23}$ each independently represent an alkyl group, an aryl group, an alkoxy group, an aryloxy group, an amino group or a heterocyclic group, each of which may be unsubstituted or may have a substituent. Examples of the substituent for the group represented by any one of $R^{21}$ to $R^{23}$ include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group and a phosphoryl group. Of the groups, an alkyl group and an aryl group, for example, methyl, ethyl, isopropyl, tert-butyl, tert-octyl, phenyl, 4-alkoxyphenyl and 4-acyloxyphenyl groups, are preferred as the substituent.

Examples of the alkyl group for any one of $R^{21}$ to $R^{23}$ include a methyl group, an ethyl group, a butyl group, an octyl group, a dodecyl group, an isopropyl group, a tert-butyl group, a tert-amyl group, a tert-octyl group, a cyclohexyl group, a 1-methylcyclohexyl group, a benzyl group, a phenetyl group and a 2-phenoxypropyl group. Examples of the aryl group include a phenyl group, a cresyl group, a xylyl group, a naphthyl group, a 4-tert-butylphenyl group, a 4-tert-octylphenyl group, a 4-anisidyl group and a 3,5-dichlorophenyl group. Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group. Examples of the aryloxy group include a phenoxy group, a cresyloxy group, an isopropylphenoxy group, a 4-tert-butylphenoxy group, a naphthoxy group and a biphenyloxy group. Examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

As $R^{21}$ to $R^{23}$ each, an alkyl group, an aryl group, an alkoxy group or an aryloxy group is preferred. From the viewpoint of effects achieved by the invention, it is preferable that at least one of $R^{12}$, $R^{22}$ and $R^{23}$ is an alkyl group or an aryl group, and it is more preferable that at least two of $R^{21}$, $R^{22}$ and $R^{23}$ are each an alkyl group or an aryl group. From the viewpoint of availability of low-price compound, it is preferred that $R^{21}$, $R^{22}$ and $R^{23}$ are the same groups.

Specific examples of the hydrogen bond-forming compound including the compound represented by formula (D) for use in the invention are set forth below, but the invention should not be construed as being limited thereto.

(D-1)

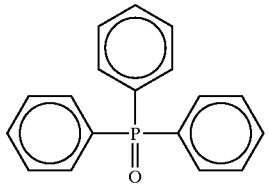

(D-2)

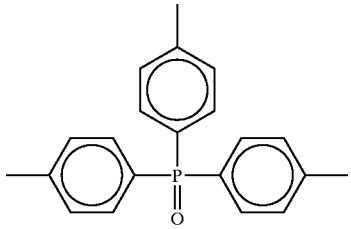

(D-3)

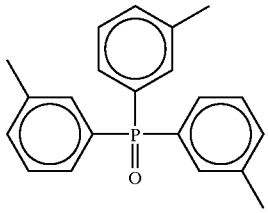

(D-4)

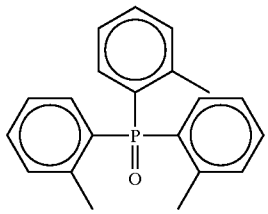

(D-5)

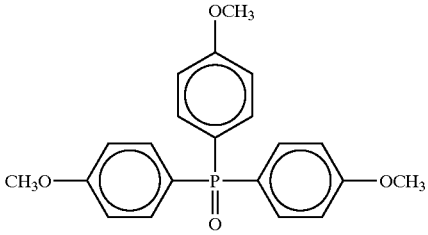

(D-6)

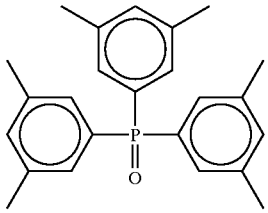

(D-7)

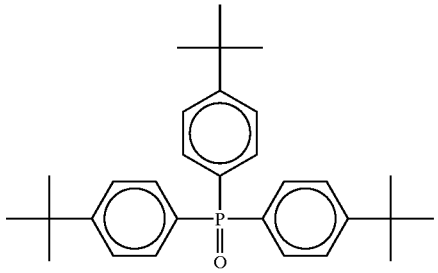

-continued (D-8)

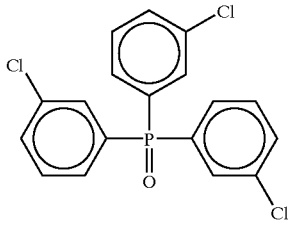

(D-9)

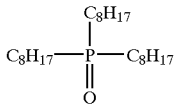

(D-10)

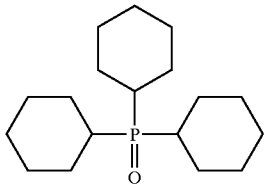

(D-11)

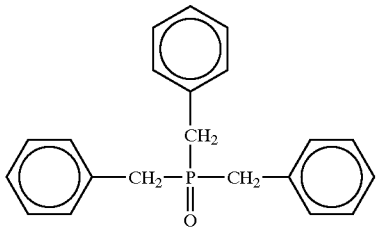

(D-12)

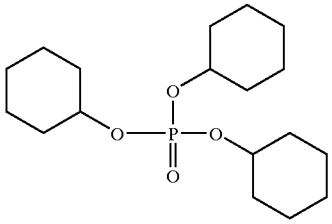

(D-13)

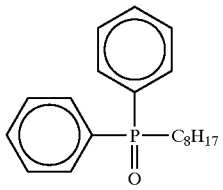

(D-14)

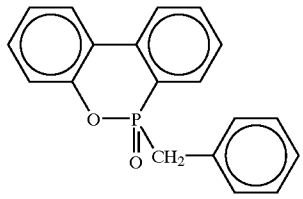

(D-15)

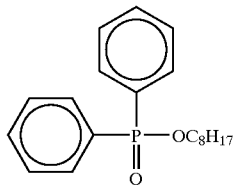

-continued (D-16)

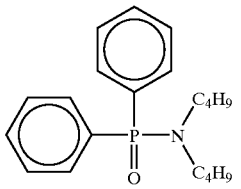

(D-17)

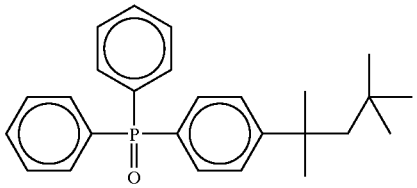

(D-18)

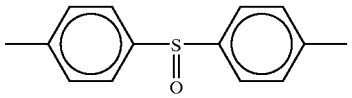

(D-19)

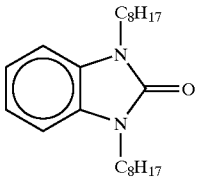

(D-20)

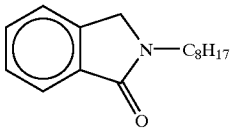

(D-21)

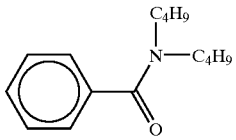

In addition to the compounds described above, examples of the hydrogen bond-forming compound include those described in European Patent 1,096,310 and JP-A-2002-156727 and JP-A-2002-318431.

The compound represented by formula (D) for use in the invention, similar to the case of the reducing agent, can be added to a coating composition in the form of a solution, an emulsified dispersion or a fine particulate solid dispersion, and incorporated into the photosensitive material. The compound is preferably used in the form of solid dispersion. When the compound is in a solution state, the compound forms a complex involving hydrogen bond with a compound containing a phenolic hydroxyl group or an amino group. Depending on the combination of the reducing agent and the compound represented by formula (D) in the invention, the complex thereof can be isolated in a crystal state. The use of the isolated crystal powder as a fine particulate solid dispersion is particularly preferred from the viewpoint of ensuring stable performances. It is also preferred to adopt a method in which powder of the reducing agent and powder of the compound represented by formula (D) are mixed and the resulting mixture is dispersed using an appropriate dispersant by means of a device, for example, a sand grinder mill, thereby forming the complex thereof.

The compound represented by formula (D) is preferably used in a proportion of from 1 to 200 mole %, more preferably from 10 to 150 mole %, still more preferably from 20 to 100 mole %, based on the reducing agent.

(Description of Silver Halide)

The light-sensitive silver halide for use in the invention has no particular restriction as to its halide composition, and any of silver chloride, silver chlorobromide, silver bromide, silver iodobromide, silver iodochlorobromide and silver iodide can be used. Of the silver halides, silver bromide and silver iodobromide are preferred. The halide distribution inside the grain may be uniform, or may vary stepwise or continuously. Also, silver halide grain having a core/shell structure can be preferably used. As to the structure thereof, the core/shell grain of a two- to five-layered stricture is preferably used, and the core-shell grain of two- to four-layered structure is more preferable. Further, techniques for localizing silver bromide or silver iodide on the grain surface of silver chloride, silver bromide or silver chlorobromide can be preferably used.

Methods for the formation of light-sensitive silver halide are well known in the field of art. For instance, the methods described in *Research Disclosure*, No. 17029 (June, 1978) and U.S. Pat. No. 3,700,458 can be used. More specifically, the light-sensitive silver halide is prepared by adding a silver-supplying compound and a halogen-supplying compound to a gelatin or other polymer solution, and then mixed with the organic silver salt. It is also preferred to use the method described in JP-A-11-119374, paragraphs [0217] to [0224] and the methods described in JP-A-11-352627 and JP-A-2000-347335.

For the purpose of restraining white turbidity after the image formation, it is preferred that the grain size of light-sensitive silver halide is small. Specifically, the grain size is preferably not more than 0.20 $\mu$m, more preferably from 0.01 $\mu$m to 0.15 $\mu$m, and still more preferably from 0.02 $\mu$m to 0.12 $\mu$m. The term "grain size" used herein means a diameter of a circular image having an area equivalent to a projected area of silver halide grain (a projected area of the principal plane in the case of tabular grain).

Examples of a shape of the silver halide grain include cubic, octahedral, tabular, spherical, rod-like and potato-like shapes. In the invention, cubic grain is particularly preferred. Also, silver halide grain having rounded corners is preferably used. Although, a plane index (Miller index) of the external surface of photosensitive silver halide grain is not particularly limited, it is preferred that a proportion of {100} plane, which has a high spectral sensitization efficiency when a spectral sensitizing dye is adsorbed, is high. The proportion of {100} plane is preferably not less than 50%, more preferably not less than 65%, and still more preferably not less than 80%. The Miller index, i.e., proportion of {100} plane can be determined by the method described in T. Tani, *J. Imaging Sci.,* 29, 165, (1985), which utilizes adsorption dependence of sensitizing dye on {111} plane and {100} plane.

A silver halide grain is silver halide grain on the outermost surface of which a hexacyano metal complex is present is preferably used in the invention. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the invention, the hexacyano iron complex is preferably used.

Since the hexacyano metal complex is present in the form of an ion in the aqueous solution thereof, a counter cation is of little importance. However, a cation miscible with water and suitable for the precipitation operation of silver halide emulsion, for example, an alkali metal ion (e.g., sodium ion, potassium ion, rubidium ion, cesium ion or lithium ion), an ammonium ion or an alkylammonium ion (e.g., tetramethylammonium ion, tetraethylammonium ion, tetrapropylammonium ion or tetra(n-butyl)ammonium ion) is preferably used.

The hexacyano metal complex can be added by dissolving in water or a mixed solvent of water and an appropriate organic solvent miscible with water (e.g., an alcohol, an ether, a glycol, a ketone, an ester and an amide), or mixing with gelatin.

The amount of the hexacyano metal complex added is preferably from $1\times10^{-5}$ mole to $1\times10^{-2}$ mole, more preferably from $1\times10^{-4}$ mole to $1\times10^{-3}$ mole, per mole of silver.

In order to make a hexacyano metal complex be present on the outermost surface of silver halide grain, the hexacyano metal complex is directly added after the completion of the addition of an aqueous silver nitrate solution used for grain formation and before the completion of the preparation process, specifically, before a chemical sensitization process, in which chalcogen sensitization, for example, sulfur sensitization, selenium sensitization or tellurium sensitization, or noble metal sensitization, for example, gold sensitization is carried out, or during a washing process, a dispersion process or the chemical sensitization process. For inhibiting the growth of fine silver halide grain, it is preferable to add the hexacyano metal complex after the grain formation without delay and before the completion of the preparation process.

The addition of hexacyano metal complex preferably starts after the addition of 96 weight % of the total amount of silver nitrate added for the grain formation, more preferably after the addition of 98 weight % of the total amount of silver nitrate added for the grain formation, and particularly preferably after the addition of 99 weight % of the total amount of silver nitrate added for the grain formation.

When the hexacyano metal complex is added after the addition of an aqueous silver nitrate solution immediately before the completion of grain formation, the complex can adsorb onto the outermost surface of silver halide grain, and mostly form sparingly soluble salt together with silver ion present on the grain surface. Since the silver salt of hexacyano iron (II) is less soluble than AgI, the redissolution due to fine grain can be prevented and the production of silver halide grain having a small grain size is possible.

The light-sensitive silver halide grain of the invention can contain metal belonging to Groups VIII to X of the periodic table (listing elements of Groups I to XVIII) or a complex thereof. The metal or central metal of the metal complex belonging to Groups VIII to X of the periodic table preferably includes rhodium, ruthenium and iridium. The metal complexes may be used alone, or as a combination of two or more complexes having metals of the same kind or different kinds. The suitable content of the metal or metal complex is from $1\times10^{-9}$ to $1\times10^{-3}$ mole per mole of silver. The heavy metal, the complex thereof and the addition methods thereof are described in JP-A-7-225449, JP-A-11-65021, paragraphs [0018] to [0024], and JP-A-11-119374, paragraphs [0227] to [0240].

Further, metal complex (e.g., $[Fe(CN)_6]^{-4}$), which can be incorporated into the silver halide grain for use in the invention, and desalting methods and chemical sensitization methods of silver halide emulsion are described in JP-A-11-84574, paragraphs [0046] to [0050], JP-A-11-65021, paragraphs [0025] to [0031], and JP-A-11-119374, paragraphs [0242] to [0250].

Various gelatins can be used in the light-sensitive silver halide emulsion for use in the invention. In order to maintain the dispersion state of light-sensitive silver halide emulsion in a coating composition containing the organic silver salt in a good condition, it is preferred to use gelatin having a molecular weight of from 10,000 to 1,000,000. Modified gelatin, for example, gelatin substituent of which is subjected to phthalation treatment is also preferably used. The gelatin may be used at the time of grain formation or dispersion after the desalting step. Preferably, it is used at the time of dispersion after the desalting step.

As the sensitizing dye for use in the invention, a sensitizing dye capable of spectrally sensitizing silver halide grain in the desired wavelength region when it is adsorbed to the grain, and having spectral sensitivity suitable for a spectral characteristic of an exposure light source can be advantageously selected. Examples of the sensitizing dye and method for the addition thereof include those described in JP-A-11-65021, paragraphs [0103] to [0109], the compounds represented by formula (II) in JP-A-10-186572, the dyes represented by formula (I) and paragraph [0106] in JP-A-11-119374, the dyes described in U.S. Pat. No. 5,510,236, the dyes described in Example 5 of U.S. Pat. No. 3,871,887, the dyes described in JP-A-2-96131, the dyes described in JP-A-59-48753, the dyes described in EP-A-803764, page 19, line 38, to page 20, line 35, and JP-A-2001-272747, JP-A-2001-290238 and JP-A-2002-23306. The sensitizing dyes may be used alone or in combination of two or more thereof. In the invention, a period of adding the sensitizing dye to the silver halide emulsion is preferably after the desalting step and before coating and more preferably after the desalting step and before the completion of the chemical ripening.

The amount of the sensitizing dye added in the invention is determined considering the desired performances, for example, sensitivity and fog. Specifically, the amount thereof is preferably from $10^{-6}$ to 1 mole, more preferably from $10^{-4}$ to $10^{-1}$ mole, per mole of silver halide in the light-sensitive layer.

For the purpose of enhancing the spectral sensitization efficiency, a super sensitizer can be used. Examples of the super sensitizer for use in the invention include the compounds described in EP-A-587338, U.S. Pat. Nos. 3,877,943 and 4,873,184, JP-A-5-341432, JP-A-11-109547 and JP-A-10-111543.

It is preferred that the light-sensitive silver halide grain for use in the invention is chemically sensitized according to a chalcogen sensitization method, for example, a sulfur sensitization method, a selenium sensitization method or a tellurium sensitization method. The compounds preferably used in the sulfur, selenium and tellurium sensitization methods include known compounds, for example, the compounds described in JP-A-7-128768. In the invention, the tellurium sensitization is particularly preferred. For the tellurium sensitization, the compounds described in the references cited in JP-A-11-65021, paragraph [0030], and the compounds represented by formulae (II), (III) and (IV) in JP-A-5-313284 are preferably used.

It is preferred that the light-sensitive silver halide grain for use in the invention is chemically sensitized according to a gold sensitization method individually or in combination with the chalcogen sensitization method. As gold sensitizers, compounds containing +1 valent or +3 valent gold are preferred and conventionally used gold compounds are preferably employed. Representative preferred examples of the gold sensitizer include potassium chloraurate, potassium bromaurate, auric trichloride, potassium auricthiocyanate, potassium iodaurate, tetracyanoauric acid, ammonium aurothiocyanate and pyridyl trichlorogold. The gold sensitizers described in U.S. Pat. No. 5,858,637 and JP-A-2002-278016 are also preferably used.

In the invention, chemical sensitization can be performed at any time within a period between the completion of grain formation and the start of coating, specifically after the desalting, (1) before the spectral sensitization, (2) simultaneously with the spectral sensitization, (3) after the spectral sensitization, or (4) immediately before coating.

The amount of sulfur, selenium and tellurium sensitizers used in the invention may vary depending on the silver halide grain used and chemical ripening conditions. Specifically, the amount used is in the order of from $10^{-8}$ to $10^{-2}$ mole, preferably from $10^{-7}$ to $10^{-3}$ mole, per mole of silver halide.

The amount of gold sensitizer used in the invention may vary depending on various conditions. As an indication of the addition, the amount is from $10^{-7}$ to $10^{-3}$ mole, preferably from $10^{-6}$ to $5\times10^{-4}$ mole, per mole of silver halide.

The conditions for chemical sensitization are not particularly restricted. Ordinarily, the pH is from 5 to 8, the pAg is from 6 to 11 and the temperature is from 40 to 95° C.

To the silver halide emulsion for use in the invention, a thiosulfonic acid compound may be added according to the method described in EP-A-293917.

The light-sensitive silver halide grain for use in the invention is preferably subjected to reduction sensitization. Preferred examples of compound for use in the reduction sensitization method include ascorbic acid and thiourea dioxide. Further, stannous chloride, aminoimonomethanesulfonic acid, a hydrazine derivative, a boran compound, a silan compound or a polyamine compound is preferably used. The addition of reduction sensitizer can be performed at any step of the production of light-sensitive emulsion including from the growth of crystal to just before coating step. The reduction sensitization is preferably carried out by ripening while maintaining pH of the emulsion at 7 or above or pAg of the emulsion at 8.3 or below. It is also preferred to conduct the reduction sensitization by introducing a singe addition part of silver ion during the grain formation.

The light-sensitive silver halide emulsion for use in the invention preferably contain FED sensitizer (Fragmentable electron donating sensitizer) as a compound generating two electrons per photon. As the FED sensitizer, the compounds described in U.S. Pat. Nos. 5,747,235, 5,747,236, 6,054,260 and 5,994,051 and JP-A-2002-287293 are preferably used. The addition of FED sensitizer can be performed at any step of the production of light-sensitive emulsion including from the growth of crystal to just before coating step. The amount of FED sensitizer added may vary depending on various conditions. As an indication of the addition, the amount is from $10^{-7}$ to $10^{-1}$ mole, preferably from $10^{-6}$ to $5\times10^{-2}$ mole, per mole of silver halide.

In the photosensitive material of the invention, only one kind of light-sensitive silver halide emulsion may be used, or two or more of light-sensitive silver halide emulsions (differing in average grain size, halide composition, crystal habit or condition for chemical sensitization) may be used in combination. The use of plural light-sensitive silver halide emulsions differing in sensitivity enables gradation control. Such techniques are described, e.g., in JP-A-57-119341, JP-A-53-106125, JP-A-47-3929, JP-A-48-55730, JP-A-46-5187, JP-A-50-73627 and JP-A-57-150841. As to the sensitivity difference, it is preferred that the sensitivities of emulsions are different from each other by at least 0.2 in terms of Log E.

The amount of light-sensitive silver halide added is preferably from 0.03 to 0.6 g/m$^2$, more preferably from 0.05 to 0.4 g/m$^2$, and most preferably from 0.07 to 0.3 g/m$^2$, in the amount of silver coated per m$^2$ of photosensitive material. A ratio of the light-sensitive silver halide to the organic silver salt is preferably from 0.01 to 0.5 mole, more preferably from 0.02 to 0.3 more, and still more preferably from 0.03 to 0.2 mole, per mole of the organic silver salt.

With respect to the method and condition for mixing light-sensitive silver halide and organic silver salt prepared separately, there are known the method of mixing the silver halide grain and the organic silver salt after the preparation by means of a high-speed stirrer, a ball mill, a sand mill, a colloid mill, a vibration mill or a homogenizer, and the method of preparing an organic silver salt wherein light-sensitive silver halide after the preparation is mixed at any timing during the preparation of organic silver salt. However, no particular restriction is imposed thereon so far as the present effects can be sufficiently produced. For controlling photographic characteristics, it is preferred to mix aqueous dispersions of two or more organic silver salts with aqueous dispersions of two or more light-sensitive silver salts.

The suitable timing at which the silver halide of the invention is added to a coating solution for an image-forming layer is from 180 minutes before to just before the start of coating, preferably from 60 minutes to 10 seconds before the start of coating. There are no restrictions on the method and condition for mixing the present silver halide with the coating solution so far as the effects of the invention can be sufficiently achieved. Specific examples of the mixing method include a mixing method using a tank controlled so that the average stay time calculated from the rate of liquid flow added to the tank and the volume of the liquid sent into a coater becomes the desired value, and a method of using a static mixer as described in N. Harnby, M. F. Edwards & A. W. Nienow, *Ekitai Kongou Gijutsu* (translated by Koji Takahashi), chapter 8, Nikkan Kogyo Shinbun-sha (1989).

(Description of Binder)

As the binder for the organic silver salt-containing layer of the invention, any polymer may be used. Examples of the binder used preferably include transparent or translucent, ordinarily colorless, natural resins, polymers and copolymers, synthetic resins, polymers and copolymers, and other film-forming media, for example, gelatin, rubber, polyvinyl alcohol, hydroxyethyl cellulose, cellulose acetate, cellulose acetate butyrate, polyvinyl pyrrolidone, casein, starch, polyacrylic acid, polymethyl methacrylate, polyvinyl chloride, polymethacrylic acid, styrene-maleic anhydride copolymer, styrene-acrylonitrile copolymer, styrene-butadiene copolymer, polyvinyl acetal (such as polyvinyl formal or polyvinyl butyral), polyester, polyurethane, phenoxy resin, polyvinylidene chloride, polyepoxide, polycarbonate, polyvinyl acetate, polyolefin, cellulose ester and polyamide. The binder may form a coating film through the use of water, an organic solvent or an emulsion.

The glass transition temperature (Tg) of binder for use in the organic silver salt-containing layer is preferably from 10° C. to 80° C. (hereinafter, the binder having its glass transition temperature in such a temperature range is also referred to as a high Tg binder sometimes), more preferably from 15° C. to 70° C., and still more preferably from 20° C. to 65° C.

In the specification, the Tg is calculated according to the following equation:

$$1/Tg=\Sigma(Xi/Tgi)$$

wherein, assuming that the polymer is a copolymer composed of n monomers from i=1 to i=n, Xi is a weight fraction of the ith monomer ($\Sigma Xi=1$) and Tgi is glass transition temperature (measured in absolute temperature) of a homopolymer formed from the ith monomer. The symbol $\Sigma$ means the sum of i=1 to i=n. The value of the glass transition temperature of a homopolymer formed from each monomer (Tgi) is adopted from J. Brandrup and E. H. Immergut, *Polymer Handbook,* 3rd. Edition, Wiley-Interscience (1989).

Two or more binders may be used in combination, if desired. Further, a binder having a glass transition temperature of not lower than 20° C. and a binder having a glass transition temperature lower than 20° C. may be used in combination. When two or more polymers differing in Tg are used in combination, it is preferred that a weight average Tg is within the above-described range.

In the invention, it is preferable that the organic silver salt-containing layer is formed by applying a coating composition wherein water constitutes at least 30 weight % of the solvent thereof and drying to form a film.

In the invention, improved performances can be achieved when the organic silver salt-containing layer is formed by applying and drying a coating solution containing water in a proportion of at least 30 weight % based on the total amount of solvent used, further when the binder used in the organic silver salt-containing layer can be dissolved or dispersed in a water-based solvent (aqueous solvent), and particularly when a binder comprising a latex of polymer having an equilibrium moisture content of 2 weight % or below under conditions of 25° C. and 60% RH. According to the most preferable form, the organic silver salt-containing layer is prepared so as to have an ionic conductivity of 2.5 mS/cm or below. The preparation method thereof includes purifying a polymer using an isolation membrane after the synthesis thereof.

The water-based solvent, in which a binder can be dissolved or dispersed, includes water and a mixture of water and not more than 70 weight % of a water-miscible organic solvent. Examples of the water-miscible organic solvent include an alcohol solvent, for example, methyl alcohol, ethyl alcohol or propyl alcohol, a cellosolve solvent, for example, methyl cellosolve, ethyl cellosolve or butyl cellosolve, ethyl acetate and dimethylformamide.

The water-based solvent is also used for a solvent in which the polymer is not dissolved thermodynamically but present in a so-called dispersed state.

The equilibrium moisture content (in weight %) under conditions of 25° C. and 60% RH can be described by the following equation using the weight of a polymer in a moisturized equilibrium under the 25° C. and 60% RH atmosphere, W1, and the weight of the polymer in an absolutely dried state at 25° C., W0:

$$\text{Equilibrium moisture content under 25° C. and 60\% RH}=\{(W1-W0)/W0\}\times 100$$

Regarding the definition of the moisture content and the method for measuring thereof, e.g., Koubunshi Kougaku Kouza, 14th volume, *Kobunshi Zairyo Shikenho*, compiled by Koubunshi Gakkai, Chijinshokan can be referred to.

The equilibrium moisture content of the binder polymer under conditions of 25° C. and 60% RH is preferably 2 weight % or below, more preferably from 0.01 to 1.5 weight %, and still more preferably from 0.02 to 1 weight %.

In the invention, a polymer dispersible in the water-based solvent is particularly preferable. Examples of the polymer in a dispersed state include latex in which fine particles of a water-insoluble, hydrophobic polymer are dispersed, and a dispersion in which a polymer molecule is dispersed in a molecular state or in the form of micelle. Particles dispersed in a latex form are preferable. The average diameter of dispersed particles is from 1 to 50,000 nm, preferably from 5 to 1,000 nm, more preferably from 10 to 500 nm, and still more preferably from 50 to 200 nm. The diameter distribution of dispersed particles is not particularly restricted, and both broad particle diameter distribution and monodisperse particle diameter distribution may be used. A mixture of two or more polymers each having monodisperse particle diameter distribution is also advantageous from the viewpoint of controlling physical properties of the coating solution.

Preferred examples of the polymer dispersible in a water-based solvent for use in the invention include hydrophobic polymer, for example, acrylic polymer, polyester, rubber (e.g., SBR resin), polyurethane, polyvinyl chloride, polyvinyl acetate, polyvinylidene chloride and polyolefin. The polymer may be a linear, branched or cross-linked polymer, and it may be a polymer obtained by polymerization of single-sort monomer, namely a so-called homopolymer, or a copolymer obtained by polymerization of two or more sorts of monomers. In the case of copolymer, both random and block copolymers are usable. The number average molecular weight of the polymer is preferably from 5,000 to 1,000,000, more preferably from 10,000 to 200,000. When the molecular weight is too low, the mechanical strength of the emulsion layer becomes insufficient, while too high molecular weight is undesirable because of poor film formability. In particular, cross-linking polymer latex is preferably used.

(Specific Examples of Latex)

Preferred examples of the polymer latex are recited below. In the following examples, each latex is represented by monomer as starting material, each figure in parentheses is expressed in weight %, and each molecular weight is number average molecular weight. When polyfunctional monomer is used, the concept of molecular weight cannot be applied because a cross-linked structure is formed. Therefore, such a latex is described as cross-linking and its molecular weight description is omitted. Tg stands for a glass transition temperature.

P-1; -MMA(70)-EA(27)-MAA(3)-latex (molecular weight: 37,000, Tg: 61° C.)

P-2; -MMA(70)-2EHA(20)-St(5)-AA(5)-latex (molecular weight: 40,000, Tg: 59° C.)

P-3; -St(50)-Bu(47)-MAA(3)-latex (cross-linking, Tg:−17° C.)

P-4; -St(68)-Bu(29)-AA(3)-latex (cross-linking, Tg: 17° C.)

P-5; -St(71)-Bu(26)-AA(3)-latex (cross-linking, Tg: 24° C.)

P-6; -St(70)-Bu(27)-IA(3)-latex (cross-linking)

P-7; -St(75)-Bu(24)-AA(1)-latex (cross-linking, Tg: 29° C.)

P-8; -St(60)-Bu(35)-DVB(3)-MAA(2) latex (cross-linking)

P-9; -St(70)-Bu(25)-DVB(2)-AA(3)-latex (cross-linking)

P-10; -VC(50)-MMA(20)-EA(20)-AN(5)-AA(5)-latex (molecular weight: 80,000)

P-11; -VDC(85)-MMA(5)-EA(5)-MAA(5)-latex (molecular weight: 67,000)

P-12; -Et(90)-MAA(10)-latex (molecular weight: 12,000)

P-13; -St(70)-2EHA(27)-AA(3)-latex (molecular weight: 130,000, Tg: 43° C.)

P-14; -MMA(63)-EA(35)-AA(2)-latex (molecular weight: 33,000, Tg: 47° C.)

P-15; -St(70.5)-Bu(26.5)-AA(3)-latex (cross-linking, Tg: 23° C.)

P-16; -St(69.5)-Bu(27.5)-AA(3)-latex (cross-linking, Tg: 20.5° C.)

The abbreviations in the above formulae stand for the following monomers respectively: MMA; methyl methacrylate, EA; ethyl acrylate, MAA; methacrylic acid, 2EHA; 2-ethylhexyl acrylate, St; styrene, Bu; butadiene, AA; acrylic acid, DVB; divinylbenzene, VC; vinyl chloride, AN; acrylonitrile, VDC; vinylidene chloride, Et; ethylene, IA; itaconic acid.

The polymer latices recited above are also commercially available, and the following products can be used. Examples of acrylic polymer products include Sebian A-4635, 4718 and 4601 (produced by DAICEL CHEMICAL INDUSTRIES, LTD), and Nipol Lx811, 814, 821, 820 and 857 (produced by ZEON CORPORATION). Examples of polyester products include FINETEX ES650, 611, 675 and 850 (produced by Dainippon Ink & Chemicals, Inc.), and WD-size and WMS (produced by EASTMAN CHEMICAL). Examples of polyurethane products include HYDRAN AP10, 20, 30 and 40 (produced by Dainippon Ink & Chemicals, Inc.). Examples of rubber products include LACSTAR 7310K, 3307B, 4700H AND 7132C (produced by Dainippon Ink & Chemicals, Inc.), and Nipol Lx46, 410, 438C and 2507 (produced by ZEON CORPORATION) Examples of polyvinyl chloride products include G351 and G576 (produced by ZEON CORPORATION). Examples of polyvinylidene chloride products include L502 and L513 (produced by Asahi Kasei Corporation). Examples of polyolefin products include Chemipearl S120 and SA100 (produced by Mitsui Chemicals, Inc.).

The polymer latices may be used alone, or two or more thereof may be blended, if desired.

(Preferred Latex)

As the polymer latex for use in the invention, styrene-butadiene copolymer latex is preferred in particular. The ratio between styrene unit and butadiene unit in the copolymer is preferably from 40:60 to 95:5 by weight. Also, it is preferred that the total amount of styrene unit and butadiene unit is from 60 to 99 weight % of the copolymer. Further, the polymer latex preferably contains acrylic acid unit or methacrylic acid unit in an amount of from 1 to 6 weight %, and more preferably from 2 to 5 weight %, based on the sum total of styrene and butadiene units. The incorporation of acrylic acid unit in the polymer latex is preferred.

Examples of styrene-butadiene-acid copolymer latex preferably used in the invention include the foregoing P-3 to P-8 and P-15, and LACSTAR-3307B, LACSTAR-7132C and Nipol Lx416 as the commercial products.

To the organic silver salt-containing layer of the photosensitive material may be added a hydrophilic polymer, such as gelatin, polyvinyl alcohol, methyl cellulose, hydroxypropyl cellulose or carboxymethyl cellulose. The amount of hydrophilic polymer added is preferably not greater than 30 weight %, more preferably not greater than 20 weight %, of the total binder in the organic silver salt-containing layer.

It is preferable that the organic silver salt-containing layer (or the image-forming layer) is a layer formed using polymer latex. The ratio of the total binder to the organic silver salt in the organic silver salt-containing layer is preferably from 1/10 to 10/1, more preferably from 1/3 to 5/1, and still more preferably from 1/1 to 1/3, by weight.

Ordinarily, the organic silver salt-containing layer is also a light-sensitive layer (an emulsion layer) containing light-sensitive silver halide as light-sensitive silver salt. In such a case, the ratio of the total binder to the silver halide is preferably from 400/1 to 5/1, and more preferably from 200/1 to 10/1, by weight.

The amount of total binder contained in the image-forming layer is preferably from 0.2 to 30 g/m$^2$, more preferably from 1 to 15 g/m$^2$, and still more preferably from 2 to 10 g/m$^2$. To the image-forming layer may be added a cross-linking agent for crosslinking and a surfactant for improving coating property.

(Description of Preferable Solvent for Coating Composition)

The solvent (herein, a solvent and a dispersing medium are both referred to as a solvent for simplicity's sake) suitably used in a coating solution for the organic silver salt-containing layer of the present photosensitive material is a water-based solvent containing at least 30 weight % water. As a solvent component other than water, a water-miscible organic solvent, such as methyl alcohol, ethyl alcohol, isopropyl alcohol, methyl cellosolve, ethyl cellosolve, dimethylformamide and ethyl acetate, may be appropriately used. The water content in the solvent for the coating solution is preferably at least 50 weight %, and more preferably at least 70 weight %. Preferred examples of the solvent composition include water=100, water/methyl alcohol=90/10, water/methyl alcohol=70/30. water/methyl alcohol/dimethylformamide=80/15/5, water/methyl alcohol/ethyl cellosolve=85/10/5, and water/methyl alcohol/isopropyl alcohol=85/10/5 (wherein all the figures are by weight %)

(Description of Antifoggant)

The compounds described in JP-A-10-62899, paragraph [0070], the compounds described in EP-A-803764, page 20, line 57, to page 21, line 7, the compounds described in JP-A-9-281637 and JP-A-9-329864, the compounds described in U.S. Pat. No. 6,083,681, and European Patent 1048975 can be used as the antifoggant, stabilizer and precursor of stabilizer in the invention. In addition, the antifoggant preferably used in the invention is an organic halogen compound. Examples of the organic halogen compound include the compounds described in JP-A-11-65021, paragraphs [0111] and [0112]. In particular, the organic halogen compounds represented by formula (P) in JP-A-2000-284399, the organic polyhalogen compounds represented by formula (II) in JP-A-10-339934, and the organic polyhalogen compounds described in JP-A-2001-31644 and JP-A-2001-33911 are preferred.

(Description of Polyhalogen Compound)

The polyhalogen compound preferably used in the invention includes a compound represented by the following formula (H):

$$Q—(Y)_n—C(Z_1)(Z_2)X \quad (H)$$

In formula (H), Q represents an alkyl group, an aryl group or a heterocyclic group, Y represents a divalent connecting group, n represents 0 or 1, $Z_1$ and $Z_2$ each represent a halogen atom, and X represents a hydrogen atom or an electron withdrawing group.

In formula (H), Q preferably represents an aryl group or a heterocyclic group. When Q represents a heterocyclic group in formula (H), a nitrogen-containing heterocyclic group having one or two nitrogen atoms is preferred, and a 2-pyridyl group or a 2-quinolyl group is particularly preferred.

X is preferably an electron withdrawing group, more preferably a halogen atom, an aliphatic sulfonyl group, an arylsulfonyl group, a heterocyclic sulfonyl group, an aliphatic acyl group, an arylacyl group, a heterocyclic acyl group, an aliphatic oxycarbonyl group, an aryloxycarbonyl group, a heterocyclic oxycarbonyl group, a carbamoyl group or a sulfamoyl group, particularly preferably a halogen atom. Of the halogen atoms, a chlorine atom, a bromine atom or an iodine atom is preferred, a chlorine atom or a bromine atom is more preferred, and a bromine atom is particularly preferred.

Y is preferably —C(=O)—, —SO— or —$SO_2$—, more preferably —C(=O)— or —$SO_2$—, particularly preferably —$SO_2$—.

n is 0 or 1, and preferably 1.

When Q represents an aryl group in formula (H), Q is preferably a phenyl group substituted with an electron withdrawing group having a positive value of Hammett's substituent constant σp. With respect to the Hammett's substituent constant, *Journal of Medicinal Chemistry*, Vol. 16, No. 11, pages 1207–1216 (1973) can be referred to.

Examples of the electron withdrawing group include a halogen atom (e.g., fluorine atom (σp value: 0.06), chlorine atom (σp value: 0.23), bromine atom (σp value: 0.23), iodine atom (σp value: 0.18)), a trihalomethyl group (e.g., tribromomethyl (σp value: 0.29), trichloromethyl (σp value: 0.33), trifluoromethyl (σp value: 0.54)), a cyano group (σp value: 0.66), a nitro group (σp value: 0.78), an aliphatic sulfonyl group (e.g., methanesulfonyl (σp value: 0.72)), an arylsulfonyl group, a heterocyclic sulfonyl group, an aliphatic acyl group (e.g., acetyl (σp value: 0.50)), an arylacyl group (e.g., benzoyl (σp value: 0.43)), a heterocyclic acyl group, an alkynyl group (e.g., —C≡CH (σp value: 0.23)), an aliphatic oxycarbonyl group (e.g., methoxycarbonyl (σp value: 0.45)), an aryloxycarbonyl group (e.g., phenoxycarbonyl (σp value: 0.44)), a heterocyclic oxycarbonyl group, a carbamoyl group (σp value: 0.36), a sulfamoyl group (σp value: 0.57), a sulfoxide group, a heterocyclic group, and a phosphoryl group. The σp value is preferably in the range of from 0.2 to 2.0, and more preferably from 0.4 to 1.0. Particularly preferred examples of the electron withdrawing group include a carbamoyl group, an alkoxycarbonyl group, an alkylsulfonyl group and an alkylphosphoryl group.

Of the polyhalogen compounds, a carbamoylphenyl group-substituted polyhalogen compound represented by the following formula (Hi) is preferred.

(H1)

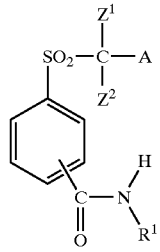

wherein, $Z^1$ and $Z^2$ each independently represent a halogen atom; A represents a hydrogen atom or a halogen atom; and $R^1$ represents an alkyl group having from 2 to 12 carbon atoms, which may have one or more substituents, an alkenyl group having from 2 to 12 carbon atoms, which may have one or more substituents or an alkynyl group having from 2 to 12 carbon atoms, which may have one or more substituents.

Also, a hetero ring-substituted polyhalogen compound represented by the following formula (H2) is preferred.

(H2)

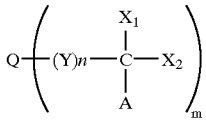

wherein, $X_1$ and $X_2$ each independently represent a halogen atom; Y represents a divalent connecting group; A represents a hydrogen atom, a halogen atom or an electron withdrawing group other than the halogen atom; m represents an integer of from 1 to 4; Q represents a heterocyclic group; and n represents an integer of from 0 to 3.

Now, the compound represented by formulae (H2) is described in detail below.

The halogen atoms represented by $X_1$ and $X_2$, which may be the same or different, each represent a fluorine atom, a chlorine atom, a bromine atom or a iodine atom, preferably a chlorine atom, a bromine atom or an iodine atom, more preferably a chlorine atom or a bromine atom, and particularly preferably a bromine atom.

Y represents a divalent connecting group. Specific examples of the divalent group include $—SO_2—$, —SO—, —CO—, $—N(R^{11})—SO_2—$, $—N(R^{11})—CO—$, $—N(R^{11})—COO—$, —COCO—, —COO—, —OCO—, —OCOO—, —SCO—, —SCOO—, $—C(Z^1)(Z_2)—$, alkylene, arylene, divalent heterocyclic ring and a divalent group formed by a combination of these groups. $R^{11}$ represents a hydrogen atom or an alkyl group, preferably a hydrogen atom. $Z^1$ and $Z^2$ each represent a hydrogen atom or an electron withdrawing group, provided that both $Z^1$ and $Z^2$ are not hydrogen atoms at the same time. The electron withdrawing group is preferably a substituent having a Hammett's substituent constant σp value of not less than 0.01, more preferably a substituent having a Hammett's substituent constant σp value of not less than 0.1. With respect to the Hammett's substituent constant, the description has been made hereinbefore.

Examples of the electron withdrawing group for $Z^1$ and $Z^2$ include those described for the substituent on the phenyl group represented by Q in formula (H).

$Z^1$ and $Z^2$ each preferably represent a halogen atom, a cyano group or a nitro group. Of the halogen atom, a chlorine atom, a bromine atom or an iodine atom is preferred, a chlorine atom or a bromine atom is more preferred, and a bromine atom is particularly preferred. Y is preferably $—SO_2—$, —SO—, —CO—, and more preferably $—SO_2—$. n is preferably 1.

The electron withdrawing group represented by A is preferably a substituent having a Hammett's substituent constant σp value of not less than 0.01, more preferably a substituent having a Hammett's substituent constant up value of not less than 0.1.

A is preferably an electron withdrawing group, more preferably a halogen atom, an aliphatic sulfonyl group, an arylsulfonyl group, a heterocyclic sulfonyl group, an aliphatic acyl group, an arylacyl group, a heterocyclic acyl group, an aliphatic oxycarbonyl group, an aryloxycarbonyl group, a heterocyclic oxycarbonyl group, particularly preferably a halogen atom. Of the halogen atoms, a chlorine atom, a bromine atom or an iodine atom is preferred, a chlorine atom or a bromine atom is more preferred, and a bromine atom is particularly preferred.

The heterocyclic group represented by Q includes a 3-membered to 10-membered saturated or unsaturated heterocyclic group containing at least one of nitrogen, oxygen and sulfur atoms. The heterocyclic ring may be a monocyclic ring or may form a condensed ring together with other rings. The heterocyclic ring is preferably a 5-membered or 6-membered aromatic heterocyclic group, more preferably a 5-membered or 6-membered aromatic heterocyclic group containing a nitrogen atom, and still more preferably a 5-membered or 6-membered aromatic heterocyclic group containing one or two nitrogen atom.

Specific examples of the heterocyclic ring include pyrrolidine, piperidine, piperazine, morpholine, thiophene, furan, pyrrole, imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzothiazole and indolenine. As the heterocyclic ring, thiophene, furan, pyrrole, imidazole, pyrazole, pyridine, pyrazine, pyridazine, triazole, triazine, indole, indazole, thiadiazole, oxadiazole, quinoline, phthalazine, naphthyridine, quinoxaline, quinazoline, cinnoline, pteridine, tetrazole, thiazole, oxazole, benzimidazole, benzoxazole, benzothiazole or indolenine is preferred, triazine, quinoline, thiadiazole, benzothiazole or oxadiazole is more preferred, and pyridine, quinoline, thiadiazole or oxadiazole is particularly preferred.

m represents an integer of from 1 to 4.

Specific examples of the compounds represented by formulae (H), (H1) and (H2) are set forth below, but the invention should not be construed as being limited thereto.

(H-1)

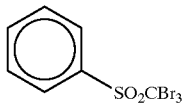

(H-2)

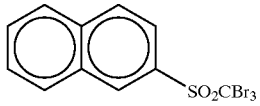

(H-3)

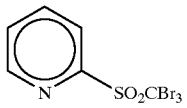

(H-4)

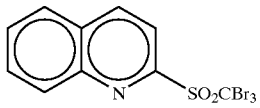

(H-5)

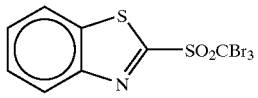

(H-6)

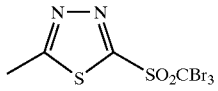

(H-7)

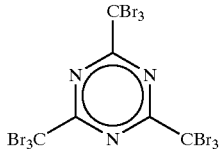

-continued
(H-8)
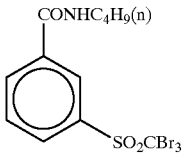
(H-9)
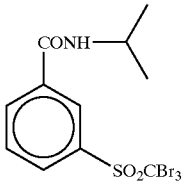
(H-10)
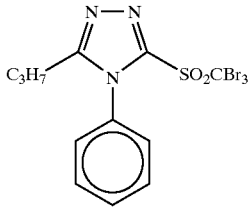
(H-11)
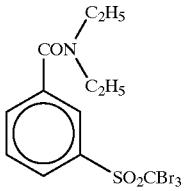
(H-12)
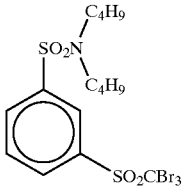
(H-13)
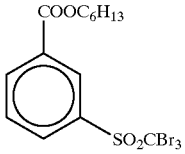
(H-14)
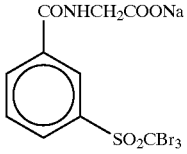
(H-15)
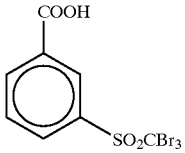
-continued
(H-16)
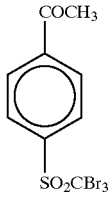
(H-17)
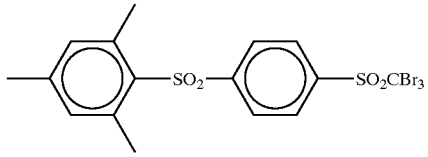
(H-18)
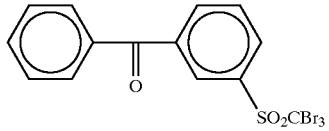
(H-19)
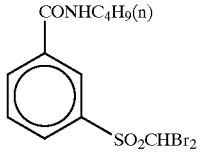
(H-20)
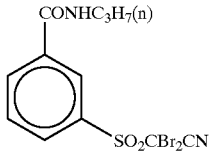
(H-21)
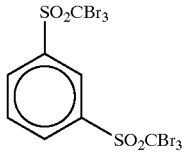
(H-22)
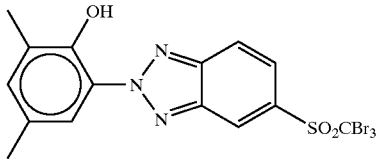
(H-23)
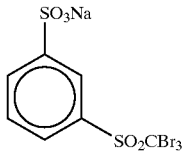
(H-24)
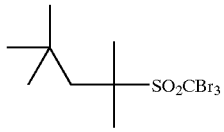
The antifoggant, preferably the polyhalogen compound according to the invention is used preferably in an amount of from $10^{-4}$ to 1 mole, more preferably from $10^{-3}$ to 0.5 mole, still more preferably from $1\times10^{-2}$ to 0.2 mole, per mole of the light-insensitive silver salt in the image-forming layer.

As a method of incorporating the antifoggant into the photosensitive material, the methods as described above for the reducing agent can be adopted. Specifically, the method of adding in the form of a fine particulate solid dispersion is also preferable for the organic polyhalogen compound.

(Other Antifoggants)

Examples of other antifoggants include the mercury(II) salts described in JP-A-11-65021, paragraph [0113], the benzoic acids described in JP-A-11-65021, paragraph [0114], the salicylic acid derivatives described in JP-A-2000-206642, the formaldehyde scavenger compounds represented by formula (S) in JP-A-2000-221634, the triazine compounds relating to claim 9 of JP-A-11-352624, the compounds represented by formula (III) in JP-A-6-11791 and 4-hydroxy-6-methyl-1,3,3a,7-tetraazaindene.

The heat-developable photosensitive material of the invention may contain an azolium salt for the purpose of fog prevention. Examples of the azolium salt include the compounds of formula (XI) described in JP-A-59-193447, the compounds described in JP-B-55-12581, and the compounds of formula (II) described in JP-A-60-153039. The azolium salt, though may be added to any region of the photosensitive material, is preferably added to a layer present on the light-sensitive layer side. More preferably, it is added to the organic silver salt-containing layer. The addition of azolinium salt may be carried out at any step in the preparation of a coating solution. In the case of adding it to the organic silver salt-containing layer, the addition timing may be any step in the process from organic silver salt preparation to coating solution preparation, but preferably during the period from the conclusion of organic silver salt preparation to just before the coating. The azolium salt may be added by any method, such as a method of adding in the form of powder, a solution or a fine-particle dispersion. It may also be added as a solution of a mixture with other additives, such as a sensitizing dye, a reducing agent or a toning agent. The amount of azolium salt added in the invention, though may be any value, is preferably from $1\times10^{-6}$ mole to 2 moles, more preferably from $1\times10^{-3}$ mole to 0.5 moles, per mole of silver.

In the photosensitive material of the invention, a mercapto compound, disulfide compound or thione compound can be contained for the purposes of controlling the development through retardation or acceleration, enhancing the efficiency of spectral sensitization and improving the preservability before and after the development. The compounds include the compounds described in JP-A-10-62899, paragraphs [0067] to [0069], the compounds represented by formula (I) in JP-A-10-186572 and their examples recited in paragraphs [0033] to [0052], and the compounds described in EP-A-0803764, page 20, lines 36–56. Of the compounds, the mercapto-substituted aromatic heterocyclic compounds as described in JP-A-9-297367, JP-A-9-304875, JP-A-2001-100358, JP-A-2002-303954 and JP-A-2002-303951 are preferable.

(Description of Toning Agent)

Addition of toning agent is preferable for the heat-developable photosensitive material of the invention. Descriptions of the toning agent can be found in JP-A-10-62899, paragraphs [0054] and [0055], EP-A-803764, page 21, lines 23–48, JP-A-2000-356317 and JP-A-2000-187298. Particularly, a phthalazinone (phthalazinone, a derivative or metal salt thereof, e.g., 4-(1-naphthyl)phthalazinone, 6-chlorophthalazinone, 5,7-dimethoxyphthalazinone or 2,3-dihydroxy-1,4-phthalazinedione), a combination of a phthalazinone and a phthalic acid (e.g., phthalic acid, 4-methylphthalic acid, 4-nitrophthalic acid, diammonium phthalate, sodium phthalate, potassium phthalate or tetrachlorophthalic anhydride), a phthalazine (phthalazine, a derivative or metal salt thereof, e.g., 4-(1-naphthyl) phthalazine, 6-isopropylphthalazine, 6-tert-butylphthalazine, 6-chlorophthalazine, 5,7-dimethoxyphthalazine or 2,3-dihydrophthalazinedie) and a combination of a phthalazine and a phthalic acid are preferably used, and the combination of a phthalazine and a phthalic acid is more preferably used. In particular, the combination of 6-isopropylphthalazine and phthalic acid or 4-methylphthalic acid is preferred.

(Description of Other Additives)

The plasticizer and the lubricant described in JP-A-11-65021, paragraph [0117], can be used in the light-sensitive layer of the invention. The super high contrast imparting agent for formation of super high contrast images and the addition method and amount thereof, which can be applied to the light-sensitive layer of the invention, are described in JP-A-11-65021, paragraph [0118], JP-A-11-223898, paragraphs [0136] to [0193], and further include the compounds represented by formula (H), formulae (1) to (3), formulae (A) and (B) respectively in JP-A-2000-284399 and the compounds represented by formulae (III) to (V) respectively (specifically, Compounds of [Ka-21] to [Ka-24]) in JP-A-2000-347345. The high contrast accelerating agent which can be used in the light-sensitive layer of the invention includes those described in JP-A-11-65021, paragraph [0102], and JP-A-11-223898, paragraphs [0194] and [0195].

In order that formic acid or a salt thereof serves as a strong fogging substance, it is preferably used in an amount of 5 millimoles or below, more preferably 1 millimole or below, per mole of silver on the side where the image-forming layer containing light-sensitive silver halides is present.

When the super high contrast imparting agent is used in the heat-developable photosensitive material of the invention, it is preferable to use an acid formed by hydration of diphosphorus pentoxide or a salt thereof in combination therewith. Examples of the acid formed by hydration of diphosphorus pentoxide and salt thereof include metaphosphoric acid (metaphosphate), pyrophosphoric acid (pyrophosphate), orthophosphoric acid (orthophosophate), triphosphoric acid (triphosphate), tetraphosphoric acid (tetraphosphate), and hexametaphosphoric acid (hexametaphosphate). Of the acid formed by hydration of diphosphorus pentoxide and salt thereof, orthophosphoric acid (orthophosphate) and hexametaphosphoric acid (hexametaphosphate) are particularly preferably used. Specific examples of the salt include sodium orthophosphate, sodium dihydrogen orthophosphate, sodium hexametaphosphate and ammonium hexametaphosphate.

The amount of the acid formed by hydration of diphosphorus pentoxide and salt thereof (coverage per $m^2$ of the photosensitive material) may be appropriately determined considering characteristics such as sensitivity and fog. Specifically, the amount is preferably from 0.1 to 500 $mg/m^2$, and more preferably from 0.5 to 100 $mg/m^2$.

(Description of Layer Structure)

The heat-developable photosensitive material of the invention can have a surface protective layer for the purpose of preventing adhesion of the image-forming layer. The surface protective layer may be a single layer or a multiple layer. Detailed descriptions of the protective layer can be found in JP-A-11-65021, paragraphs [0119] and [0120], and JP-A-2000-171936.

As a binder of the present surface protective layer, gelatin is preferable. It is also preferred to use polyvinyl alcohol (PVA) alone or in combination with gelatin. As to the gelatin used, inert gelatin (e.g. Nitta Gelatin 750) and phthalated gelatin (e.g., Nitta Gelatin 801) are usable. Examples of PVA usable include those described in JP-A-2000-171936, paragraphs [0009] to [0020], preferably PVA-105 as a completely saponified product, PVA-205 and PVA-335 as partially saponified products, and MP-203 as a modified polyvinyl alcohol product (which all are trade names and available from Kuraray Co., Ltd.). The polyvinyl alcohol coverage (per $m^2$ of a support) for each of the protective layer is preferably from 0.3 to 4.0 $g/m^2$, more preferably from 0.3 to 2.0 $g/m^2$.

In the case where the heat-developable light-sensitive layer of the invention is used for printing purpose wherein dimensional stability becomes significant in particular, it is preferable to use polymer latex in the surface protective layer or a backing layer. Descriptions of the polymer latex can be found, e.g., in *Gousei Jushi Emulsion*, compiled by Taira Okuda & Hiroshi Inagaki, Koubunshi Kankoukai (1978), *Gousei Latex no Ouyou*, compiled by Takaaki Sugimura, Yasuo Kataoka, Souichi Suzuki & Keishi Kasahara, Koubunshi Kankoukai (1993), and *Gousei Latex no Kagaku*, compiled by Souichi Muroi, Koubunshi Kankoukai (1970). Examples of usable polymer latex include latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/styrene (8.6 weight %)/2-hydroxyethyl methacrylate (5.1 weight %)/acrylic acid (2.0 weight %) copolymer, and latex of methyl methacrylate (64.0 weight %)/styrene (9.0 weight %)/butyl acrylate (20.0 weight %)/2-hydroxyethyl methacrylate (5.0 weight %)/acrylic acid (2.0 weight %) copolymer. Further, to the binder of the surface protective layer may be applied the arts described in JP-A-2000-267226, paragraphs [0021] to [0025], and the arts described in JP-A-2000-19678, paragraphs [0023] to [0041].

In the surface protective layer, the content of polymer latex is preferably from 10 to 90 weight %, particularly preferably from 20 to 80 weight %, based on the total binder.

The coverage (per $m^2$ of a support) of the total binder (including water-soluble binder and latex polymer) for each of the surface protective layer is preferably from 0.3 to 5.0 $g/m^2$, and more preferably from 0.3 to 2.0 $g/m^2$.

The preparation temperature of the coating solution for the present image-forming layer is preferably from 30° C. to 65° C., more preferably from 35° C. to 60° C., and still more preferably 35° C. to 55° C. It is also preferred that the temperature of the coating solution for the image-forming layer just after the addition of polymer latex is kept at a temperature of from 30° C. to 65° C.

The image-forming layer of the invention is provided on a support, and constituted of one or more layers. When it has one constituent layer, the image-forming layer of the invention contains an organic silver salt, light-sensitive silver halide, a reducing agent and a binder, and additional ingredients including a toning agent, a coating aid and other auxiliary agents, if desired. When the image-forming layer has two or more constituent layers, the first image-forming layer (ordinarily the layer adjacent to a support) contains an organic silver salt and light-sensitive silver halide, and the second image-forming layer or both first and second image-forming layers contain other ingredients.

In the case of a multicolor, light-sensitive heat-developable photographic material, the photographic material may have a combination of the two layers for each color or, as described in U.S. Pat. No. 4,708,928, may contain all the ingredients in a single layer. In the case of a multi-dye, multicolor, light-sensitive, heat-developable photographic material, as described in U.S. Pat. No. 4,469,681, each adjacent pair of emulsion layers are kept distinctively by providing a functional or non-functional barrier layer between the light-sensitive layers.

In the light-sensitive layer of the invention, various kinds of dyes and pigments (such as C.I. Pigment Blue 60, C.I. Pigment Blue 64, C.I. Pigment Blue 15:6) can be used from the viewpoints of improvement of tone, prevention of interference pattern formation upon exposure to laser light and prevention of irradiation. Detailed descriptions thereof can be found in WO 98/36322, JP-A-10-268465 and JP-A-11-338098.

In the heat-developable photosensitive material of the invention, an anti-halation layer may be positioned at a location distant from a light source relative to the light-sensitive layer.

The heat-developable photosensitive material ordinarily has a light-insensitive layer in addition to the light-sensitive layer. According to its position, the light-insensitive layer is classified under four groups, namely (1) a protective layer provided on a light-sensitive layer (distant from a support), (2) an interlayer provided between adjacent light-sensitive layers or between a light-sensitive layer and a protective layer, (3) an undercoat layer provided between a support and a light-sensitive layer and (4) a backing layer provided on the side opposite to the light-sensitive layer. A filter layer is provided in the photosensitive material as a layer classified as the group (1) or (2), and an anti-halation layer is provided in the photosensitive material as a layer classified as the group (3) or (4).

Descriptions of the anti-halation layer can be found in JP-A-11-65021, paragraphs [0123] and [0124], JP-A-11-223898, JP-A-9-230531, JP-A-10-36695, JP-A-10-104779, JP-A-11-231457, JP-A-11-352625 and JP-A-11-352626.

The anti-halation layer contains anti-halation dye showing absorption at wavelength of light for exposure. When the exposure light has its wavelength peak in the infrared region, an infrared absorbing dye is used as the anti-halation dye. In this case, it is preferable that the dye used has no absorption in the visible region.

When the prevention of halation is performed with dye showing absorption in the visible region, as it is preferred that the dye used leave substantially no color after the image formation, an expedient of decoloring the dye by the heat of heat development may be adopted. In particular, it is preferable to add a thermally decoloring dye and a base precursor to a light-insensitive layer and make the light-insensitive layer function as anti-halation layer. These arts are described in JP-A-11-231457.

The amount of decoloring dye added is determined depending on usage of the dye. Ordinarily, the decoloring dye is used preferably in an amount for providing an optical density (absorbance) higher than 0.1, measured at the intended wavelength. The optical density is preferably from 0.15 to 2, and more preferably from 0.2 to 1. In order to attain such an optical density, the amount of dye used is ordinarily approximately from 0.001 to 1 $g/m^2$.

By decoloring the dye appropriately, the optical density after the heat development can be lowered to 0.1 or below. Two or more decoloring dyes may be used together in a thermal decoloration type recording material or a heat-developable photosensitive material. Also, two or more base precursors may be used together.

The base precursors for use in the invention include various kinds of compounds. Since the decoloration reaction is carried out under heated conditions, it is preferred to use a precursor capable of generating (or releasing) a base upon heating. The base precursor capable of generating a base upon heating representatively includes a base precursor of heat-decomposable type (decarboxylation type) composed of a carboxylic acid and a base. When the base precursor of decarboxylation type is heated, a carboxy group of the carboxylic acid is subjected to a decarboxylation reaction to release an organic base. As the carboxylic acid, a carboxylic acid capable of being easily decarboxylated, for example, sulfonylacetic acid or propiolic acid is used. It is preferred that sulfonylacetic acid or propiolic acid has a a group having aromaticity (for example, an aryl group or an unsaturated heterocyclic group), which accelerates the decarboxylation, as a substituent. The base precursor of sulfonylacetic acid and the base precursor of propiolic acid are described in JP-A-59-168441 and JP-A-59-180537, respectively.

As the base component of the base precursor of decarboxylation type, an organic base is preferred, and amidine, guanidine or a derivative thereof is more preferred. The organic base is preferably a diacid base, a triacid base or a tetraacid base, more preferably a diacid base, and most preferably a diacid base of amidine derivative or guanidine derivative.

The diacid base, triacid base or tetraacid base precursors of amidine derivative are described in JP-B-7-59545. The diacid base, triacid base or tetraacid base precursors of guanidine derivative are described in JP-B-8-10321.

The diacid base of amidine derivative or guanidine derivative comprises (A) two amidine parts or guanidine parts, (B) a substituent on amidine parts or guanidine parts, or (C) a divalent connecting group bonding two amidine parts and guanidine parts. Examples of the substituent in (B) include an alkyl group (including a cycloalkyl group), an alkenyl group, an alkynyl group, an aralkyl group and a heterocyclic group. Two or more of the substituents may be combined with each other to form a nitrogen-containing heterocyclic ring. The connecting group in (C) is preferably an alkylene group or a phenylene group.

Specific examples of the diacid base precursor of amidine derivative or guanidine derivative are set forth below.

(BP-1)

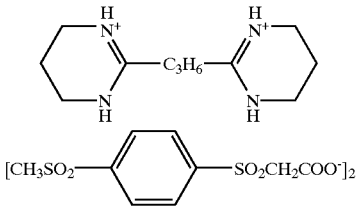

(BP-2)

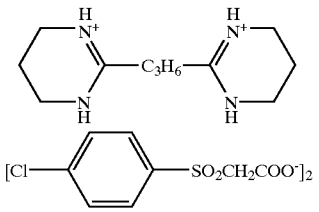

-continued (BP-3)

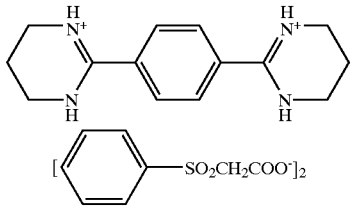

(BP-4)

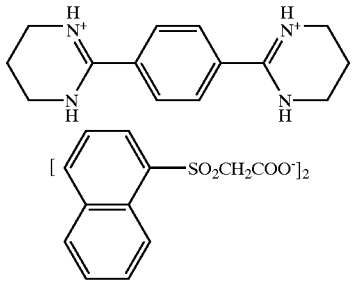

(BP-5)

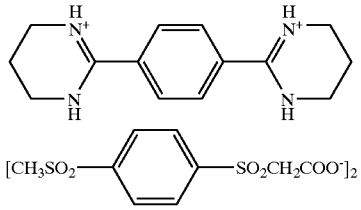

(BP-6)

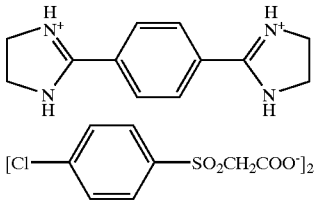

(BP-7)

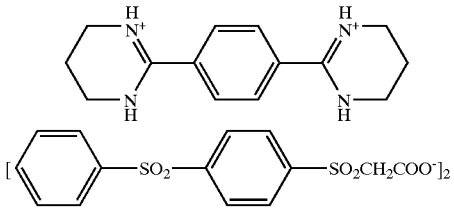

(BP-8)

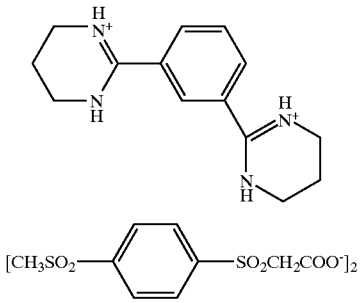

-continued
(BP-9)
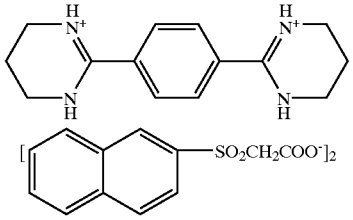
(BP-10)
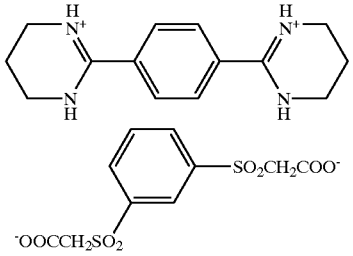
(BP-11)
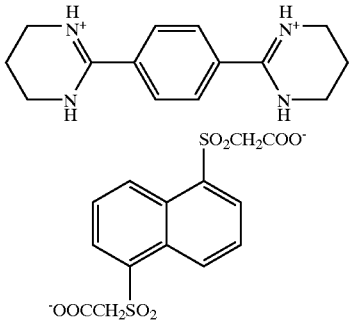
(BP-12)
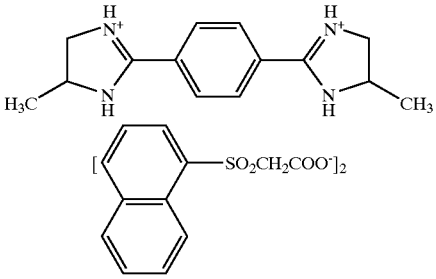
(BP-13)
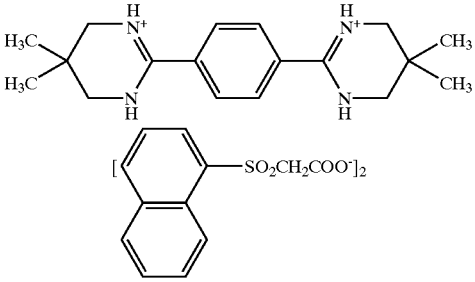
-continued
(BP-14)
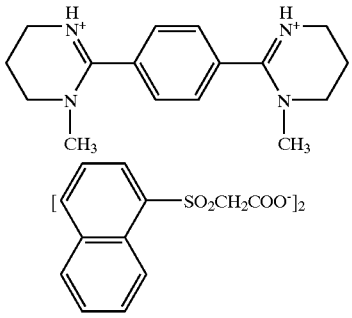
(BP-15)
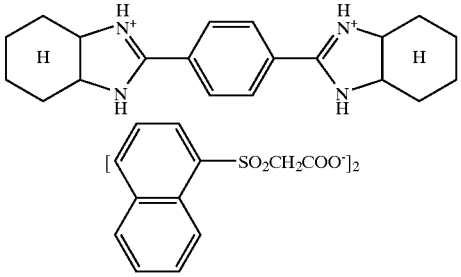
(BP-16)
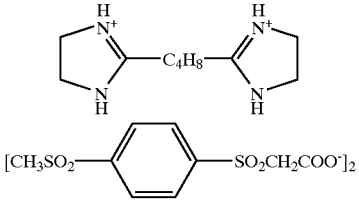
(BP-17)
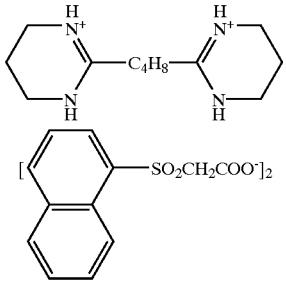
(BP-18)
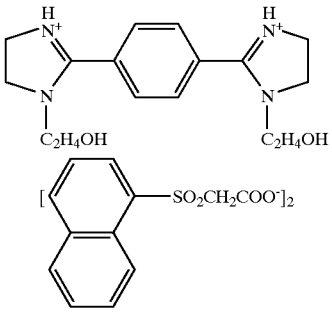

-continued
(BP-19)
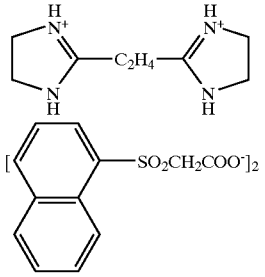
(BP-20)
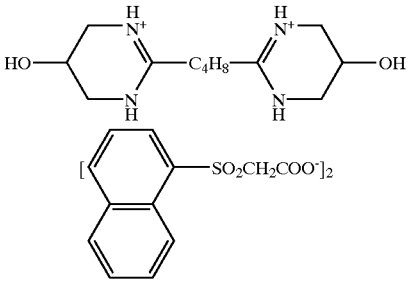
(BP-21)
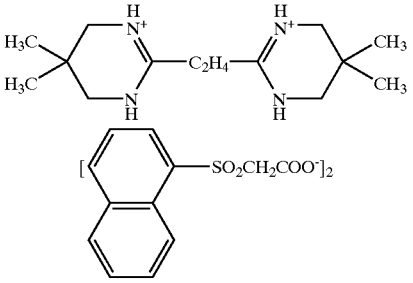
(BP-22)
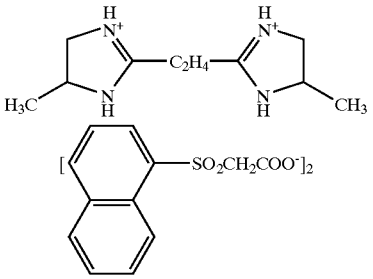
(BP-23)
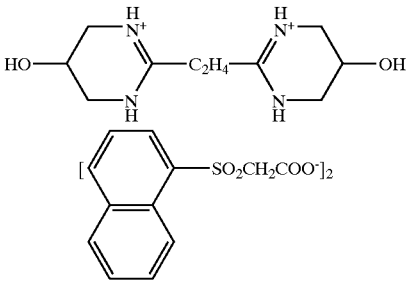
-continued
(BP-24)
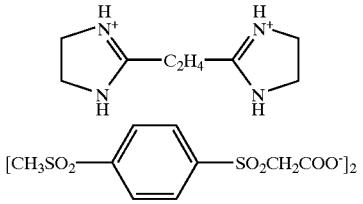
(BP-25)
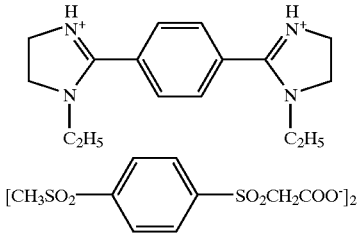
(BP-26)
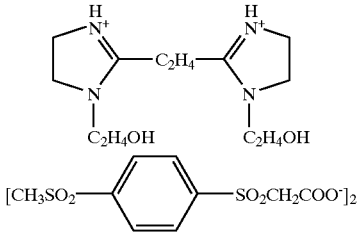
(BP-27)
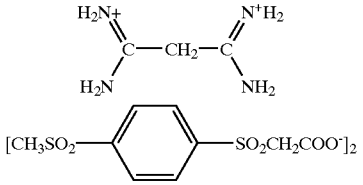
(BP-28)
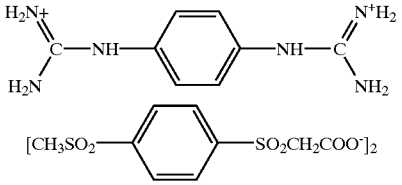
(BP-29)
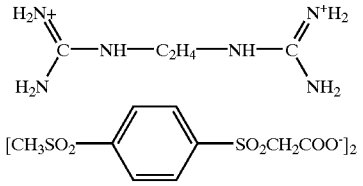
(BP-30)
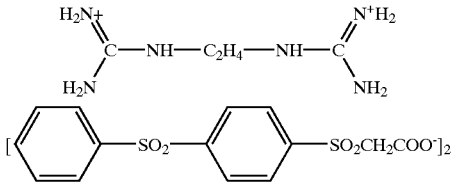

-continued (BP-31)

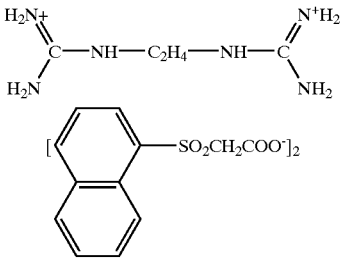

(BP-32)

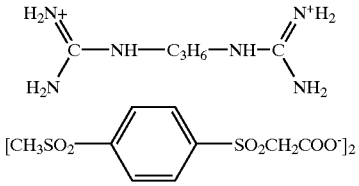

(BP-33)

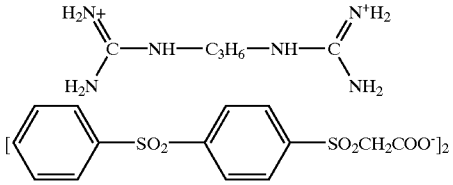

(BP-34)

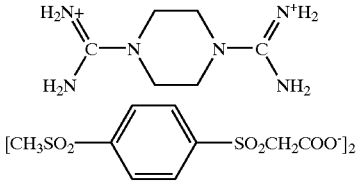

(BP-35)

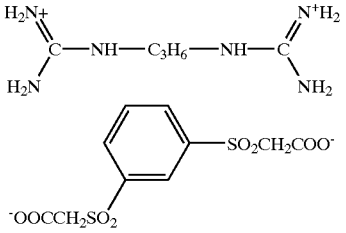

(BP-36)

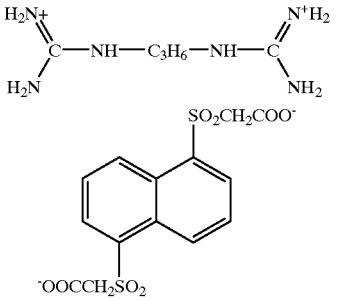

(BP-37)

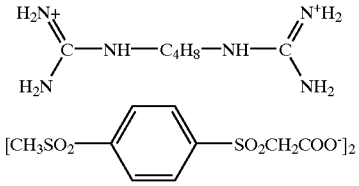

-continued (BP-38)

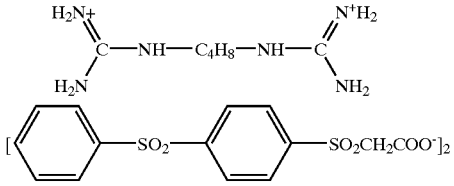

(BP-39)

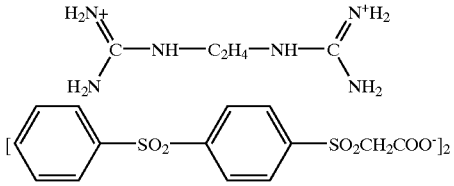

In the thermal decoloration using such a decoloring dye and a base precursor, it is preferred to use a substance capable of lowering a melting point by 3° C. (deg) or more when mixed with the base precursor as described in JP-A-11-352626 (for example, diphenylsulfone or 4-chlorophenyl (phenyl)sulfone), or 2-naphthylbenzoate from the viewpoint of thermal decoloration capability.

For the purpose of improving color tone of silver and preventing change of the image with the lapse of time, a coloring agent having its absorption maximum in the wavelength region of from 300 to 450 nm can be added in the invention. Such coloring agents are described, for example, in JP-A-62-210458, JP-A-63-104046, JP-A-63-103235, JP-A-63-208846, JP-A-63-306436, JP-A-63-314535, JP-A-01-61745 and JP-A-2001-100363.

The coloring agent is ordinarily added in an amount of from 0.1 mg/m$^2$ to 1 g/m$^2$. A layer to which the coloring agent is added is preferably a back layer provided on the side opposite to the light-sensitive layer.

The heat-developable photosensitive material of the invention is preferably a so-called single-sided photosensitive material, namely a photosensitive material having on one side of a support a light-sensitive layer containing at least a silver halide emulsion and on the other side a back layer.

(Description of Matting Agent)

In the invention, addition of a matting agent is preferable for the purpose of improving suitability for conveyance. Descriptions of the matting agent can be found in JP-A-11-65021, paragraphs [0126] and [0127]. The amount of matting agent added is preferably from 1 to 400 mg, more preferably from 5 to 300 mg, per m$^2$ of the photosensitive material.

The shape of matting agent used in the invention may be a regular or irregular shape, but preferably a regular shape, especially a spherical shape. The average diameter of particles is preferably from 0.5 to 10 $\mu$m, more preferably from 1.0 to 8.0 $\mu$m, still more preferably from 2.0 to 6.0 $\mu$m. The variation coefficient of particle size distribution is preferably 50% or below, more preferably 40% or below, still more preferably 30% or below. The term "variation coefficient" used herein means a value represented by (standard deviation of particle diameter)/(average value of particle diameter)×100. Further, it is preferred to use two matting agents each having a small variation coefficient and an average diameter ratio of at least 3.

The emulsion layer surface may have any matting degree so far as it causes no stardust defect, but it has preferably Bekk smoothness of 30 to 2,000 seconds, especially 40 to 1,500 seconds. The Bekk smoothness can be easily determined in conformance with Japanese Industrial Standards (JIS) P8119, entitled "Paper and Paper Board Smoothness Testing Method by Bekk Smoothness Tester", and TAPPI Standard Method T479.

The matting degree of the back layer surface in the invention is preferably from 10 to 1,200 seconds, more preferably from 20 to 800 seconds, still more preferably from 40 to 500 seconds, in terms of Bekk smoothness.

In the invention, it is preferred that the matting agent is contained in the outermost surface layer, a layer functioning as the outermost surface layer, or a layer near the outer surface. It is also preferred to add the matting agent to a layer functioning as the so-called protective layer.

Back layers applicable to the invention are described in JP-A-11-65021, paragraphs [0128] to [0130].

In the heat-developable photosensitive material of the invention, a pH on the surface before heat-development processing is preferably 7.0 or below, more preferably 6.6 or below. The pH on the surface has no particular lower limit, but it is of the order of 3. The most preferable pH range on the surface is from 4 to 6.2. For adjustment of the pH on the surface, an organic acid such as a phthalic acid derivative, a nonvolatile inorganic acid such as sulfuric acid, or a volatile base such as ammonia is used preferably from the viewpoint of decreasing the pH on the surface. In particular, ammonia is preferable for attaining a low pH value on the surface because it is easy to volatilize and to remove at the coating step or before heat development.

In addition, the combined use of ammonia with a nonvolatile base, such as sodium hydroxide, potassium hydroxide or lithium hydroxide, is also preferred. As a method of measuring the pH on the surface, the method described in JP-A-11-87297, paragraph [0123] can be adopted.

A hardener may be used in each of the constituent layers of the invention, such as the light-sensitive layer, the protective layer and the back layer. There are many hardening methods as described in T. H. James, *THE THEORY OF THE PHOTOGRAPHIC PROCESS FOURTH EDITION*, pages 77–87, Macmillan Publishing Co., Inc. (1977), and a wide variety of hardeners can be used. Preferable examples thereof include chrome alum, sodium salt of 2,4-dichloro-6-hydroxy-s-triazine, N,N-ethylenebis(vinylsulfonacetamide), N,N-propylenebis(vinylsulfonacetamide), the polyvalent metal ions as described in the book cited above, page 78, the polyisocyanates as described in U.S. Pat. No. 4,281,060 and JP-A-6-208193, the epoxy compounds as described in U.S. Pat. No. 4,791,042, and the vinylsulfone compounds as described in JP-A-62-89048.

Such a hardener is added as a solution, and the suitable timing at which the solution is added to a coating solution for a protective layer is from 180 minutes before to just before the start of coating, preferably from 60 minutes to 10 seconds before the start of coating. There are no restrictions on the method and the condition for mixing the hardener in the coating solution so far as the effects of the invention can be sufficiently produced. As specific mixing methods, there are known the mixing method using a tank controlled so that the average stay time calculated from the rate of liquid flow added to the tank and the volume of the liquid sent into a coater becomes the desired value, and the method of using a static mixer as described in N. Harnby, M. F. Edwards & A. W. Nienow, *Ekitai Kongou Gijutsu*, Chapter 8 (translated by Koji Takahashi), Nikkan Kogyo Shinbun-sha (1989).

Surfactants usable in the invention include those described in JP-A-11-65021, paragraph [0132], solvents usable in the invention include those described in ibid., paragraph [0133], supports usable in the invention include those described in ibid., paragraph [0134], anti-static or conductive layers applicable to the invention include those described in ibid., paragraph [0135], color image formation methods applicable to the invention include those described in ibid., paragraph [0136], and lubricants usable in the invention include those described in JP-A-11-84573, paragraphs [0061] to [0064], and JP-A-2001-83679, paragraphs [0049] to [0062].

It is preferred for the photosensitive material of the invention to have a conductive layer containing a metal oxide. As a conductive material contained in the conductive layer, metal oxides in which oxygen defects or foreign metal atoms are introduced and thereby increased in conductivity are preferably used. Preferable metal oxides include ZnO, $TiO_2$ and $SnO_2$. The addition of Al and In to ZnO, that of Sb, Nb, P and halogen elements to $SnO_2$, and that of Nb and Ta to $TiO_2$ are preferred. In particular, $SnO_2$ to which Sb is added is preferably used. The amount of foreign atom added is preferably from 0.01 to 30 mole %, and more preferably from 0.1 to 10 mole %. The metal oxide used may have any of spherical, acicular and tabular shapes. From the viewpoint of effectiveness of imparting conductivity, however, acicular grain having major axis/minor axis ratio of at least 2.0, preferably from 3.0 to 50, is advantageously used. The mount of metal oxide used is preferably from 1 to 1,000 $mg/m^2$, more preferably from 10 to 500 $mg/m^2$, and still more preferably from 20 to 200 $mg/m^2$.

The conductive layer may be arranged on the emulsion layer side or the back layer side, but preferably it is disposed between a support and a back layer. Specific examples of the conductive layer usable in the invention are described in JP-A-7-295146 and JP-A-11-223901.

In the invention, it is preferable to use a fluorine-containing surfactant. Examples of the fluorine-containing surfactant usable include the compounds described in JP-A-10-197985, JP-A-2000-19680 and JP-A-2000-214554. The fluorine-containing polymer surfactants described in JP-A-9-281636 are also used preferably. In the heat-developable image recording material of the invention, the fluorine-containing surfactants described in JP-A-2002-82411, Japanese Patent Application Nos. 2001-242357 and 2001-264110 are preferably used. In particular, the fluorine-containing surfactants described in Japanese Patent Application Nos. 2001-242357 and 2001-264110 are preferably used in case of performing coating using an aqueous coating solution in view of charge controlling ability, stability of coated surface and slipability, and the fluorine-containing surfactants described in Japanese Patent Application No. 2001-264110 are most preferred from the viewpoint of a small amount to be used because they have a high charge controlling ability.

In the invention, the fluorine-containing surfactant can be used any of the emulsion layer side and back layer side, and preferably used in both sides. It is particularly preferred to use the fluorine-containing surfactant in combination with the conductive layer containing metal oxide. In such a case, sufficient performances can be achieved even when the amount of fluorine-containing surfactant used on the side of conductive layer is reduced.

The amount of fluorine-containing surfactant used on each of the emulsion layer side and the back layer side is preferably in a range of from 0.1 to 100 $mg/m^2$, more preferably in a range of from 0.3 to 30 $mg/m^2$, and still more preferably in a range of from 1 to 10 $mg/m^2$. In particular, the fluorine-containing surfactants described in Japanese Patent Application No. 2001-264110 exhibit large effects and they are preferably used in a range of from 0.01 to 10 $mg/m^2$, and more preferably in a range of from 0.1 to 5 $mg/m^2$.

The transparent support preferable for the invention is polyester, especially polyethylene terephthalate, which has undergone heat treatment in a temperature range of 130 to 185° C. for the purposes of lessening internal strains remaining in the film upon biaxial stretch and eliminating the distortion caused by thermal shrinkage during the heat development. In the case of a heat-developable photosensitive material for medical use, the transparent support may be colored with a blue dye (e.g., Dye-1 used in Example of JP-A-8-240877), or it may be colorless. To the support are preferably applied undercoat arts using the water-soluble polyester described in JP-A-11-84574, the styrene-butadiene copolymer described in JP-A-10-186565 and the vinylidene chloride copolymers described in JP-A-2000-39684 and JP-A-2001-83679, paragraphs [0063] to [0080], respectively. To the anti-static layer and the undercoat layer can be applied the arts described in JP-A-56-143430, JP-A-56-143431, JP-A-58-62646, JP-A-56-120519, JP-A-11-84573, paragraphs [0040] to [0051], U.S. Pat. No. 5,575,957, and JP-A-11-223898, paragraphs [0078] to [0084].

The heat-developable photosensitive material is preferably a mono-sheet type (or a type which forms images in the heat-developable photosensitive material without using another sheet such as an image-receiving material).

To the heat-developable photosensitive material may further be added an antioxidant, a stabilizer, a plasticizer, an ultraviolet absorbent and a coating aid. These additives are added to either of light-sensitive and light-insensitive layers. For details of these additives WO 98/36322, EP-A-803764, JP-A-10-186567 and JP-A-10-18568 can be referred to.

In preparing the heat-developable photosensitive material, any coating method may be adopted. More specifically, a wide variety of coating operations including extrusion coating, slide coating, curtain coating, dip coating, knife coating, flow coating and the extrusion coating using a hopper as described in U.S. Pat. No. 2,681,294 can be applied. Moreover, the extrusion coating and the slide coating techniques described in Stephen F. Kistler & Petert M. Schweizer, *LIQUID FILM COATING*, pages 399–536, CHAPMAN & HALL CO. (1997) are preferably applied. In particular, the slide coating techniques are preferably used. Examples of the shape of a slide coater usable in the slide coating operation are illustrated in the book cited above, FIG. 11b.1 on page 427. Further, if desired, simultaneous coating of two or more layers may be performed in accordance with the methods as described in the book cited above, pages 399–536, U.S. Pat. No. 2,761,791 and British Patent 837,095.

The coating solution for the present organic silver salt-containing layer is preferably the so-called thixotropic fluid. For the art of forming such a fluid JP-A-11-52509 can be referred to.

The coating solution for the organic silver salt-containing layer has preferably a viscosity of 400 to 100,000 mPa·s, more preferably 500 to 20,000 mPa·s, at a shear rate of 0.1 $S^{-1}$. The viscosity of the coating solution at a shear rate of 1,000 $S^{-1}$ is preferably from 1 to 200 mPa·s, more preferably from 5 to 80 mPa·s.

The techniques described in EP-A-803764, EP-A-883022, WO 98/36322, JP-A-56-62648, JP-A-58-62644, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338096, JP-A-11-338098, JP-A-11-338099, JP-A-11-343420, JP-A-2000-187298, JP-A-2000-10229, JP-A-2000-47345, JP-A-2000-206642, JP-A-2000-98530, JP-A-2000-98531, JP-A-2000-112059, JP-A-2000-112060, JP-A-2000-112104, JP-A-2000-112064 and JP-A-2000-171936 can also be applied to the heat-developable photosensitive material of the invention.

(Description of Packaging Material)

For the purpose of controlling changes caused in photographic properties when the photosensitive material of the invention is stored in a condition of raw film, or improving the resistance of the photosensitive material of the invention to curl and core set, it is preferred to package the raw film in a packaging material having a low oxygen-permeability and/or a low moisture-permeability. The oxygen-permeability of the packaging material is preferably not more than 50 $ml/atm \cdot m^2 \cdot day$, more preferably not more than 10 $ml/atm \cdot m^2 \cdot day$, and still more preferably not more than 1.0 $ml/atm \cdot m^2 \cdot day$, measured at 25° C. The moisture-permeability is preferably not more than 10 $g/atm \cdot m^2 \cdot day$, more preferably not more than 5 $g/atm \cdot m^2 \cdot day$, and still more preferably not more than 1 $g/atm \cdot m^2 \cdot day$.

Specific examples of the packaging material having such low oxygen- and/or moisture-permeability include the packaging materials described in JP-A-8-254793 and JP-A-2000-206653.

(Description of Heat Development)

The heat-developable photosensitive material of the invention may be developed by any method, but it is ordinarily developed by temperature rise after the imagewise exposure. The temperature for development is preferably from 80° C. to 250° C., more preferably from 100° C. to 140° C., and still more preferably from 110° C. to 130° C. The development time is preferably from 1 to 60 seconds, more preferably from 3 to 30 seconds, still more preferably from 5 to 25 seconds, and particularly preferably from 7 to 15 seconds.

The heat development may be performed in a way of using a drum heater or a plate heater, but the way of using a plate heater is preferred in the invention. To the heat development using a plate heater, it is preferable to apply the method described in JP-A-11-133572. More specifically, the method uses a heat-development apparatus that enables conversion of latent images formed in the heat-developable photosensitive material into visible images by bringing the photosensitive materials into contact with a heating means installed in the heat-development section. The apparatus is characterized in that the heating means installed therein is a plate heater, a plurality of pressing rollers are opposed along one surface of the plate heater and the heat-developable photosensitive material is made to pass between the plate heater and the pressing rollers, thereby effecting the heat development. It is preferable that the plate heater is two- to six-segmented and the temperature of the head segment is reduced by the order of 1 to 10° C. For instance, a case can be used where a quartet of plate heaters capable of independent temperature control is used and these plate heaters are adjusted to temperatures of 112° C., 119° C., 121° C. and 120° C., respectively. Such a way of heating is described in JP-A-54-30032, and can remove the moisture and the organic solvent contained in the heat-developable photosensitive material into the outside of the photosensitive material and moreover control a support shape change caused by an abrupt heating of the heat-developable photosensitive material.

The photosensitive material of the invention may be exposed in accordance with any method. As an exposure light source, however, laser light is preferred. Preferred examples of the laser light applied to the invention include gas laser ($Ar^+$, He—Ne), YAG laser, dye laser and semiconductor laser. Also, combination of semiconductor laser and a second harmonic generating device can also be used. A gas or semiconductor laser device emitting red to infrared light is preferred.

As a medical laser imager provided with an exposure section and a heat development section, Fuji Medical Dry Laser Imager FM-DP L can be used. The model FM-DP L is described in *Fuji Medical Review*, No.8, pp. 39–55. The arts described therein are applied to a laser imager used for the heat-developable photosensitive material of the invention. Further, the heat-developable photosensitive material of the invention can also be utilized as a heat-developable photosensitive material for the laser imager in "AD Network" which Fuji Medical System offers as a network system compliant with the DICOM standard.

The heat-developable photosensitive material of the invention forms black-and-white images based on silver images, and preferably used as a heat-developable photosensitive material for medical diagnosis, industrial photography, graphic art and COM purpose.

The invention will be described in more detail with reference to the following examples, but the invention should not be construed as being limited thereto.

EXAMPLE 1

<Production of Polyethylene Terephthalate (PET) Support>

PET having intrinsic viscosity (IV) of 0.66 (measured in a 6:4 (weight ratio) mixture of phenol and tetrachloroethane at 25° C.) was produced using terephthalic acid and ethylene glycol in a usual manner. The PET obtained was shaped into pellets, dried at 130° C. for 4 hours, and then molten at 300° C. Then, it was extruded from a T die and quenched, thereby forming a unstretched film having such a thickness as to provide a thickness of 175 μm after thermal setting.

The film was stretched to 3.3 times its original length by means of rollers differing in peripheral speed, and then stretched on a tenter to 4.5 times its original width. The temperatures during these stretching operations were 110° C. and 130° C., respectively. Thereafter, the film was thermally set at 240° C. for 20 seconds and further, under the same temperature, subjected to 4% relaxation in a lateral direction. Then, the part corresponding to the tenter's chuck was slit off, and the both sides underwent knurl processing. The thus processed film was wound under a tension of 4 kg/cm$^2$ to form a roll of 175 μm-thick film.

<Surface Corona Treatment>

By means of a solid-state corona treater, Model 6 KVA, made by Pillar Technologies, both surfaces of the support was treated at a rate of 20 m/min at room temperature. From the readout numbers of current and voltage under the operation, the treatment of support underwent was calculated to be 0.375 kV·A·min/m$^2$. The treatment frequency and the gap clearance between the electrode and the dielectric roll under the operation were 9.6 kHz and 1.6 mm., respectively.

(Production of Support with Undercoat Layer)

<Preparation of Coating Composition for Undercoat Layer>

Formulation (i) (for Undercoat Layer on Light-Sensitive Layer Side):

| | |
|---|---|
| Pesresin A-520 produced by Takamatsu Oil & Fat Co., Ltd. (30 wt % solution) | 59 g |
| Polyethylene glycol monononyl phenyl ether (average number of ethylene oxide units = 8.5, 10 wt % solution) | 5.4 g |
| MP-1000 produced by Soken Chemical & Engineering Co., Ltd. (fine particles of polymer, average particle size: 0.4 μm) | 0.91 g |
| Distilled water | 935 ml |
| Formulation (ii) (for first layer on back side): | |
| Styrene-butadiene copolymer latex (solid content = 40 wt %, styrene/butadiene = 68/32 by weight) | 158 g |
| Sodium salt of 2,4-dichloro-6-hydroxy-s-triazine (8 wt % aqueous solution) | 20 g |
| Sodium laurylbenzenesulfonate (1 wt % aqueous solution) | 10 ml |
| Distilled water | 854 ml |
| Formulation (iii) (for second layer on back side): | |
| $SnO_2$/SbO (9/1 by weight, average grain size 0.038 μm, 17 wt % dispersion) | 84 g |
| Gelatin (10 wt % aqueous solution) | 89.2 g |
| Metolose TC-5 produced by Shin-Etsu Chemical Co., Ltd. (2 wt % aqueous solution) | 8.6 g |
| MP-1000 produced by Soken Chemical & Engineering Co., Ltd. | 0.01 g |
| Sodium dodecylbenzenesulfonate (1 wt % aqueous solution) | 10 ml |
| NaOH (1 wt % aqueous solution) | 6 ml |
| Proxel produced by Imperial Chemical Industries PLC | 1 ml |
| Distilled water | 805 ml |

<Production of Support with Undercoat Layer>

After the corona discharge processing described above, the biaxially stretched 175 μm-thick polyethylene terephthalate support was coated on one side (photosensitive layer side) with the undercoating composition of formula (i) at a wet coverage of 6.6 ml/m$^2$ (per side) by means of a wire bar, and dried at 180° C. for 5 minutes. Subsequently thereto, the support was coated on the other side (back side) with the undercoating composition of formula (ii) at a wet coverage of 5.7 ml/m$^2$ by means of a wire bar, and dried at 180° C. for 5 minutes, and further thereon with the undercoating composition of formula (iii) at a wet coverage of 7.7 ml/m$^2$ by means of a wire bar, and dried at 180° C. for 6 minutes. Thus, the support provided with the undercoat layers was produced.

(Production of Support A1 Provided with Backing: Comparison)

<Preparation of Coating Composition for Back Side>

<Preparation of Solid Fine Particle Dispersion (a) of Base Precursor>

Distilled water was admixed with 1.5 kg of base precursor Compound-1, 225 g of a surfactant (Demol N, trade name, produced by Kao Corp.), 937.5 g of diphenylsulfone and 15 g of butyl p-hydroxybenzoate (Mekkins M, trade name, produced by Ueno Pharmaceutical Co., Ltd.) to make the total amount of the resulting mixture 5.0 kg. The mixture was subjected to beads dispersion by means of a horizontal sand mill (Model UVM-2, produced by AIMEX Co., Ltd.). More specifically, the mixture was fed into the sand mill UVM-2 packed with zirconia beads having an average diameter of 0.5 mm by means of a diaphragm pump, and underwent a dispersing operation under an inner pressure of at least 50 hPa until the desired average grain size was attained.

While making spectral absorption measurements during the dispersing operation, the operation was continued until the dispersion prepared came to have an absorbance ratio of at least 2.2 between the spectral absorption at 450 nm and that at 650 nm (D450/D650). The thus obtained dispersion was diluted with distilled water so as to have the base precursor concentration of 20 weight %, and filtrated for removal of dusts (by means of a polypropylene filter having an average pore size of 3 μm), and then put to practical use.

<Preparation of Solid Fine Particle Dispersion of Dye>

Distilled water was mixed with 6.0 kg of Cyanine Dye Compound-1 shown below, 3.0 kg of sodium p-dodecylbenzenesulfonate, 0.6 kg of a surfactant (Demol SNB produced by Kao Corp.) and an anti-foaming agent (Surfynol 104E, trade name, a product of Nissin Chemical Industry Co., Ltd.) to make the total amount of the resulting mixture 60 kg. The mixture was subjected to dispersion by means of a horizontal sand mill (UVM-2 produced by AIMEX Co., Ltd.). More specifically, the admixture was fed into the sand mill UVM-2 with zirconia beads having an average diameter of 0.5 mm.

While making spectral absorption measurements during the dispersing operation, the operation was continued until the dispersion prepared came to have an absorbance ratio of at least 5.0 between the spectral absorption at 650 nm and that at 750 nm (D650/D750). The thus obtained dispersion was diluted with distilled water so as to have the cyanine dye concentration of 6 weight %, and filtrated for removal of dusts (by means of a filter having an average pore size of 1 μm), and then put to practical use.

<Preparation of Coating Composition for Anti-Halation Layer-1>

A coating composition for anti-halation layer-1 was prepared by mixing 30 g of gelatin, 24.5 g of polyacrylamide, 2.2 g of an aqueous sodium hydroxide solution having a concentration of 1 mole/liter, 2.4 g of monodisperse fine particles of polymethyl methacrylate (average particle size: 8 μm, standard deviation of particle size: 0.4), 0.08 g of benzisothiazolinone, 35.9 g of Solid Fine Particle Dispersion of Dye described above, 74.2 g of Solid Fine Particle Dispersion (a) of Base Precursor described above, 0.6 g of sodium polystyrenesulfonate, 0.21 g of Blue Dye Compound-1 shown below, 0.15 g of Yellow Dye Compound-1 shown below and 8.3 g of acrylic acid/ethyl acrylate copolymer (copolymerization ratio: 5/95 by weight) latex and adding water to make the total volume 818 ml.

<Preparation of Coating Composition for Protective Layer on Back Side>

In a vessel kept at 40° C. was prepared a coating composition for protective layer on the back side by mixing 40 g of gelatin, a liquid paraffin emulsion containing 1.5 g of liquid paraffin, 6.8 g of an aqueous sodium hydroxide solution having a concentration of 1 mole/liter, 0.5 g of sodium tert-octylphenoxyethoxyethanesulfonate, 0.27 g of sodium polystyrenesulfonate, 5.4 ml of a 2% aqueous solution of fluorine-containing surfactant (F-1) shown below, 5.4 ml of a 2% aqueous solution of fluorine-containing surfactant (F-2), 6.0 g of acrylic acid/ethyl acrylate copolymer (copolymerization ratio: 5/95 by weight) and 2.0 g of N,N-ethylenebis(vinylsulfonacetamide) and adding water to make the total volume 1,000 ml.

<Coating of Back Layer>

On the back side of the support provided with the undercoat layer, the coating composition for anti-halation layer-1 and the coating composition for back protective layer were coated by a simultaneous double coating method so as to have a gelatin coverage of 0.44 g/m$^2$ for the anti-halation layer and a gelatin coverage of 1.7 g/m$^2$ for the back protective layer, and dried to prepare Support A1 provided with backing.

(Production of Support A2 Provided with Backing: Comparison)

Coating composition for anti-halation layer-2 was prepared in the same manner as in Coating composition for anti-halation layer-1 used in the production of Support A1 provided with backing except for eliminating Blue Dye Compound-1.

On the back side of the support provided with the undercoat layer, the coating composition for anti-halation layer-2 and the coating composition for back protective layer were coated by a simultaneous double coating method so as to have a gelatin coverage of 0.44 g/m$^2$ for the anti-halation layer and a gelatin coverage of 1.7 g/m$^2$ for the back protective layer, and dried to prepare Support A1 provided with backing.

(Production of Support A3 Provided with Backing: Invention)

Coating composition for anti-halation layer-3 was prepared in the same manner as in Coating composition for anti-halation layer-1 used in the production of Support A1 provided with backing except for using 10.5 ml of a 2% aqueous solution of Water-Soluble Phthalocyanine Compound 1 (Kayafect Turquoise RN produced by Nippon Nippon Kayaku Co., Ltd.) in place of Blue Dye Compound-1.

On the back side of the support provided with the undercoat layer, the coating composition for anti-halation layer-3 and the coating composition for back protective layer were coated by a simultaneous double coating method so as to have a gelatin coverage of 0.44 g/m$^2$ for the anti-halation layer and a gelatin coverage of 1.7 g/m$^2$ for the back protective layer, and dried to prepare Support A3 provided with backing.

(Production of Supports A11 to A13 Provided with Backing)

Supports A11 to A13 provided with backing were prepared in the same manner as in Supports A1 to A3 provided with backing except that Yellow Dye Compound-1 was eliminated from each coating composition for anti-halation layer and that fluorine-containing surfactants (F-1) and (F-2) used in the coating composition for protective layer on back side were changed to fluorine-containing surfactants (F-3) and (F-4) shown below respectively. Supports A11 to A12 are for comparison and Support A3 is for the invention.

(Preparation of Silver Halide Emulsion)

<Preparation of Silver Halide Emulsion 1>

A solution prepared by adding 3.1 ml of a 1 wt % potassium bromide solution to 1,421 ml of distilled water and then adding thereto 3.5 ml of diluted sulfuric acid having a concentration of 0.5 mole/L and 31.7 g of phthalated gelatin was placed in a reaction pot made of stainless steel, and kept at 30° C. with stirring. Thereto, Solution A prepared by diluting 22.22 g of silver nitrate to 95.4 ml with distilled water and Solution B prepared by diluting 15.3 g of potassium bromide and 0.8 g of potassium iodide to 97.4 ml with distilled water were added at constant flow rates in their entirety over a 45-second period. Thereafter, 10 ml of a 3.5 wt % aqueous solution of hydrogen peroxide was further added, followed by addition of 10.8 ml of a 10 wt % aqueous solution of benzimidazole. Furthermore, Solution C prepared by diluting 51.86 g of silver nitrate to 317.5 ml with distilled water and Solution D prepared by diluting 44.2 g of potassium bromide and 2.2 g of potassium iodide to 400 ml with distilled water were added in a manner that the total amount of Solution C was added at a constant flow rate over a 20-minute period and Solution D was added in accordance with a controlled double jet method while keeping the pAg of the resultant mixture at 8.1. After a 10-minute lapse from the start of the addition of Solutions C and D, potassium hexachloroiridate(III) in an amount of $1\times10^{-4}$ mole per mole of silver was added at once. In addition, after a 5-second lapse from the completion of addition of Solution C, an aqueous solution of potassium iron(II) hexacyanide in an amount of $3\times10^{-4}$ mole per mole of silver was added at once. The pH of the resultant reaction mixture was adjusted to 3.8 by the use of diluted sulfuric acid having a concentration of 0.5 mole/L. At this point the reaction mixture ceased to be stirred, and it was subjected successively to precipitation, desalting and washing operations. In addition, the pH adjustment to 5.9 was carried out by addition of an aqueous solution of sodium hydroxide having a concentration of 1 mole/L. Thus, a silver halide dispersion having a pAg value of 8.0 was prepared.

The silver halide dispersion was kept at 38° C. with stirring and mixed with 5 ml of a 0.34 wt % methanol solution of 1,2-benzisothiazolin-3-one. After a lapse of 40 minutes, the resulting dispersion was mixed with a methanol solution containing a 1:1 by mole mixture of spectral sensitizing Dyes A and B (structural formulae of which are illustrated hereinafter). The total amount of the sensitizing dyes added was $1.2\times10^{-3}$ mole per mole of silver. After a 1-miture lapse, the temperature of the dispersion was raised to 47° C. After a 20-minute lapse from the temperature raise, sodium benzenethiosulfonate in an amount of $7.6\times10^{-5}$ mole/mole silver was added as a methanol solution. After a further lapse of 5 minutes, tellurium sensitizer C shown below in an amount of $2.9\times10^{-4}$ mole per mole of silver was added as a methanol solution. The resulting dispersion was ripened for 91 minutes. The thus ripened dispersion was mixed with 1.3 ml of a 0.8 wt % methanol solution of N,N'-dihydroxy-N"-diethylmelamine. After a 4-minute lapse, thereto were further added $4.8\times10^{-3}$ mole/mole silver of 5-methyl-2-mercaptobenzimidazole as a methanol solution and $5.4\times10^{-3}$ mole/mole silver of 1-phenyl-2-heptyl-5-mercapto-1,3,4-triazole as a methanol solution. Thus, silver halide Emulsion 1 was obtained.

The grains in the thus prepared silver halide emulsion were silver iodobromide grains containing 3.5 mole % of iodide homogeneously and having an average sphere equivalent diameter of 0.042 $\mu$m and a variation coefficient of 20% with respect to sphere equivalent diameter. For determination of such values concerning grain sizes, 1,000 grains were examined with an electron microscope, and the average thereof was calculated. By using Kubelka-Munk method, it was determined that these grains had {100} plane in a proportion of 80%.

<Preparation of Silver Halide Emulsion 2>

A silver halide Emulsion 2 was prepared in the same manner as the silver halide Emulsion 1, except that the solution temperature at the time of grain formation was changed from 30° C. to 47° C., the preparation of Solution B was changed to dilution of 15.9 g of potassium bromide to a volume of 97.4 ml with distilled water, the preparation of Solution D was changed to dilution of 45.8 g of potassium bromide to a volume of 400 ml with distilled water and the addition of potassium iron (II) hexcyanide was omitted. Similarly to the preparation of the silver halide Emulsion 1, precipitating, desalting, washing and dispersing operations were carried out successively. Further, the spectral sensitization and chemical sensitization were performed in the same manner as in Emulsion 1, except that the amount of the methanol solution containing a 1:1 by mole mixture of spectral sensitizing Dyes A and B was changed to $7.5\times10^{-4}$ mole per mole silver in terms of the total amount of the sensitizing Dyes A and B, the amount of the tellurium Sensitizer C was changed to $1.1\times10^{-4}$ mole per mole silver and the amount of 1-phenyl-2-heptyl-5-mercapto-1,3,4-triazole was changed to $3.3\times10^{-3}$ mole per mole silver. The thus obtained emulsion grains of silver halide Emulsion 2 were cubic grains of pure silver bromide having an average sphere equivalent diameter of 0.080 $\mu$m and a variation coefficient of 20% with respect to the sphere equivalent diameter.

<Preparation of Silver Halide Emulsion 3>

A silver halide Emulsion 3 was prepared in the same manner as the silver halide Emulsion 1, except that the solution temperature at the time of grain formation was changed from 30° C. to 27° C., that a solid dispersion containing spectral sensitizing Dyes A and B in a ratio of 1:1 by mole was added as an aqueous gelatin solution in an amount of $6\times10^{-3}$ mole per mole silver in terms of the total amount of the sensitizing Dyes A and B, that the amount of the tellurium Sensitizer C was changed to $5.2\times10^{-4}$ mole per mole silver, and that 3 minutes after the addition of tellurium sensitizer C, bromauric acid in an amount of $5\times10^{-4}$ mole per mole of silver and potassium thiocyanate in an amount of $2\times10^{-3}$ mole per mole of silver were added. Similarly to the preparation of the silver halide Emulsion 1, the precipitating, desalting, washing and dispersing operations were carried out. The thus obtained emulsion grains of silver halide Emulsion 3 were silver iodobromide grains containing 3.5 mole % iodide homogeneously and having an average sphere equivalent diameter of 0.034 $\mu$m and a variation coefficient of 20% with respect to sphere equivalent diameter.

<Preparation of Mixed Emulsion A for Coating Composition>

The silver halide Emulsions 1, 2 and 3 were dissolved in a ratio of 70:15:15 by weight, and thereto was added a 1 wt % aqueous solution of benzothiazolium iodide in an amount of $7\times10^{-3}$ mole per mole silver. Further, water was added thereto in an amount that the silver halide content became 38.2 g per kg of an mixed emulsion for coating composition.

<Preparation of Dispersion A of Silver Salt of Fatty Acid>

Behenic acid (Edenor C22-85R, trade name, produced by Henkel Co.) in an amount of 87.6 kg was mixed with 423 L of distilled water, 49.2 L of an aqueous solution containing NaOH in a concentration of 5 mole/L and 120 L of tert-butanol, and stirred for one hour at 75° C. to prepare a sodium behenate solution A. Separately, 206.2 L of an aqueous solution (pH 4.0) containing 40.4 kg of silver nitrate was prepared, and kept at 10° C. A reaction vessel in which 635 L of distilled water and 30 L of tert-butanol were placed was kept at 30° C. with vigorous stirring, and thereto the total amount of the foregoing sodium behenate solution A and the total amount of the foregoing silver nitrate solution were added at their individual constant flow rates over a period of 93 minutes and 15 seconds and a period of 90 minutes, respectively. More specifically, these two solutions were added in the following manner: The aqueous solution of silver nitrate alone was added for a period from the beginning of addition to a lapse of 11 minutes, then the sodium behenate solution A began to be added, and further the addition of the sodium behenate solution A alone was continued for a period of 14 minutes and 15 seconds after finishing the addition of aqueous silver nitrate solution. During the addition, the temperature inside the reaction vessel was maintained at 30° C. by controlling externally so that the mixed solution temperature was kept constant. The jacketed pipe laid for feeding the sodium behenate solution A was kept warm by circulating hot water through the outer part thereof, and the solution temperature at the exit of the addition nozzle tip was regulated at 75° C. As to the jacketed pipe laid for feeding the aqueous silver nitrate solution, the solution temperature was kept constant by circulating cold water through the outer part of the pipe. The nozzle tip from which the sodium behenate solution A was fed and that from which the aqueous silver nitrate solution was fed were arranged symmetrically about the stirring axis, and situated above the reaction solution so as to avoid the contact of those solutions with the reaction solution.

After the addition of the sodium behenate solution A was completed, the reaction solution was stirred for 20 minutes as the temperature thereof was kept unchanged, and then the solution temperature was raised to 35° C. over a 30-minute period. And the resulting solution was ripened for 210 minutes. Immediately after the completion of ripening, the solid matter in the ripened solution was filtered off by centrifugal filtration, and washed with water till the filtrated water became to have a conductivity of 30 $\mu$S/cm. Thus, the silver salt of fatty acid was obtained. The solid matter obtained was stored as wet cake without undergoing any drying treatment.

The form of the thus produced silver behenate grains was evaluated by electron micrography. As a result, the grains were found to have the crystal shape of scales, specifically with, on average, a=0.14 $\mu$m, b=0.4 $\mu$m and c=0.6 $\mu$m, an average aspect ratio of 5.2, an average sphere equivalent diameter of 0.52 $\mu$m and a variation coefficient of 15% with respect to the sphere equivalent diameter (wherein a, b and c have the same meaning as defined hereinbefore, respectively).

To the wet cake in the amount corresponding to 260 kg on a dry solids basis, 19.3 kg of polyvinyl alcohol (PVA-217, trade name, produced by Kuraray Co. Ltd.) was added. Further, water was added thereto in the amount to adjust the total weight of the resultant mixture to 1,000 kg, and the mixture was made into slurry with dissolver blades and preliminary dispersed with a pipeline mixer (Model PM-10, made by MIZUHO INDUSTRIAL CO., LTD.)

The thus preliminarily dispersed solution was processed three times by using a dispersing machine, Microfluidizer M-610 (trade name, produced by Microfluidex International Corporation, wherein Z-type interaction chamber was used), under the pressure adjusted to 1260 kg/cm$^2$, thereby preparing a dispersion of silver behenate. The dispersion temperature was set at 18° C. by mounting coiled heat exchangers on the front and the rear of interaction chamber respectively, and controlling the temperature of the coolant used therein.

<Preparation of Dispersion B of Silver Salt of Fatty Acid>

<<Preparation of Recrystallized Behenic Acid>>

100 kg of behenic acid (trade name: Edenor C22-85R, produced by Henkel Japan Co., Ltd.) was mixed with 1,200 kg of isopropyl alcohol. The mixture was then subjected to dissolution at a temperature of 50° C. The solution was filtered through a filter having a pore diameter of 10 $\mu$m, and then cooled to a temperature of 30° C. so that it was recrystallized. During the recrystallization procedure, the cooling rate was controlled to 3° C./hr. The resulting crystal was subjected to centrifugal filtration, washed with 100 kg of isopropyl alcohol, and then dried. The crystal thus obtained was esterified, and then subjected to GC-FID measurement. As a result, the crystal was found to have a behenic acid content of 96%, a lignoceric acid content of 2% and an arachidic acid content of 2%.

<<Preparation of Dispersion B of Silver Salt of Fatty Acid>>

88 kg of the recrystallized behenic acid, 422 L of distilled water, 49.2 L of a 5 mole/L aqueous solution of NaOH, and 120 L of tert-butyl alcohol were mixed. The mixture was then stirred at a temperature of 75° C. for 1 hour so that it was reacted to obtain sodium behenate solution B. Separately, 206.2 L of an aqueous solution (pH 4.0) of 40.4 kg of silver nitrate was prepared and kept at a temperature of 10° C. To 635 L of distilled water and 30 L of tert-butyl alcohol in a reaction vessel which had been kept at a temperature of 30° C. were added all the amount of the sodium behenate solution B previously prepared and all the amount of the aqueous solution of silver nitrate previously prepared at a constant flow rate in 93 minutes and 15 seconds and in 90 minutes, respectively, with thorough stirring. During the procedure, only the aqueous solution of silver nitrate was added for 11 minutes from the beginning of the addition of aqueous solution of silver nitrate, and then the addition of the sodium behenate solution B began. Only the sodium behenate solution B was added for 14 minutes and 15 seconds from the termination of addition of the aqueous solution of silver nitrate. During the procedure, the temperature in the reaction vessel was 30° C. and the ambient temperature was controlled such that the liquid temperature was kept constant. The piping in the system for the addition of the sodium behenate solution B was kept at a constant temperature by circulating hot water through the outer pipe in a double pipe, and the liquid temperature at the outlet of the injection nozzle was adjusted to 75° C. The piping in the system for the addition of the aqueous solution of silver nitrate was kept at a constant temperature by circulating cold water through the outer piper in a double pipe. The position at which the sodium behenate solution B was added and the position at which the aqueous solution of silver nitrate was added was asymmetric about the axis of stirring. The two addition positions were adjusted high enough not to come in contact with the reaction solution.

After the termination of addition of sodium behenate solution B, the mixture was allowed to stand at the same temperature with stirring for 20 minutes, then heated to a temperature of 35° C. over a period of 30 minutes, and ripened for 210 minutes. Immediately after the termination of ripening, the emulsion was then subjected to centrifugal filtration to separate the solid content which was then rinsed until the conductivity of the filtrate reached 30 $\mu$S/cm. Thus, silver salt of fatty acid was obtained. The solid content thus obtained was then stored without drying in the form of wet cake.

The form of the silver behenate particles thus obtained was then evaluated by electron micrography. As a result, the silver behenate was found to be a crystal having a side a of 0.21 $\mu$m, a side b of 0.4 $\mu$m and a side c of 0.4 $\mu$m on the average, an average aspect ratio of 2.1, an average sphere equivalent diameter of 0.51 $\mu$m and a variation coefficient of 11% with respect to the sphere equivalent diameter (wherein a, b and c have the same meaning as defined hereinbefore, respectively).

To the wet cake in a dry solid content of 260 kg was added 19.3 kg of polyvinyl alcohol (trade name: PVA-217). To the mixture was added water to make 1,000 kg. The mixture was slurried by means of a dissolver blade. The mixture was subjected to previous dispersion using a pipe line mixer (PM-10 produced by MIZUHO Industrial Co., Ltd.).

Subsequently, the raw liquid which had thus been previously dispersed was processed three times by means of a dispersing machine (trade name: Microfluidizer M-610, produced by Microfluidex International Corporation; equipped with a Z type interaction chamber) the pressure in which had been adjusted to 1,150 kg/cm$^2$ to obtain a silver behenate dispersion. In order to cool the system, the interaction chamber was provided with spiral heat exchangers in front and rear thereof. By adjusting the temperature of the coolant, the dispersion temperature was kept at 18° C.

(Preparation of Reducing Agent Dispersion)

<Preparation of Dispersion of Reducing Agent Complex 1>

To 10 kg of reducing agent complex 1 (1:1 complex of 6,6'-di-tert-butyl-4,4'-dimethyl-2,2'-butylidenediphenol and triphenylphosphine oxide) shown below, 0.12 kg of triphenylphosphine oxide and 16 kg of a 10 weight % aqueous solution of a modified polyvinyl alcohol (Poval MP203, produced by KURARAY CO., LTD.) was added 10 kg of water. The mixture was then thoroughly stirred to obtain a slurry. The slurry was supplied by a diaphragm pump into a horizontal sandmill (UVM-2 produced by AIMEX Co., Ltd.) filled with zirconia beads having an average diameter of 0.5 mm where it was then dispersed for 4 hours and 30 minutes. To the dispersion were then added 0.2 g of benzoisothiazolinone sodium salt and water to the reducing agent complex concentration of 22% by weight to obtain a dispersion of reducing agent complex 1.

The particles in the reducing agent complex dispersion thus obtained had a median diameter of 0.45 μm and a maximum particle diameter of not greater than 1.4 μm. The reducing agent complex dispersion thus obtained was filtered through a polypropylene filter having a pore diameter of 3.0 μm to remove foreign matters such as dust, and then stored.

<Preparation of Dispersion of Reducing Agent 2>

To 10 kg of reducing agent 2 (6,6'-di-tert-butyl-4,4'-dimethyl-2,2'-butylidenediphenol) shown below and 16 kg of a 10 weight % aqueous solution of a modified polyvinyl alcohol (Poval MP203, produced by KURARAY CO., LTD.) was added 10 kg of water. The mixture was then thoroughly stirred to obtain a slurry. The slurry was supplied by a diaphragm pump into a horizontal sandmill (UVM-2 produced by AIMEX Co., Ltd.) filled with zirconia beads having an average diameter of 0.5 mm where it was then dispersed for 3 hours and 30 minutes. To the dispersion were then added 0.2 g of benzoisothiazolinone sodium salt and water to the reducing agent concentration of 25% by weight. The dispersion was subjected to heat treatment at 60° C. for 5 hours to obtain a dispersion of reducing agent 2.

The particles in the reducing agent dispersion thus obtained had a median diameter of 0.40 μm and a maximum particle diameter of not greater than 1.5 μm. The reducing agent dispersion thus obtained was filtered through a polypropylene filter having a pore diameter of 3.0 μm to remove foreign matters such as dust, and then stored.

<Preparation of Dispersion of Hydrogen Bond-Forming Compound 1>

To 10 kg of Hydrogen Bond-Forming Compound 1 (tri(4-tert-butylphenyl)phosphine oxide) shown below and 16 kg of a 10 wt % aqueous solution of modified polyvinyl alcohol (Poval MP-203 produced by Kuraray Co., Ltd.), 10 kg of water was added and thoroughly mixed to prepare a slurry. The slurry was fed by means of a diaphragm pump into a horizontal sand mill (Model UVM-2, made by AIMEX Co., Ltd.) packed with zirconia beads having an average diameter of 0.5 mm, and underwent a dispersing operation over a period of 3 hours and 30 minutes, and further adjusted so as to have the hydrogen bond-forming compound concentration of 25 wt % by addition of 0.2 g of sodium salt of benzisothiazolinone and water. The dispersion was heated at 80° C. for one hour to obtain a dispersion of Hydrogen Bond-Forming Compound 1 was obtained. The hydrogen bond-forming compound particles present in the thus prepared dispersion had a median diameter of 0.35 μm and the maximum diameter of 1.5 μm or below. The dispersion was passed through a polypropylene filter having a pore size of 3.0 μm to eliminate extraneous matter including dust, and then stored.

<Preparation of Dispersion of Development Accelerator 1>

To 10 kg of Development Accelerator 1 shown below and 20 kg of a 10 wt % aqueous solution of modified polyvinyl alcohol (Poval MP-203 produced by Kuraray Co., Ltd.), 10 kg of water was added and thoroughly mixed therein to prepare a slurry. The slurry was fed by means of a diaphragm pump into a horizontal sand mill (Model UVM-2, made by AIMEX Co., Ltd.) packed with zirconia beads having an average diameter of 0.5 mm, and underwent a dispersing operation over a period of 3 hours and 30 minutes, and further adjusted so as to have the development accelerator concentration of 20 wt % by addition of 0.2 g of sodium salt of benzisothiazolinone and water. Thus, a dispersion of Development Accelerator 1 was obtained. The development accelerator particles present in the thus prepared dispersion had a median diameter of 0.48 μm and the maximum diameter of 1.4 μm or below. The dispersion was passed through a polypropylene filter having a pore size of 3.0 μm to eliminate extraneous matter including dust, and then stored.

Solid dispersions of Development Accelerator 2 and Color Tone Controlling agent 1 shown below were prepared in the same manner as in the dispersion of Development Accelerator 1, respectively. The concentration of each dispersion was 20 wt %.

(Preparation of Polyhalogen Compound Dispersion)

<Preparation of Dispersion of Organic Polyhalogen Compound 1>

Ten kilograms of Organic Polyhalogen Compound 1 (tribromomethanesulfonylbenzene) shown below, 10 kg of a 20 wt % aqueous solution of modified polyvinyl alcohol (Poval MP-203 produced by Kuraray Co., Ltd.), 0.4 kg of a 20 wt % aqueous solution of sodium triisopropylnaphthalenesulfonate and 14 kg of water were thoroughly mixed together to prepare a slurry. The slurry was fed by means of a diaphragm pump into a horizontal sand mill (Model UVM-2, made by AIMEX Co., Ltd.) packed with zirconia beads having an average diameter of 0.5 mm, and subjected to a dispersing operation over a period of 5 hours, and adjusted so as to have the organic polyhalogen compound concentration of 26 wt % by addition of 0.2 g of sodium salt of benzisothiazolinone and water. Thus, a dispersion of Organic Polyhalogen Compound 1 was obtained. The organic polyhalogen compound particles present in the thus prepared dispersion had a median diameter of 0.41 μm and the maximum diameter of 2.0 μm or below. The dispersion was passed through a polypropylene filter having a pore size of 10.0 μm to eliminate extraneous matter including dust, and then stored.

<Preparation of Dispersion of Organic Polyhalogen Compound 2>

Ten kilograms of Organic Polyhalogen Compound 2 (N-butyl-3-tribromomethanesulfonylbenzamide) shown below, 20 kg of a 10 wt % aqueous solution of modified polyvinyl alcohol (Poval MP-203 produced by Kuraray Co., Ltd.) and 0.4 kg of a 20 wt % aqueous solution of sodium triisopropylnaphthalenesulfonate were thoroughly mixed together to prepare a slurry. The slurry was fed by means of a diaphragm pump into a horizontal sand mill (Model UVM-2, made by AIMEX Co., Ltd.) packed with zirconia beads having an average diameter of 0.5 mm, and subjected to a dispersing operation over a period of 5 hours, and further adjusted so as to have the organic polyhalogen compound concentration of 30 wt % by addition of 0.2 g of sodium salt of benzisothiazolinone and water. The dispersion obtained was heated at 40° C. for 5 hours. Thus, a dispersion of Organic Polyhalogen Compound 2 was obtained. The organic polyhalogen compound particles present in the thus prepared dispersion had a median diameter of 0.40 μm and the maximum diameter of 1.3 μm or below. The dispersion was passed through a polypropylene filter having a pore size of 3.0 μm to eliminate extraneous matter including dust, and then stored.

<Preparation of Solution of Phthalazine Compound 1>

In 174.57 kg of water, 8 kg of modified polyvinyl alcohol (Poval MP-203 produced by Kuraray Co., Ltd.) was dissolved. To the solution were added 3.15 kg of a 20 wt % aqueous solution of sodium triisopropylnaphthalenesulfonate and 14.28 kg of a 70 wt % aqueous solution of Phthalazine Compound 1 (6-isopropylphthalazine) shown below. Thus, a 5 wt % solution of Phtahalzine Compound-1 was prepared.

(Preparation of Solution of Mercapto Compound)

<Preparation of Aqueous Solution of Mercapto Compound 1>

In 993 g of water was dissolved 7 g of Mercapto Compound 1 (sodium salt of 1-(3-sulfophenyl)-5-mercaptotetrazole) shown below to prepare a 0.7 wt % aqueous solution.

<Preparation of Aqueous Solution of Mercapto Compound 2>

In 980 g of water was dissolved 20 g of Mercapto Compound 2 (sodium salt of 1-(3-methylureido)-5-mercaptotetrazole) shown below to prepare a 2.0 wt % aqueous solution.

<Preparation of Dispersion of Pigment 1>

To 64 g of C.I. Pigment Blue 60 and 6.4 g of Demol N produced by Kao Corp. was added 250 g of water. The composition was thoroughly mixed to form a slurry. The slurry and 800 g of zirconia beads having an average diameter of 0.5 mm were put in a vessel and dispersed for 25 hours by means of a dispersing machine (1/4 G sand grinder mill produced by AIMEX Co., Ltd.), thereby preparing a dispersion of Pigment 1. The pigment particles in the pigment dispersion thus obtained had an average particle size of 0.21 μm.

<Preparation of SBR Latex>

A latex of SBR having Tg of 22° C. was prepared in the following manner.

Emulsion polymerization of 70.0 parts by weight of styrene, 27.0 parts by weight of butadiene and 3.0 parts by weight of acrylic acid was performed in the presence of ammonium persulfate as a polymerization initiator and an anionic surfactant as an emulsifier, followed by aging at 80° C. for 8 hours. Then, the polymerization product was cooled to 40° C. and adjusted to pH 7.0 by use of aqueous ammonia. Thereto, SANDET BL produced by Sanyo Chemical Industries, Ltd. was added in an amount to reach a content of 0.22%. The pH of the resultant matter was adjusted to 8.3 by addition of a 5% aqueous solution of sodium hydroxide, and further to 8.4 by use of aqueous ammonia. The ratio of sodium ion to ammonium ion used in this pH adjustment was 1:2.3 by mole. Then 0.15 ml of a 7% aqueous solution of sodium salt of benzisothiazolinone was added per kg of the mixture, thereby preparing a SBR latex. (SBR latex: Latex of -St(70.0)-Bu(27.0)-AA(3.0)-) Tg: 22° C.; average particle size: 0.1 μm; concentration: 43 wt %; equilibrium water content at 25° C. and 60% RH: 0.6 wt %; ionic conductivity of undiluted latex (43 wt %): 4.2 mS/cm (measured at 25° C. with a conductometer, Model CM-30S, produced by DKK-TOA Corp.); pH: 8.4

SBR latices having different Tg values can be prepared in a similar manner described above by appropriately varying the ratio of styrene to butadiene.

<Preparation of Coating Composition-1 for Emulsion Layer (Light-Sensitive Layer)>

To 1,000 g of the dispersion A of silver salt of fatty acid were added successively 276 ml of water, 33 g of the dispersion of Pigment 1, 21 g of the dispersion of Organic Polyhalogen Compound 1, 58 g of the dispersion of Organic Polyhalogen Compound 2, 173 g of the solution of Phthalazine Compound 1, 1,082 g of the SBR latex (Tg: 22° C.), 299 g of the dispersion of Reducing Agent Complex 1, 5.7 g of the dispersion of Development Accelerator 1, 9 ml of the aqueous solution of Mercapto Compound 1 and 27 ml of the aqueous solution of Mercapto Compound 2. To the mixture, 117 g of the silver halide mixed Emulsion A was added just before coating, followed by mixing thoroughly. The coating composition for emulsion layer thus prepared was fed into a coating die without delay and underwent coating operation.

The viscosity of the coating composition was 25 [mPa·s] measured at 40° C. (No.1 rotor, 60 rpm) with a Brookfield type viscometer produced by Tokyo Keiki Kogyo.

Further, the coating composition had viscosity values of 230, 60, 46, 24 and 18 [mPa·s] as measured at 25° C. under shear rates of 0.1, 1, 10, 100 and 1,000 [1/sec], respectively, by means of RFS Fluid Spectrometer produced by Rheometrics Fareast Co., Ltd.

The content of zirconium in the coating composition was 0.38 mg per g of silver.

<Preparation of Coating Composition-2 for Emulsion Layer (Light-Sensitive Layer)>

To 1,000 g of the dispersion B of silver salt of fatty acid were added successively 276 ml of water, 35 g of the dispersion of Pigment 1, 32 g of the dispersion of Organic Polyhalogen Compound 1, 46 g of the dispersion of Organic Polyhalogen Compound 2, 173 g of the solution of Phthalazine Compound 1, 1,082 g of the SBR latex (Tg: 20° C.), 153 g of the dispersion of Reducing Agent 2, 55 g of the dispersion of Hydrogen Bond-Forming Compound 1, 4.8 g of the dispersion of Development Accelerator 1, 5.2 g of the dispersion of Development Accelerator 2, 2.1 g of the dispersion of Color Tone Controlling Agent 1 and 8 ml of the aqueous solution of Mercapto Compound 2. To the mixture, 140 g of the silver halide mixed Emulsion A was added just before coating, followed by mixing thoroughly. The coating composition for emulsion layer thus prepared was fed into a coating die without delay and underwent coating operation.

The viscosity of the coating composition was 40 [mPa·s], measured at 40° C. (No.1 rotor, 60 rpm) with a Brookfield type viscometer produced by Tokyo Keiki Kogyo.

Further, the coating composition had viscosity values of 530, 144, 96, 51 and 28 [mPa·s] as measured at 25° C. under shear rates of 0.1, 1, 10, 100 and 1,000 [1/sec], respectively, by means of RFS Fluid Spectrometer produced by Rheometrics Fareast Co., Ltd.

The content of zirconium in the coating composition was 0.25 mg per g of silver.

<Preparation of Coating Composition for Interlayer on Emulsion Side>

The coating composition for interlayer was prepared by mixing 1,000 g of polyvinyl alcohol (PVA-205 produced by Kuraray Co., Ltd.), 272 g of the dispersion of Pigment 1, 4,200 ml of a 19 wt % latex of methyl methacrylate/styrene/butyl acrylate/hydroxyethyl methacrylate/acrylic acid copolymer (copolymerization ratio: 64/9/20/5/2 by weight), 27 ml of a 5 wt % aqueous solution of Aerosol OT (produced by American Cyanamid Co.) and 135 ml of a 20 wt % aqueous solution of diammonium phthalate, adding thereto water in an amount to make the total amount 10,000 g, and adjusting the pH to 7.5 by addition of NaOH. The composition thus prepared was fed into a coating die to attain a coverage of 9.1 ml/m$^2$.

The viscosity of the coating composition was 58 [mPa·s] at 40° C. (No.1 rotor, 60 rpm) measured with the Brookfield type viscometer.

<Preparation of Coating Composition for First Protective Layer on Emulsion Side>

Inert gelatin in an amount of 64 g was dissolved in water, and thereto were added 112 g of a 19.0 wt % latex of methyl methacrylate/styrene/butyl acrylate/hydroxyethyl methacrylate/acrylic acid copolymer (copolymerization ratio: 64/9/20/5/2 by weight), 30 ml of a 15 wt % methanol solution of phthalic acid, 23 ml of a 10 wt % aqueous solution of 4-methylphthalic acid, 28 ml of diluted sulfuric acid having a concentration of 0.5 mole/L, 5 ml of a 5 wt % aqueous solution of Aerosol OT (American Cyanamid Co.), 0.5 g of phenoxyethanol and 0.1 g of benzoisothiazolinone. Further, water was added thereto in an amount to adjust the total weight of the resultant mixture to 750 g, thereby preparing a coating composition. The composition was mixed with 26 ml of a 4 wt % aqueous solution of chrome alum by means of a static mixer just before coating, and fed into a coating die to attain a coverage of 18.6 ml/m$^2$.

The viscosity of the coating composition was 20 [mPa·s] at 40° C. (No.1 rotor, 60 rpm) measured with the Brookfield type viscometer.

<Preparation of Coating Composition for Second Protective Layer on Emulsion Side>

Inert gelatin in an amount of 80 g was dissolved in water, and thereto were added 102 g of a 27.5 wt % latex of methyl methacrylate/styrene/butyl acrylate/hydroxyethyl methacrylate/acrylic acid copolymer (copolymerization ratio: 64/9/20/5/2 by weight), 5.4 ml of a 2 wt % solution of fluorine-containing surfactant (F-1), 5.4 ml of a 2 wt % aqueous solution of fluorine-containing surfactant (F-2), 23 ml of a 5 wt % aqueous solution of Aerosol OT (American Cyanamid Co.), 4 g of fine particle of polymethyl methacrylate (average particle size: 0.7 μm), 21 g of fine particle of polymethyl methacrylate (average particle size: 4.5 μm), 1.6 g of 4-methylphthalic acid, 4.8 g of phthalic acid, 44 ml of diluted sulfuric acid having a concentration of 0.5 mole/L and 10 mg of benzoisothiazolinone. Further, water was added thereto in an amount to adjust the total weight to 650 g and, just before coating, mixed with 445 ml of aqueous solution containing 4 wt % chrome alum and 0.67 wt % phthalic acid by means of a static mixer, thereby preparing a coating composition for second surface protective layer on the emulsion side. The composition was fed into a coating die to attain a coverage of 8.3 ml/m$^2$.

The viscosity of the coating composition was 19 [mPa·s] at 40° C. (No.1 rotor, 60 rpm) measured with the Brookfield type viscometer.

(Production of Heat-Developable Photosensitive Materials 101 to 103)

On the undercoat opposite to the back side of each of Supports A1 to A3 provided with backing, the emulsion layer (Coating Composition-1), the interlayer, the first protective layer and the second protective layer were simultaneously coated in this order using a slide beads multiple coating method, thereby producing a heat-developable photosensitive material. The temperature of the emulsion layer and the interlayer was adjusted to 31° C., that of the first protective layer to 36° C., and that of the second protective layer to 37° C.

The coverage (g/m$^2$) of each ingredient in the emulsion layer is described below:

| | |
|---|---|
| Silver behenate | 5.58 |
| Pigment (C. I. Pigment Blue 60) | 0.036 |
| Polyhalogen Compound 1 | 0.12 |
| Polyhalogen Compound 2 | 0.37 |
| Phthalazine Compound 1 | 0.19 |
| SBR latex | 9.98 |
| Reducing Agent Complex 1 | 1.41 |
| Development Accelerator 1 | 0.025 |
| Mercapto Compound 1 | 0.002 |
| Mercapto Compound 2 | 0.012 |
| Silver halide (as silver) | 0.091 |

The coating and drying conditions were as follows:

The coating operation was carried out at a speed of 160 m/min, the clearance between the tip of the coating die and the support was chosen from the range of 0.10 to 0.30 mm, and the pressure of the vacuum chamber was controlled so as to be from 196 to 882 Pa lower than atmospheric pressure. Prior to coating, static charge of the support was eliminated by ion wind.

In the chilling zone subsequent to the coating zone, the air having a dry-bulb temperature of 10–20° C. was made to blow against the coated layer to effect the chilling. Thereafter, the support with the coated layer was conveyed in a contact-free condition, and dried by blowing drying air having a dry-bulb temperature of 23–45° C. and a wet-bulb temperature of 15–21° C. by use of a helical non-contact dryer.

After the drying, the coated layer underwent moisture adjustment at 25° C. under humidity of 40–60% RH, and then heated up to 70–90° C., followed by cooling to 25° C.

The mattness of the heat-developable photosensitive material thus produced was 550 seconds on the photosensitive layer side and 130 seconds on the back layer side in terms of Bekk smoothness. The pH of the surface on the photosensitive layer side was found to be 6.0

(Production of Heat-Developable Photosensitive Materials 201 to 203)

Heat-developable photosensitive materials 201 to 203 were produced in the same manner as the heat-developable photosensitive materials 101 to 103, except that Supports A11 to A13 provided with backing were used in place of the Supports A1 to A3 provided with backing, that the coating Composition-2 for emulsion layer was used in place of the coating Composition-1 for emulsion layer, and that the fluorine-containing surfactants (F-1) and (F-2) in the coating composition for second protective layer were changed to the fluorine-containing surfactants (F-3) and (F-4) respectively.

The coverage (g/m$^2$) of each ingredient in the emulsion layer is described below:

| | |
|---|---|
| Silver behenate | 5.27 |
| Pigment (C. I. Pigment Blue 60) | 0.036 |
| Polyhalogen Compound 1 | 0.17 |
| Polyhalogen Compound 2 | 0.28 |
| Phthalazine Compound 1 | 0.18 |
| SBR latex | 9.43 |
| Reducing Agent 2 | 0.77 |
| Hydrogen Bond-Forming Compound 1 | 0.28 |
| Development Accelerator 1 | 0.019 |
| Development Accelerator 2 | 0.020 |
| Color Tone Controlling Agent 1 | 0.008 |
| Mercapto Compound 2 | 0.003 |
| Silver halide (as silver) | 0.091 |

The chemical structures of the compounds used in the example are illustrated below.

Spectral Sensitizing Dye A

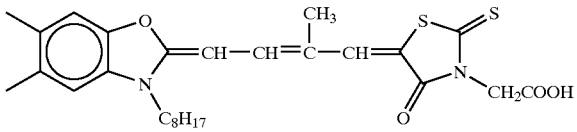

Spectral Sensitizing Dye B

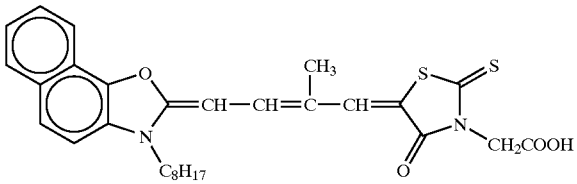

Tellurium Sensitizer C

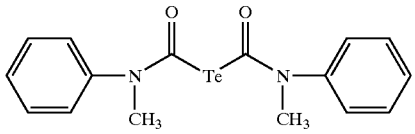

Base Precursor Compound 1

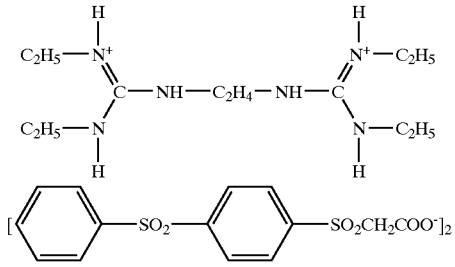

Cyanine Dye Compound 1

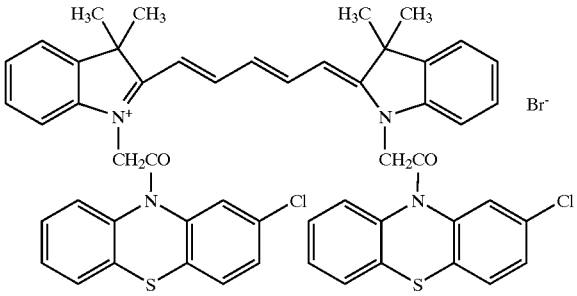

-continued

Blue Dye Compound 1

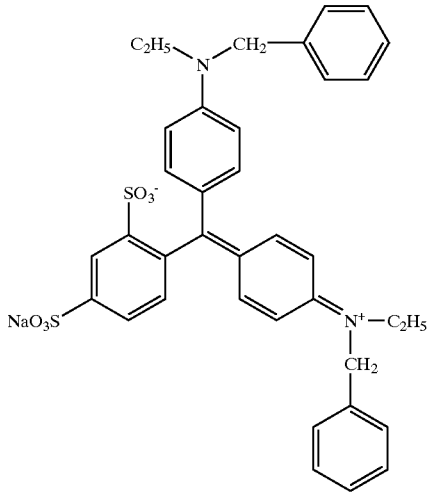

Yellow Dye Compound 1

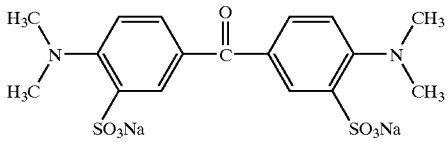

Reducing Agent Complex 1

1:1 Complex of

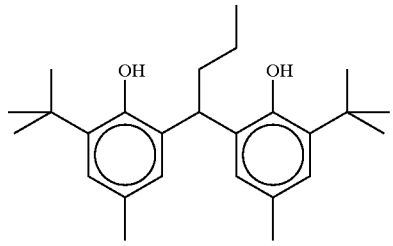

and

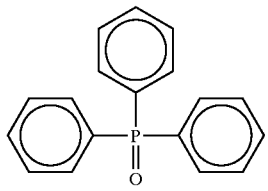

Reducing Agent 2

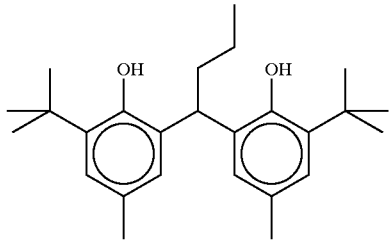

-continued

Hydrogen Bond-Forming Compound 1

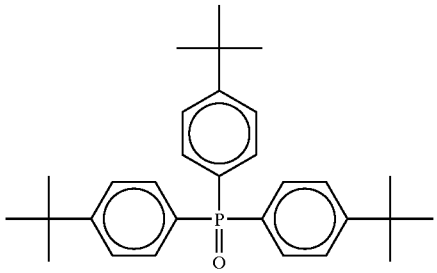

Polyhalogen Compound 1

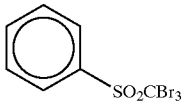

Polyhalogen Compound 2

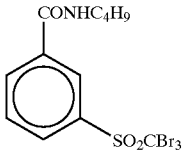

Mercapto Compound 1

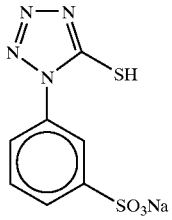

Mercapto Compound 2

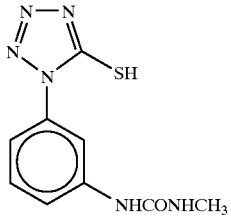

Phthalazine Compound 1

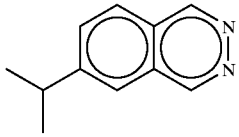

Development Accelerator 1

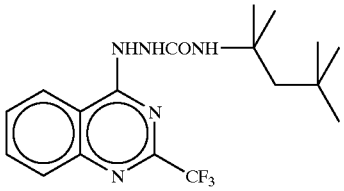

-continued

Development Accelerator 2

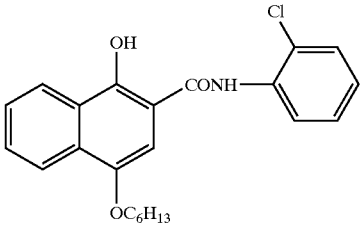

Color Tone Controlling Agent

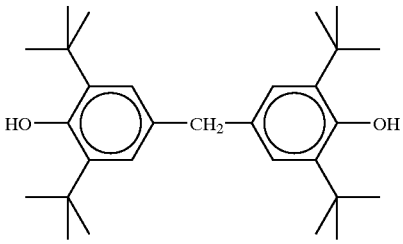

F-1

$CF_3(CF_2)_nCH_2CH_2SCH_2CH_2COOL_i$
Mixture of n = 5 to 11

F-2

$CF_3(CF_2)_nCH_2CH_2O(CH_2CH_2O)_mH$
Mixture of n = 5 to 11 and m = 5 to 15

F-3

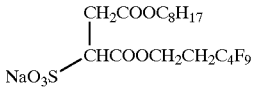

F-4

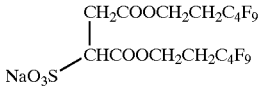

(Evaluation of Photographic Properties)

Each heat-developable photosensitive material thus obtained was cut into sheets measuring 356 mm by 432 mm, wrapped in a packaging material described below in surroundings of 25° C. and 50% RH, and stored at room temperature for 2 weeks.

(Packaging Material)

A laminate of 10 μm-thick PET, 12 μm-thick PE, 9 μm-thick aluminum foil, 15 μm-thick Ny and 50 μm-thick polyethylene containing 3% carbon black (oxygen permeability: 0.02 ml/atm·$m^2$·25° C.·day; moisture permeability: 0.10 g/atm·$m^2$·25° C.·day)

Each heat-developable photosensitive material was exposed by means of Fuji Medical Dry Laser Imager FM-DP L (equipped with 660 nm semiconductor laser generating power of 60 mW (IIIB) at the maximum) and heat-developed (with 4 built-in panel heaters set at 112° C., 119° C., 121° C. and 121° C., respectively), under conditions that the total heat-development time was adjusted to 24 seconds in the cases of the heat-developable photosensitive materials 101 to 103, and it was adjusted to 14 seconds in the cases of the heat-developable photosensitive materials 201 to 203. Evaluations of the images thus produced were conducted by a densitometer.

Each of the heat-developable photosensitive materials 103 and 203 according to the present invention produced images of good contrast.

(Evaluation of Background Color)

(1) Evaluation of Background Color Just After Processing

Each heat-developable photosensitive material was heat-developed (with 4 built-in panel heaters set at 112° C., 119° C., 121° C. and 121° C., respectively), under conditions that the total heat-development time was adjusted to 24 seconds in the cases of the heat-developable photosensitive materials 101 to 103, and it was adjusted to 14 seconds in the cases of the heat-developable photosensitive materials 201 to 203 without the exposure by means of Fuji Medical Dry Laser Imager FM-DP L (equipped with 660 nm semiconductor laser generating power of 60 mW (IIIB) at the maximum) to obtain image for evaluation of background color.

The samples thus obtained were placed on a standard light box, and color tone of background of each sample was visually evaluated.

Criterion for Visual Observation:

O: Having preferable blue color

X: Not preferable feeling although colored (2) Evaluation of Change in Background Color After Preservation The sample for evaluation of background color were cut into two pieces, and one piece was stored in a refrigerator and other piece was allowed to stand without overlaping each other on a desk in a room kept at 25° C. and 60% RH under a fluorescent lump of 1,500 lux for one week.

Then, the piece stored in a refrigerator was adapted to room temperature and both pieces were placed on a standard light box and color tone of background of each piece was visually evaluated to examine the degree of change in background color.

Criterion for Visual Observation:

O: Change was not recognized and had preferable feeling

X: Change was clearly recognized

The results obtained are shown in Table 1.

TABLE 1

| Heat-Developable Photosensitive material | Background Color after Processing | Change in Background Color after preservation | Remarks |
|---|---|---|---|
| 101 | ○ | X | Comparison |
| 102 | X | X | Comparison |
| 103 | ○ | ○ | Invention |
| 201 | ○ | X | Comparison |
| 202 | X | ○ | Comparison |
| 203 | ○ | ○ | Invention |

From the results shown above it can be seen that the heat-developable photosensitive materials 103 and 203 of the invention provide preferable blue tone of background color, which does not change upon the preservation and thus they are excellent.

EXAMPLE 2

(Production of Heat-Developable Photosensitive Materials 111 to 117 and 211 to 217)

Heat-developable photosensitive materials 111 to 117 and heat-developable photosensitive materials 211 to 217 were produced in the same manner as the heat-developable photosensitive materials 101 to 103 and heat-developable photosensitive materials 201 to 203 produced in Example 1, except that the kind and amount of the water-soluble phthalocyanine compound and the amount of the dispersion of Pigment 1 were changed as shown in Tables 2 and 3, in the emulsion layer, the interlayer, the first protective layer and the second protective layer on the side opposite to the back side of each of the Supports A2 and A12 provided with backing used in the heat-developable photosensitive materials 102 and 202.

TABLE 2

| Heat-Developable | Emulsion Layer (Coating Composition 1) | | Interlayer | | First Protective Layer | Second Protective Layer | |
|---|---|---|---|---|---|---|---|
| Photosensitive Material | Dispersion of Pigment 1 | Water-Soluble Pc | Dispersion of Pigment 1 | Water-Soluble Pc | Water-Soluble Pc | Water-Soluble Pc | Remarks |
| 102 | 33 g | — | 272 g | — | — | — | Comparison |
| 111 | 33 g | — | 192 g | 1 (346 g) | — | — | Invention |
| 112 | 33 g | — | 192 g | | 1 (346 g) | — | Invention |
| 113 | 33 g | — | 192 g | | — | 1 (346 g) | Invention |
| 114 | 33 g | — | — | 1 (1038 g) | — | — | Invention |
| 115 | — | 1 (126 g) | — | 1 (1038 g) | — | — | Invention |
| 116 | 33 g | — | 192 g | 2 (357 g) | — | — | Invention |
| 117 | — | 2 (130 g) | — | 2 (1071 g) | — | — | Invention |

Note:

Water-Soluble Pc: A water-soluble metal phthalocyanine compound.

Water-Soluble Pc 1: Kayafect Turquoise RN was diluted with water to make a 2 wt % aqueous solution.

Water-Soluble Pc 2: Phthalocyanine Compound shown below was diluted with water to make a 2 wt % aqueous solution.

TABLE 3

| Heat-Developable Photosensitive Material | Emulsion Layer (Coating Composition 2) Dispersion of Pigment 1 | Emulsion Layer (Coating Composition 2) Water-Soluble Pc | Interlayer Dispersion of Pigment 1 | Interlayer Water-Soluble Pc | First Protective Layer Water-Soluble Pc | Second Protective Layer Water-Soluble Pc | Remarks |
|---|---|---|---|---|---|---|---|
| 202 | 35 g | — | 272 g | — | — | — | Comparison |
| 211 | 35 g | — | 192 g | 1 (346 g) | — | — | Invention |
| 212 | 35 g | — | 192 g | | 1 (346 g) | — | Invention |
| 213 | 35 g | — | 192 g | | — | 1 (346 g) | Invention |
| 214 | 35 g | — | — | 1 (1038 g) | — | — | Invention |
| 215 | — | 1 (134 g) | — | 1 (1038 g) | — | — | Invention |
| 216 | 35 g | — | 192 g | 2 (357 g) | — | — | Invention |
| 217 | — | 2 (138 g) | — | 2 (1071 g) | — | — | Invention |

Note:
Water-Soluble Pc: A water-soluble metal phthalocyanine compound.
Water-Soluble Pc 1: Kayafect Turquoise RN was diluted with water to make a 2 wt % aqueous solution.
Water-Soluble Pc 2: Phthalocyanine Compound shown was diluted with water to make a 2 wt % aqueous solution.

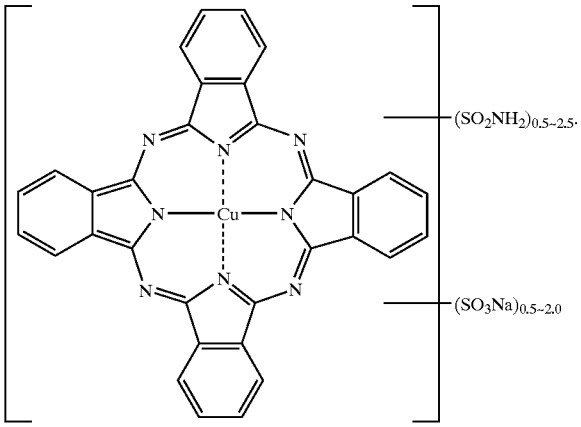

Phthalocyanine Compound (Production of Heat-Developable Photosensitive Materials 118 and 218 for Comparison)

Heat-developable photosensitive materials 118 and heat-developable photosensitive materials 218 were produced in the same manner as the heat-developable photosensitive materials 101 to 103 and heat-developable photosensitive materials 201 to 203 produced in Example 1, except that 925 g of a 1% aqueous solution of Blue Dye Compound 1 was used in place of 272 g of the 5% dispersion of Pigment 1 in the interlayer on the side opposite to the back side of each of the Supports A2 and A12 provided with backing used in the heat-developable photosensitive materials 102 and 202.

(Evaluation of Heat-Developable Photosensitive Material)

(1) Evaluation of Image

Each heat-developable photosensitive material was exposed by means of Fuji Medical Dry Laser Imager FM-DP L (equipped with 660 nm semiconductor laser generating power of 60 mW (IIIB) at the maximum) and heat-developed (with 4 built-in panel heaters set at 112° C., 119° C., 121° C. and 121° C., respectively), under conditions that the total heat-development time was adjusted to 24 seconds in the cases of the heat-developable photosensitive materials 111 to 118, and it was adjusted to 14 seconds in the cases of the heat-developable photosensitive materials 211 to 218. Evaluations of the images thus produced were conducted by a densitometer.

Each of the heat-developable photosensitive materials 111 to 117 and 211 to 217 produced images of good contrast. On the other hand, in the heat-developable photosensitive materials 118 and 218 for comparison, fine lines in the letter image portion were not clear.

(2) Evaluation of Background Color Just After Processing

Each heat-developable photosensitive material was heat-developed (with 4 built-in panel heaters set at 112° C., 119° C., 121° C. and 121° C., respectively), under conditions that the total heat-development time was adjusted to 24 seconds in the cases of the heat-developable photosensitive materials 111 to 118, and it was adjusted to 14 seconds in the cases of the heat-developable photosensitive materials 211 to 218 without the exposure by means of Fuji Medical Dry Laser Imager FM-DP L (equipped with 660 nm semiconductor laser generating power of 60 mW (IIIB) at the maximum) to obtain image for evaluation of background color.

The samples thus obtained were placed on a standard light box, and color tone of background of each sample was visually evaluated.

Criterion for Visual Observation:

O: Having preferable blue color

X: Not preferable feeling although colored (3) Evaluation of Change in Background Color After Preservation The sample for evaluation of background color were cut into two pieces, and one piece was stored in a refrigerator and other piece was allowed to stand without overlaping each other on a desk in a room kept at 25° C. and 60% RH under a fluorescent lump of 1,500 lux for one week.

Then, the piece stored in a refrigerator was adapted to room temperature and both pieces were placed on a standard light box and color tone of background of each piece was visually evaluated to examine the degree of change in background color based on the piece stored in a refrigerator.

Criterion for Visual Observation:

O: Change was not recognized and had preferable feeling

X: Change was clearly recognized

The results of (2) and (3) obtained are shown in Table 4.

TABLE 4

| Heat-Developable Photosensitive material | Background Color after Processing | Change in Background Color after preservation | Remarks |
|---|---|---|---|
| 102 | X | X | Comparison |
| 111 | ○ | ○ | Invention |
| 112 | ○ | ○ | Invention |
| 113 | ○ | ○ | Invention |
| 114 | ○ | ○ | Invention |
| 115 | ○ | ○ | Invention |
| 116 | ○ | ○ | Invention |
| 117 | ○ | ○ | Invention |
| 118 | ○ | X | Comparison |
| 202 | X | X | Comparison |
| 211 | ○ | ○ | Invention |
| 212 | ○ | ○ | Invention |
| 213 | ○ | ○ | Invention |
| 214 | ○ | ○ | Invention |
| 215 | ○ | ○ | Invention |
| 216 | ○ | ○ | Invention |
| 217 | ○ | ○ | Invention |
| 218 | ○ | X | Comparison |

From the results shown above it can be seen that the heat-developable photosensitive materials 111 to 117 and 211 to 217 of the invention provide preferable blue tone of background color, which does not change upon the preservation and thus they are excellent.

The heat-developable photosensitive material according to the present invention provides preferable blue tone on background of image after processing, causes no problem on change in the background color with the lapse of time under practical preservation conditions, and provides images having high sharpness. The heat-developable photosensitive material of the invention is particularly suitable for output of medical images.

The entire disclosure of each and every foreign patent application from which the benefit of foreign priority has been claimed in the present application is incorporated herein by reference, as if fully set forth herein.

While the invention has been described in detail and with reference to specific examples thereof, it will be apparent to one skilled in the art that various changes and modifications can be made therein without departing from the spirit and scope thereof.

What is claimed is:

1. A heat-developable photosensitive material comprising at least one light-sensitive layer containing an organic silver salt, light-sensitive silver halide and a reducing agent and at least one light-insensitive layer on a support, wherein the heat-developable photosensitive material comprises a water-soluble metal phthalocyanine compound.

2. The heat-developable photosensitive material as claimed in claim 1, wherein the water-soluble metal phthalocyanine compound is a copper phthalocyanine compound.

3. The heat-developable photosensitive material as claimed in claim 1, wherein the water-soluble metal phthalocyanine compound is a compound represented by the following formula (Pc-1):

$$MPc(SO_3H)_n(SO_2NHR)_m \quad \text{(Pc-1)}$$

in formula (Pc-1), Pc represents a phthalocyanine skeleton; R represents a hydrogen atom, an alkyl group which may have a substituent, an aryl group which may have a substituent or a heterocyclic group which may have a substituent; n represents a number of from 0 to 4; m represents a number of from 1 to 4; and M represents a metal atom or an oxide, hydroxide or halide thereof.

4. The heat-developable photosensitive material as claimed in claim 1, wherein the water-soluble metal phthalocyanine compound is present on the same side as the light-sensitive layer provided on the support.

5. The heat-developable photosensitive material as claimed in claim 1, which further comprises a polyhalogen compound represented by formula (H), (H1) or (H2) shown below incorporated into at least one of the light-sensitive layer and the light-insensitive layer:

$$Q—(Y)_n—C(Z_1)(Z_2)_X \quad \text{(H)}$$

in formula (H), Q represents an alkyl group, an aryl group or a heterocyclic group; Y represents a divalent connecting group; n represents 0 or 1; $Z_1$ and $Z_2$ each independently represent a halogen atom; and X represents a hydrogen atom or an electron withdrawing group, (H1)

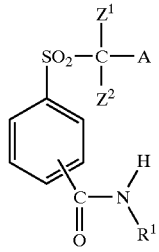

in formula (H1), $Z^1$ and $Z^2$ each independently represent a halogen atom; A represents a hydrogen atom or a halogen atom; and $R^1$ represents an alkyl group having from 2 to 12 carbon atoms, which may have one or more substituents, an alkenyl group having from 2 to 12 carbon atoms, which may have one or more substituents or an alkynyl group having from 2 to 12 carbon atoms, which may have one or more substituents, (H2)

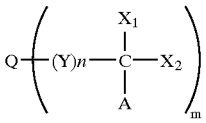

in formula (H2), $X_1$ and $X_2$ each independently represent a halogen atom; Y represents a divalent connecting group; A represents a hydrogen atom, a halogen atom or an electron withdrawing group other than the halogen atom; m represents an integer of from 1 to 4; Q represents a heterocyclic group; and n represents an integer of from 0 to 3.

6. The heat-developable photosensitive material as claimed in claim 1, wherein the water-soluble metal phthalocyanine compound is incorporated into a layer provided on the side of the support opposite to the side provided with the light-sensitive layer.

7. The heat-developable photosensitive material as claimed in claim 1, which further comprises a base precursor compound incorporated into a layer provided on the side of the support opposite to the side provided with the light-sensitive layer.

8. The heat-developable photosensitive material as claimed in claim 1, which further comprises a free ion of metal same as the central metal of the water-soluble metal phthalocyanine compound in an amount of not more than 200 mol % based on the content of water-soluble metal phthalocyanine compound.

9. The heat-developable photosensitive material as claimed in claim 1, which further comprises a water-soluble organic solvent in an amount of from 1 to 500 moles per mol of the water-soluble metal phthalocyanine compound.

10. The heat-developable photosensitive material as claimed in claim 9, wherein the water-soluble organic solvent is urea.

* * * * *